United States Patent [19]

Sullivan

[11] Patent Number: 4,505,182

[45] Date of Patent: Mar. 19, 1985

[54] FIREARM TRIGGER MECHANISM

[75] Inventor: Leroy J. Sullivan, Singapore, Singapore

[73] Assignee: Chartered Industries of Singapore Private Ltd., Jurong Town, Singapore

[21] Appl. No.: 624,032

[22] Filed: Jun. 25, 1984

Related U.S. Application Data

[62] Division of Ser. No. 520,117, Aug. 3, 1983, Pat. No. 4,475,437, which is a division of Ser. No. 280,740, Jul. 6, 1981, Pat. No. 4,416,186.

[30] Foreign Application Priority Data

Dec. 11, 1980 [GB] United Kingdom ..... 8039739

[51] Int. Cl.[3] ..... F41D 11/02

[52] U.S. Cl. ..... 89/132; 42/69 A

[58] Field of Search ..... 42/69 A; 89/132, 148

[56] References Cited

U.S. PATENT DOCUMENTS

| | | | |
|---|---|---|---|
| 3,010,237 | 11/1961 | Colby | 42/69 |
| 3,360,878 | 1/1968 | Robinson | 42/16 |
| 3,670,442 | 6/1972 | Kennedy et al. | 42/70 F |

FOREIGN PATENT DOCUMENTS

| | | |
|---|---|---|
| 754444 | 10/1952 | Fed. Rep. of Germany . |
| 131129 | 1/1929 | Switzerland . |
| 454673 | 4/1968 | Switzerland . |
| 1154234 | 6/1969 | United Kingdom . |

*Primary Examiner*—Stephen C. Bentley

*Attorney, Agent, or Firm*—Ladas & Parry

[57] ABSTRACT

A gun having a trigger mechanism comprising a pivotally mounted trigger (73) which is connected to rotate a pivotal sear and a reciprocal bolt carrier assembly having lugs (325) which are arranged to engage with the rear of the sear and a notch (717) in the top of the sear. Mounted on the pivotal axis of the trigger is a prop member (745) which is arranged to cooperate with an L-shaped nose (720) of the sear so that when the trigger is pulled to rotate the sear in a first direction out of engagement with the lugs (325) the prop member (745) is initially prevented from moving with the trigger by the nose (720) and when the lugs are released by the sear the sear is further rotated in the first direction by the lugs contacting the upper sear surface to free the member to move toward the trigger and under the nose (720). The prop member is then positioned under the nose (720) and thereby prevents the sear from rotating in a direction counter to said first direction until the trigger is released.

3 Claims, 68 Drawing Figures

Figure 1:
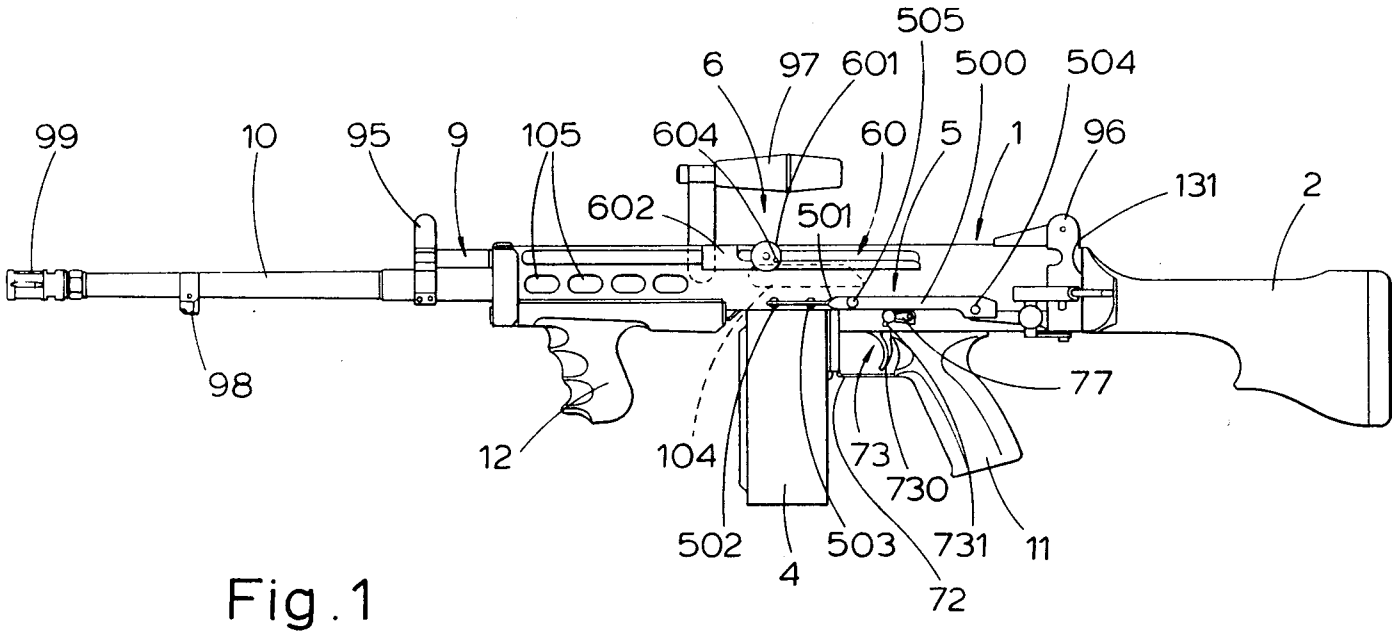

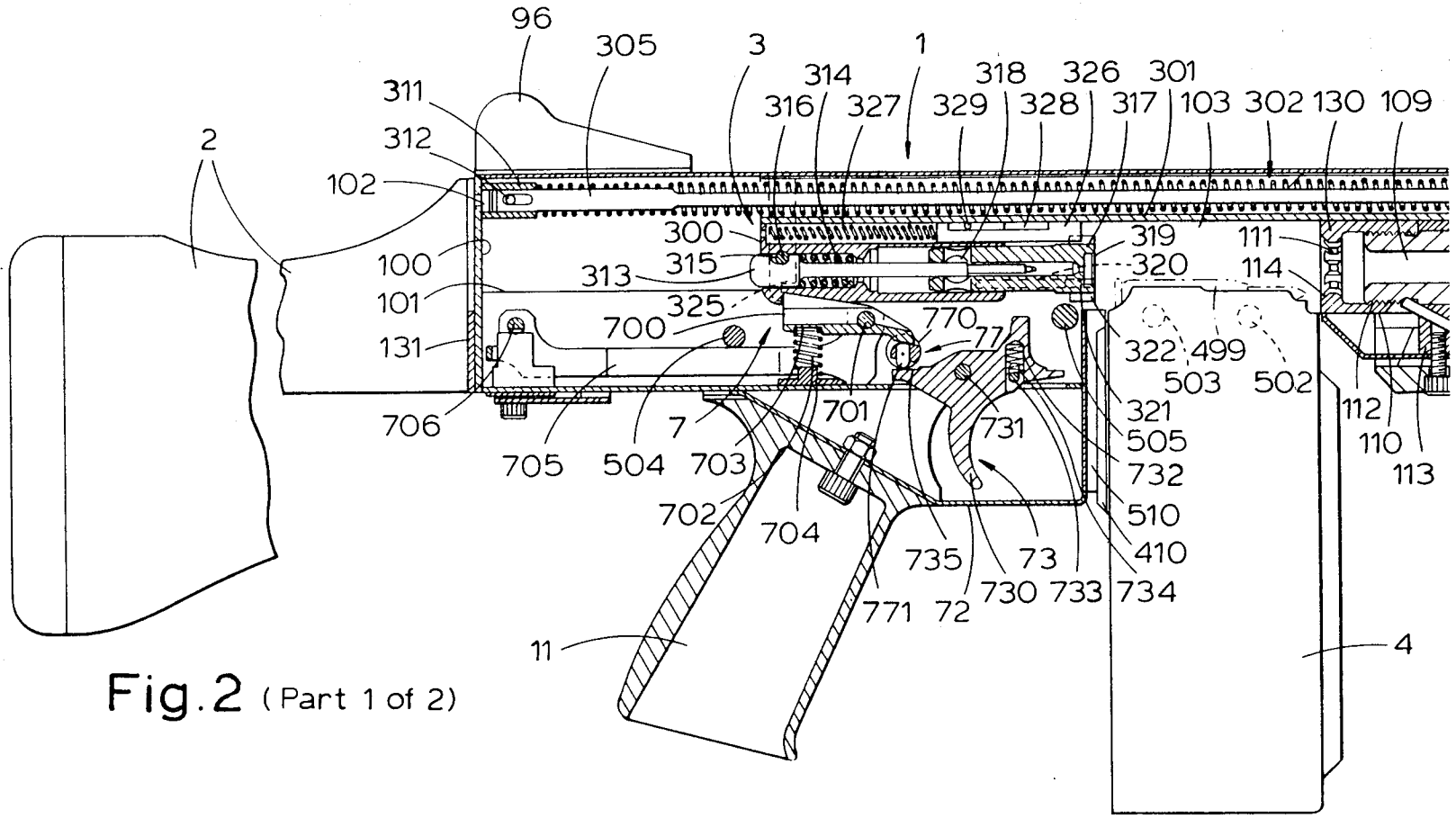
Fig. 2 (Part 1 of 2)

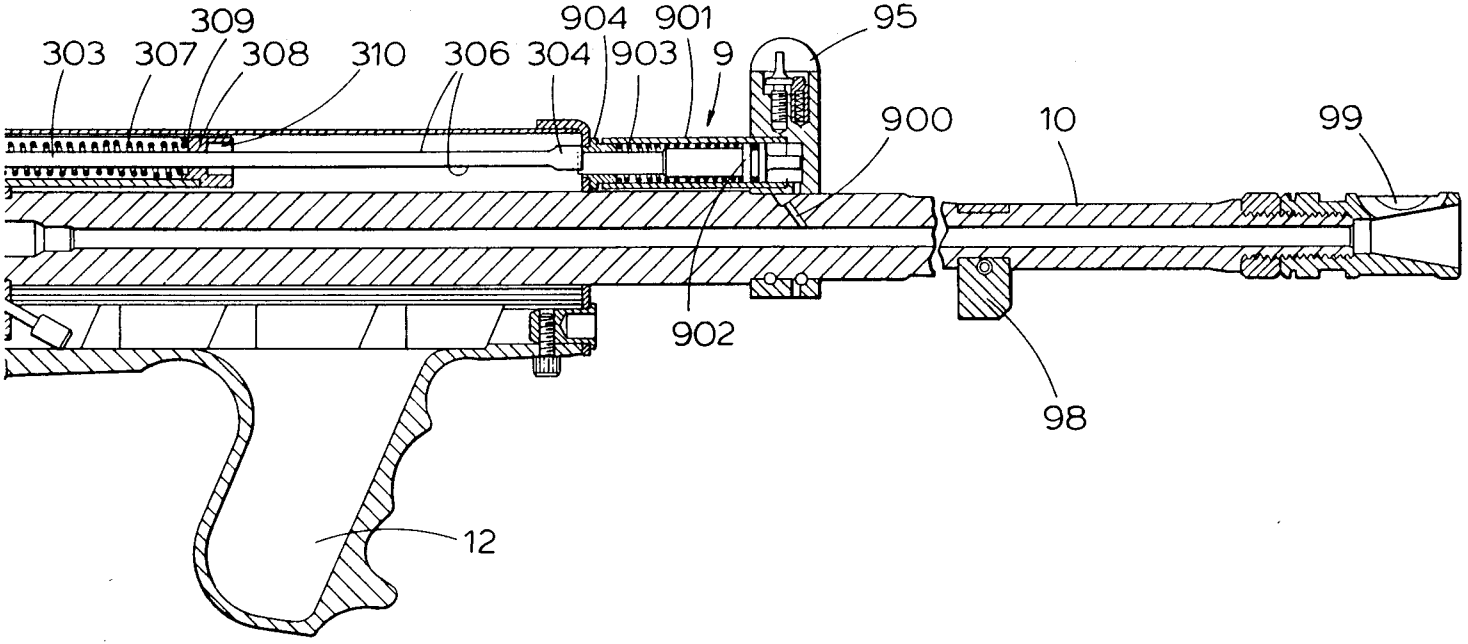
Fig. 2 (Part 2 of 2)

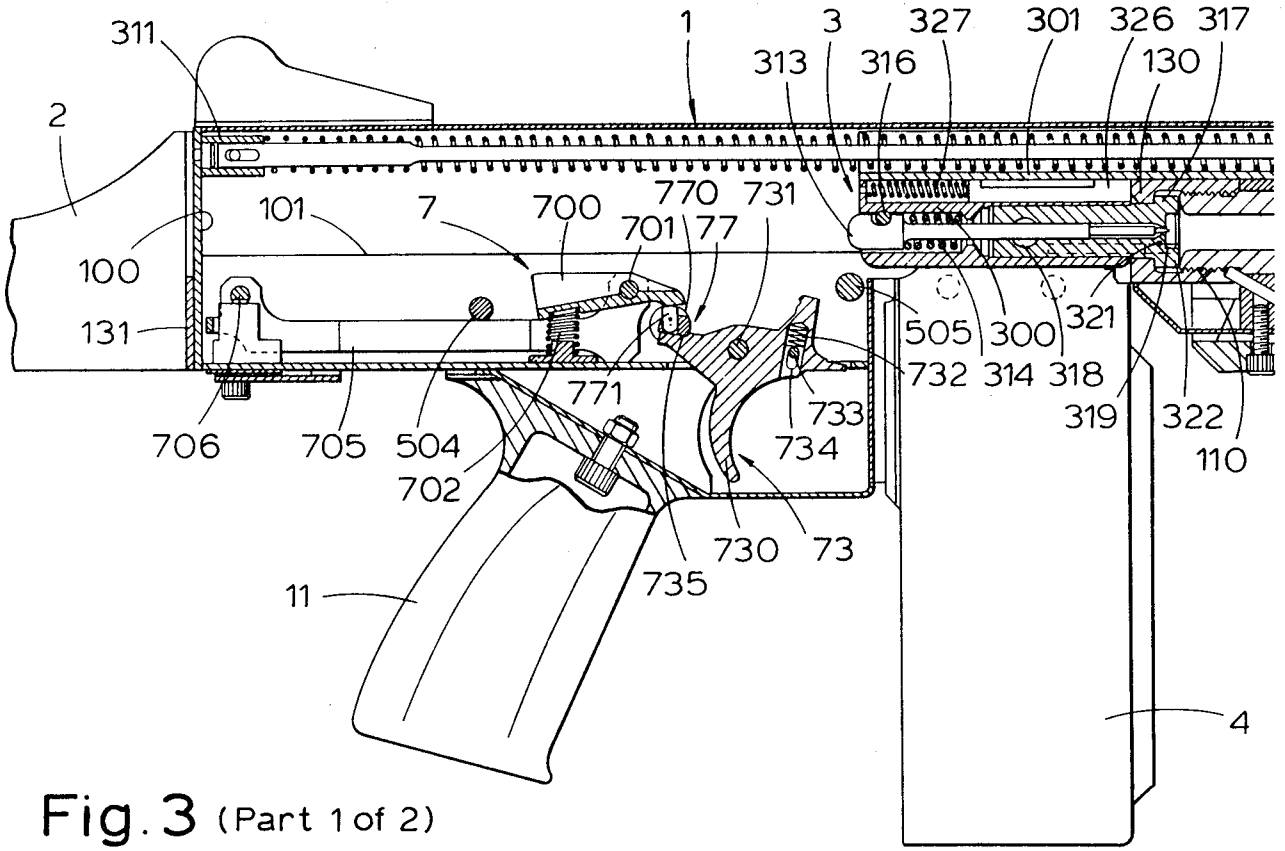
Fig. 3 (Part 1 of 2)

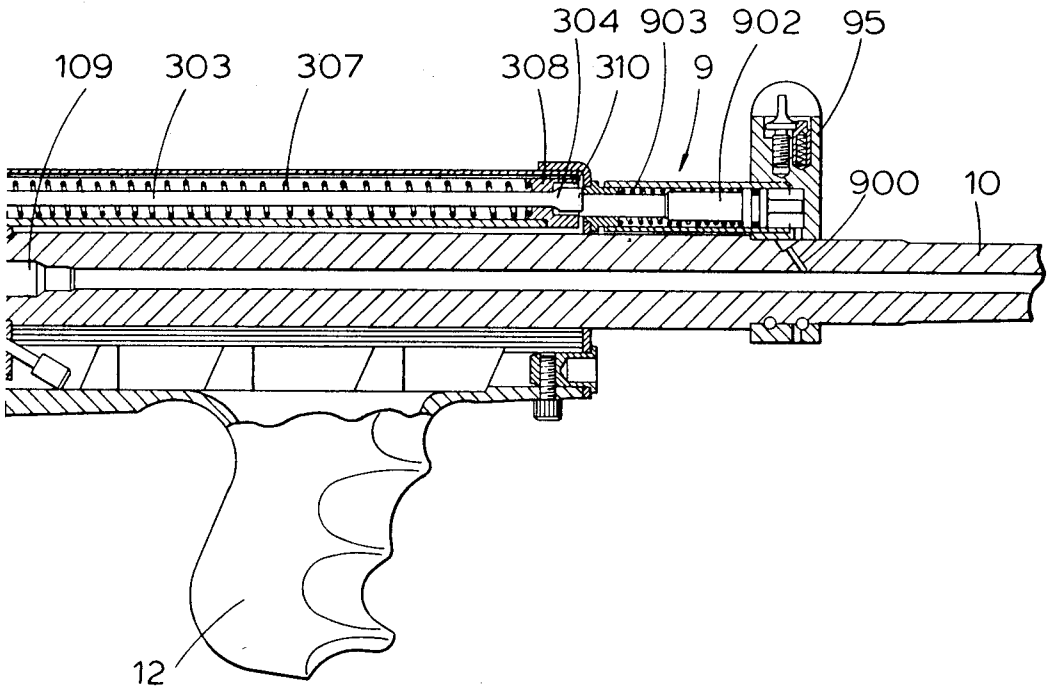
Fig. 3 (Part 2 of 2)

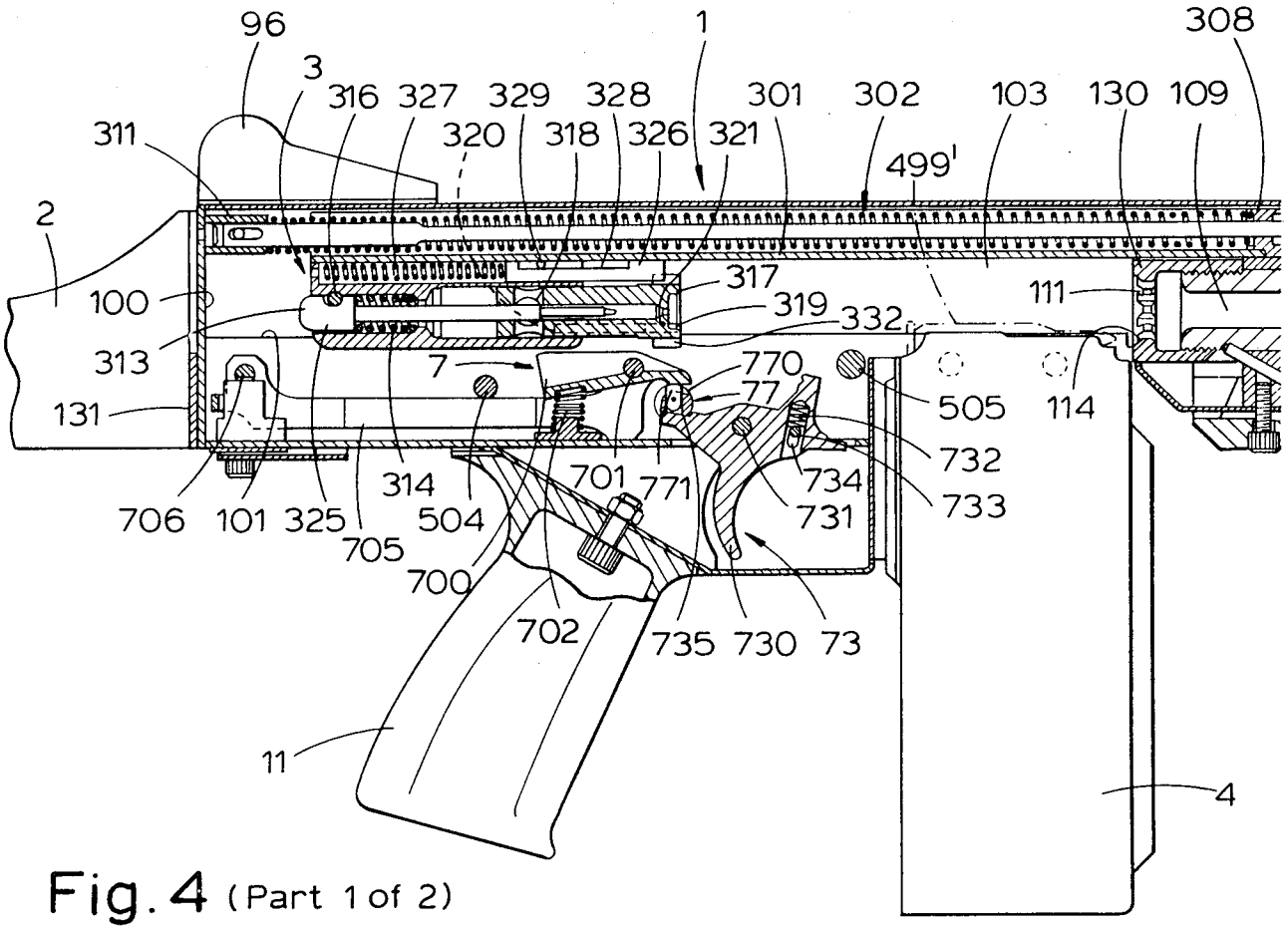
Fig. 4 (Part 1 of 2)

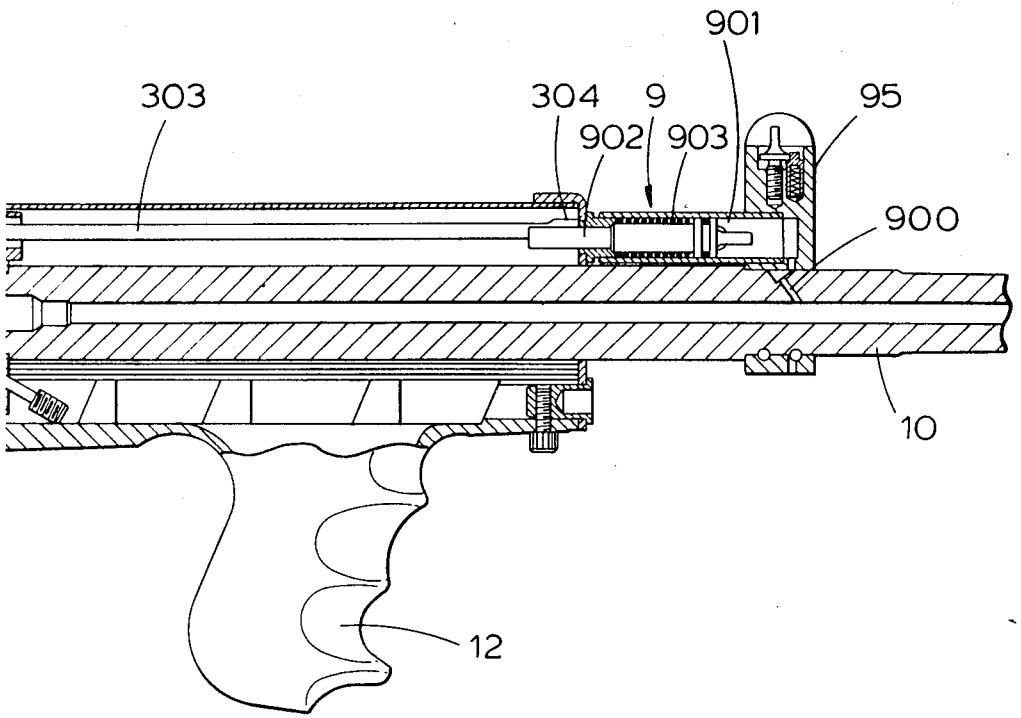
Fig. 4 (Part 2 of 2)

D
132
135
133
96
116
B
117
B
128
72
511
527
104
510
C
C
108
118
1
115
105
122
123
120
121
126
124
119
125
D 115
104
107
116
108
107

115
101
117
116
133
131
134
134
132
132
116
527
510
511
107
107
106
118
118
115
120
120
119
125

FIREARM TRIGGER MECHANISM

CROSS REFERENCE TO RELATED APPLICATION

This application is a divisional of Ser. No. 520,117 filed 8.3.83 now U.S. Pat. No. 4,475,437 which in turn was a divisional of Ser. No. 280,740 filed 7.6.81 now U.S. Pat. No. 4,416,186.

This invention relates to firearms and parts thereof, and in particular, although not exclusively to gas operated automatic guns, although it may also be used with semi-automatic guns.

Automatic guns are well known and the term is applied to a gun in which, when a trigger is pulled, a plurality of cartridges are fired serially for as long as the trigger is held or until the last cartridge is fired. Semi-automatic guns are similarly well known and the term is usually applied to a gun which, when a trigger is pulled, fires a cartridge subsequently ejects the cartridge, cocks the bolt and chambers a next cartridge automatically but does not fire said next cartridge until the trigger is released and again pulled to repeat the cycle. Automatic and semi-automatic guns are generally of three different kinds namely, recoil operated, blow-back operated or gas operated and the present invention relates to the latter form of operation.

Automatic and semi-automatic guns are well discussed in literature and examples are "Small Arms of the World" by W. H. B. Smith, tenth edition completely revised by Joseph E. Smith published by Stackpole Books, Harrisburg, Pa., U.S.A., and Janes Infantry Weapons 1977 edited by Dennis H. R. Archer published by Janes Publishing Company, and a known type of gas operated, automatic gun is the United States 7.62 mm NATO M.60 machine gun described at pages 695–699 in Small Arms of the World and Pages 332–337 of Janes Infantry Weapons and the 5.56 mm AR18 rifle described at page 656 in Small Arms of the World and pages 229–231 of Janes Infantry Weapons.

A gas operated gun, such as the AR18 has a receiver housing a bolt/bolt carrier assembly which is urged toward a barrel by a drive spring and actuated by a trigger through the intermediary of a sear. A radial drilling through the wall of the barrel is provided at a predetermined distance along the barrel length and externally in cooperating with the drilling is a gas piston and cylinder assembly. In operation the bolt/bolt carrier assembly strips and feeds a cartridge from a magazine into a feed area within the receiver and the bolt drives the cartridge over a feed ramp within the normally provided barrel extension to chamber the cartridge. The bolt is usually then rotated into a locked position so that the cartridge is securely held within the chamber. Because the bolt/bolt carrier assembly are slidably and rotatably movable with respect to one another and the firing pin is carried by the bolt carrier assembly, final forward momentum of the bolt carrier assembly rotates and locks the bolt as it drives the firing pin into the cartridge to thereby discharge the cartridge. Gas, is produced by the firing action of the cartridge, which gas enters the radial drilling once the bullet has past the drilling and enters the gas cylinder whilst the bullet is still within the barrel. Of course, once the bullet leaves the barrel the gas is dissipated. The cylinder is arranged to be the movable part and the cylinder is connected to the bolt carrier assembly by a rod so that as the cylinder fills with gas it is driven by the gas, the bolt carrier is driven rearwardly thereby unlocking the bolt, extracting the spent cartridge, ejecting the same and cocking the gun for a further series of operations. A further, similar, cycle is then produced for as long as the trigger is squeezed and of course for as long as there are cartridges to provide the gas discharge. It is to be noted that the movable cylinder does not have the same length of travel as the bolt carrier assembly.

The AR18 rifle along with several other automatic weapons fires from a closed bolt position which means that the bolt/bolt carrier assembly are all the way forward and a round has been chambered by the preceding cycle so that when the trigger is pulled only the hammer or other light weight firing mechanism moves; the bolt and carrier assembly do not move until after firing takes place and there is no consequential motion or force applied to the gun before the instant of firing. This is in distinction to a gun which fires from the open bolt position (such as an M-60 machine gun) where the bolt/bolt carrier assembly are held back behind the feed area by the previous cycle being interupted and the bolt carrier being caught by a sear before the bolt/bolt carrier assmbly are driven all the way forward by the drive spring. Thus, initially no cartridge has been chambered and when the trigger is pulled the bolt/bolt carrier assmbly is released and driven forward by the main spring to then chamber and fire the cartridge. When firing from the open bolt position there is a rearward force applied to the gun before the instant of firing due to the reaction of the drive spring in pushing the bolt carrier forward.

In the cycle of operations the bolt carrier travels to a rearward position thereby overtravelling the feed, e.g. the magazine delivery port, so as to permit a further round to be fed and chambered.

In known gas operated guns it is normal for the bolt carrier to impact the rear wall of the receiver to limit the extent of rearward travel and in many known guns, such as the M60 the impact is through the intermediary of a buffer.

By the term "buffer" as used herein is meant a means which is interposed between the bolt carrier assembly and the stop to rapidly retard the bolt carrier and which has a force at least twice greater than that of all the other combined spring force averages.

Thus, in known gas operated guns, not only is there a recoil from the gun when the cartrdige fires but there is also a recoil when the carrier assembly strikes the rear receiver wall even if through the intermediary of a buffer. The effect of such recoil upon a user of the gun is that whilst the first round may have been on target, subsequent rounds tend to drive the barrel of the weapon upward so that shots are fired above the target. It must be remembered that such automatic weapons usually fire of the oder 6–12 rounds per second and it takes some time, of the order of 1–2 seconds before the user of the weapon is able to compensate for the recoil effect and bring his aim back on to target. Such weapons due to loss of control by a user tend to be inaccurate.

Although the loss of control has been substantially mitigated in both blow-back and recoil guns by providing a softer recoil, the solutions employed in those guns have not been thought applicable to gas operated guns because of the operational differences between the types of guns. The recoil operated gun has fallen into disfavour due to its complexity in requiring both the barrel and bolt/bolt carrier assembly to be moved backwards so as to recock the gun and blow-back guns, although still in use by infantry are operable only with low powered short range cartridges. For these reasons it is highly desirable that the gas operated gun which is generally preferred by present day infantry due to the fact that it is not so susceptible to fouling by mud and grit etc., be provided with improved accuracy when operating in a fully automatic mode.

In a gas operated gun numerous attempts have been made to lessen the effect of the bolt carrier striking the rear receiver wall so as to provide zero restitution. The term "restitution" means that proportion of energy from an impacting mass which is returned to that mass upon striking a fixed, solid object. Thus, if a steel bolt carrier strikes a steel rear wall of the receiver most of the energy of the impacting carrier assembly will be returned to the carrier in the opposite direction by the rear receiver wall. In such an instance there is thus 100% restitution, i.e., very high recoil and the AR18 is an example.

In the M16 rifle (described at pages 650–653 in Small Arms of the World and pages 226–228 of Janes Infantry Weapons) an attempt has been made to reduce restitution by providing a buffer carried by the rear of the bolt carrier assmbly so as to absorb some of the energy of the impacting bolt on the rear receiver wall. The buffer is compressible between the rear receiver wall and the rear of the bolt carrier assembly. Although the coefficient of restitution of the M16 is considered to be low, it is still found that a significant recoil is caused by the rear receiver wall being impacted by the buffer/bolt carrier assembly.

The recoil effect on a gas operated gun is normally considered less than that of a bolt action gun which, although not automatic, contains many similarities with a gas operated gun. In this respect they both have a locked and rigid structure that tries to deliver the cartridge impulse during "bore" time. The lighter recoil has been attributed to the gas in the cylinder not only driving the moving member, be it the cylinder or piston, rearwardly but also the gas driving the front wall of the fixed member in a forward direction. Thus, gas operated guns tend to have a "softer" action than the aforesaid bolt action gun. Nonetheless, the effect of recoil is still as described above, i.e., the user loses aim after the first shot has been fired and it is evident that the cause of the user losing aim is because of the number of differing recoil actions that occur which are experienced by a user as a series of separate sharp blows. Various attempts to overcome recoil have been made and reference may be paid to "Hatcher's Note Book" by Julian S. Hatcher, published in the United States of America by the Telegraph Press, 3rd Edition, 2nd printing April 1976, page 262 et seq.

Because of the action of recoil on the controllability of known gas operated guns the hit probability of such guns is poor. Attempts to improve the hit probability of such gas operated guns include 3 shot burst limiters, high rate rifles that fire 3 to 4 shots extremely quickly so that the gun does not have time to move off target and duplex or triplex cartridges that fire 2 or 3 bullets with each shot. None of these devices have proved successful and have merely shown the desperation of designers to improve the accuracy of a gas operated automatic gun. It is a broad object of this invention to provide an improved firearm and in particular an improved gas operated gun.

Known bolt operating assemblies are usually of two types, namely a bolt carrier type, to which a first feature of the present invention belongs or an operating rod type. In the latter type the bolt and operating rod are each separately guided in the receiver and the operating rod extends forward of the breach (an example is the M60). In distinction the bolt carrier type has the bolt contained within the carrier and the carrier alone is guided by the receiver and usually no part of the assembly extends forward of the breach (an example is the M-16). It is desirable to extend a part of the carrier forward of the bolt to improve guiding, provide drive spring room and increase weight without increasing receiver cross-section or length, but known extended bolt carrier tend to be of complex construction.

It is an object of a first feature of this invention to provide a bolt operating assembly of the extended bolt carrier type which is simple to produce.

In automatic and semi-automatic guns the magazine holding the cartridges is required to be rigidly and accurately located in a feed position so as to ensure correct feeding of the cartridges from the feed area into the gun chamber. Furthermore, it is a requirement that the magazine be changeable in as short a time as possible. At present there are two types of magazine in general use, namely a flat box-type magazine in which the cartridges are stacked in either a single column or a double column or a drum magazine where the cartridges are located on one or more spiral or circular paths.

With guns where only a flat box magazine is intended to be used, a magazine well of the gun extends downwardly a predetermined distance and surrounds the magazine on all sides, the long magazine well strengthening the receiver and preventing the magazine from moving fore and aft, and sideways with respect to the barrel axis.

In a gun intended to use solely a drum magazine, the long downward sides of the magazine well are omitted. Further it is desirable with drum magazines that the height of the cartridge feedway from the circular path within the magazine to the magazine feed lips be kept to a minimum, since the lipped portion forming the feedway is susceptible to damage and because cartridges in a long feedway are not readily controlled in that they may not enter the feed ramp of the gun with the required alignment. Additionally, it is desired to maintain the overall depth of the gun from the top of the barrel to the bottom of the magazine to a minimum. The location of a drum magazine is commonly accomplished by adding a key to the rear of the magazine to prevent sideways rocking and, to prevent fore and aft rocking of the magazine, either the long downward front wall of the magazine well is retained or a latch locks into the front wall of the magazine.

In many circumstances it is required that a gun be able to use both flat box magazines and drum magazines, and such a gun is described in "Small Arms of the World" by W. H. B. Smith, tenth edition, completely revised by Joseph E. Smith (referred to above) at page 674, where a vertical T-shaped keyway to the rear of the magazine well is used for insertion of a flat box magazine and a further horizontal I-shaped keyway at the front of the magazine well is used in which a drum magazine can alternatively be slid.

A second feature of the present invention seeks to provide a magazine well and latching assembly which can be used in common with both flat box magazines and drum magazines.

As described above, in a gas operated gun, it is known that when a cartridge is fired gases are produced which, when a bullet passes a gas port extending through the side of a barrel, so the gases enter the gas port to drive a piston operating within a cylinder. The piston is arranged to drive the normally provided bolt carrier assembly rearwardly to unlock the bolt, pull the bolt rearwardly, extract the cartridge, eject the cartridge and cock the gun in readiness for a further round to be fired. It has been found with known guns that, in contrast to the normal recoil action, when gas enters the gas cylinder so as impulse in a forwards direction with respect to the longitudinal axis of the barrel causes the barrel to be deflected downwardly with respect to its usual fixture point in the receiver at the barrel extension. Such a deflection at the end of the barrel, remote from the barrel extension, results in a considerable loss of accuracy.

It is an object of a third feature of this invention to seek to reduce the aforementioned deflection and to provide a construction of receiver which is inexpensive to produce. It is also part of the object of the third feature of this invention to produce an inexpensive barrel assembly.

It is known that automatic or semi-automatic guns require to have a manual cocking handle assembly so that even for an automatic gun the gun is initially manually cocked for subsequent automatic operation.

There are two basic types of manual cocking handle arrangements for guns. In the first, the cocking handle is fixed to the bolt carrier assembly and travels with the bolt carrier assembly whilst the assembly is reciprocating, and in the second the cocking handle moves only during the cocking operation and, during the firing period of reciprocation by the bolt carrier assembly, the cocking handle is stationarily positioned forwardly on the gun receiver. The present invention, in a fourth feature, is of the second type.

Because it is required that a gun be manually cocked rapidly, it is desirable that the operation of cocking be as natural to a user as possible. In this respect when the cocking handle is in its stationary position on the gun receiver it is necessary to lock the cocking handle to the receiver in some manner. A known manner (such as the M16) in which the cocking handle is released is to provide a lever which is squeezed and then the cocking handle manually pulled rearwardly to cock the gun. In a further type of cocking handle lock, it is required that the cocking handle be pulled outwardly, sideways, from the receiver and then pulled rearwardly. Both the aforementioned systems of unlocking the cocking handle from the receiver do not facilitate a particularly natural action for a user's hand.

A fourth feature of this invention seeks to provide a cocking handle arrangement which is simple to produce and easy to use.

Known buttstock arrangements are generally of four types:

1. a fixed buttstock which is factory fitted and removed by special tools, 2. a folding buttstock in which the buttstock swivels on a hinge and can be folded to rest against one side of the receiver, 3. a detachable buttstock in which the entire buttstock can be separated from the gun by releasing a retaining catch, and 4. a telescoping buttstock.

It has, however, always been a feature of such buttstocks that due to their securing arrangements only one buttstock is to be used for a particular gun.

In a fifth feature, the present invention seeks to provide a buttstock securing arrangement in which different types of buttstocks may be fitted to a gun and which are interchangeable one with another.

An object of a sixth feature of this invention is to provide a sear buffer of simple construction.

A seventh feature of this invention seeks to provide a sear actuator having improved safety.

In an automatic or semi-automatic gun of the kind which fire from the open bolt position it is known to provide a reciprocating bolt carrier assembly which is selectively held in readiness for release and firing by a pivotable sear which, in turn, is actuated by a pivotable trigger. In such guns, it is usual for the bolt carrier assembly to be provided with a sear engaging lug which is arranged to engage with the top rear portion of the sear and, in this manner, when the sear engaging lug engages with the top rear portion of the sear the bolt carrier assembly is prevented from moving forwardly to a firing position. In a gun, such as the M60 machine gun, described at pages 695–699 in Small Arms of the World by W. H. B. Smith, tenth edition completely revised by Joseph E. Smith published by Stackpole Books, Harrisburg, Pa., U.S.A., and pages 332–337 of Janes Infantry Weapons 1977 edited by Dennis H. R. Archer published by Janes Publishing Company, the bolt carrier assembly is held back behind the cartridge feed station by the previous gun cycle being interrupted. In this respect the bolt carrier is caught by the sear before the bolt carrier assembly is driven all the way forward by the bolt carrier assembly drive spring. Because it is common for a firing cycle to be completed with the bolt carrier assembly all the way forward, it is customary for a manual cocking handle to be provided to draw the bolt carrier assembly rearwardly so that the sear engaging lug engages with the sear and to thereby permit a cartridge to rise from, for example, a magazine into the receiver feed area of the gun.

To enable the cartridge to rise into the feed area, it is obviously necessary for the bolt to be withdrawn behind the base of the cartridge. However, it will be appreciated that if in manually cocking, or for that matter if the gun is dropped on its buttstock, the bolt carrier assembly can be withdrawn rearwardly sufficiently for a cartridge to rise into the feed area but insufficiently for the sear engaging lug to engage with the sear. To overcome this problem, it is known to provide a notch in the top of the sear in which the sear lug may engage at a point in the forward cycle of the bolt prior to chambering the cartridge, locking the bolt against the barrel, and firing the cartridge.

It has, however, been found that with such a notch in the top of the sear when the trigger is pulled the lug tends to abrade a forward edge of the notch thereby damaging both the lug and the notch. Stopping the bolt on the notch then has the undesirable result in that a cartridge may be partly stripped from the magazine and displaced in the feed area and may even be partially chambered, possibly resulting in prevention of removal of the magazine. Alternatively, if the last round is fired and the now empty magazine is replaced by a fresh magazine, because the bolt stripping shoulder will have stopped forward of the cartridge base, the bolt will move forwardly when the trigger is pulled and the bolt released from the notch.

An eigth feature of this invention seeks to provide an automatic or semi-automatic gun having a trigger mechanism in which the foregoing defect is at least partially mitigated.

It is known to provide a rifle or machine gun with a rear sight which is adjustable over a predetermined hit range of the gun. One such known rear sight employs a ramp mounted in an axial direction along the top rear of the gun receiver and along which a slider moves so that at the lowest position of the ramp where the sight aperture is at its lowest point with regard to the gun receiver the weapons aim is set at its closest range and at the top of the ramp, with the sight aperture at its furthest point from the receiver, the weapon sight is set at maximum range.

With such a sight a pivotal bar is often used along which the slider carrying an additional sight aperture is movable, the slider cooperating with the ramp. A releasable latch is usually provided between the bar and slider formed by a series of axially aligned slots in one side of the bar and a spring device on the slider engaging with respective ones of the slots. It is also known to provide the pivotal bar with 90° rotation so that by using the additional sight aperture mounted in the slider the bar may be located perpendicularly with respect to the receiver and the slider then moves perpendicularly to the receiver. Such an arrangement provides the sight with extended range.

However, for manufacturing reasons, axially (with respect to the receiver) aligned slots in the bar can only provide a course pitch so that very sensitive range adjustment cannot be made. The lack of sensitivity is particularly noticable at the longer ranges where the bullet drop becomes large.

To overcome this problem a further known type of rear sight employs a screw thread extending vertically from the top of the gun receiver along which the sight is slidably mounted so that with rotation of the screw thread the sight is moved up and down with respect to the receiver to adjust the range of the weapon's aim. Such a rear sight tends to be of limited range adjustment.

It is an object of a ninth feature of this invention to provide an adjustable rear sight and a gun embodying the rear sight having an increased range of operability with improved range sensitivity.

A tenth feature of this invention is particularly applicable to guns known as assault rifles, although it is to be understood that it is not limited thereto.

With guns of the assult rifle type it is known to provide a bipod attached to a lug underneath the gun barrel with the legs of the bipod being extendable. However, known bipods usually only permit the gun barrel to roll about a Y-axis, although the present applicants believe that some bipods have been produced using a universal joint comprising two C-shaped members perpendicularly arranged to one another which are interlinked through the intermediary of a cruciform-shaped member. It will be realised that the production of a universal joint coupling for a bipod is complex and, therefore, costly and, furthermore, the connection of the bipod to the gun is also complex.

A tenth feature of this invention seeks to provide a bipod for a gun and a gun embodying the bipod in which the forementioned disadvantages are, at least, partially mitigated.

According to the broadest aspect of this invention there is provided a gas operated automatic or semi-automatic gun including a receiver, a barrel connected toward one end of said receiver, a buttstock connected to an opposing end of said receiver against a rear wall means of said receiver, a bolt means housed within said receiver and reciprocal between said barrel and said rear wall means and a gas means for driving the bolt means toward the rear wall means, the arrangement of the receiver, bolt means and gas means being such that the bolt means does not impact said rear wall means.

Preferably, the barrel is secured to be partially within the receiver so that the receiver is continued forwardly of a chamber in the barrel and toward said gas system which advantageously includes a rearwardly angled bore through the barrel wall to a cylinder and piston arrangement, whereby said piston is operative to drive the bolt means rearwardly.

In a preferred embodiment the bolt means comprises a housing having a longitudinal bore within which a bolt is slidably mounted, a P cross-sectionally shaped member having its longest side secured to said housing, said P shaped member being forwardly extended with respect to the bolt to be, in operation adjacent the piston, and a main drive spring located alongside the wrapped-over portion of the P shaped member which is arranged to provide forward drive motion to the housing and P shaped member.

Advantageously the rear wall means comprises a channel connected to the receiver and against which the buttstock abuts, said channel having a cutout to permit removal of the bolt means and a wall slidably mounted in said channel to cover said cutout.

According to an aspect of a first feature of this invention there is provided a bolt carrier assembly for a gas operated gun including a housing means for supporting a bolt, a P cross-sectionally shaped member having the longest side of the P shaped member secured to the housing means, said P shaped member being forwardly extended with respect to the bolt to be, in operation, adjacent the gas cocking system which is provided a predetermined distance along the barrel, and a main drive spring located alongside the wrapped-over portion of the P shaped member which is arranged to provide motion to the housing means and P shaped member.

Preferably, the housing means is a block having a bore within which the bolt is slidingly arranged and conveniently the block is shaped to provide a bearing surface for supporting the assembly and to permit reciprocal motion thereof.

Advantageously, sear contacting lugs are provided through the P shaped member and the housing means, and preferably two lugs are provided one passing through the wrapped-over portion of the P shaped member and the other passing through the planar portion of the P shaped member. Advantageously, the block has a downward extension substantially the same depth as the lugs to ensure that as the block travels rearwardly a cartridge being fed by a magazine is not contacted by the lugs.

Preferably, a closure member is provided at the end of the P shaped member remote from the housing means and, advantageously, said closure member is arranged to support one end of the main drive spring. Conveniently, an anti-bounce weight is mounted in the wrapped-over portion of the P shaped member and preferably said anti-bounce weight has a chamfer at one end which is engagable between the wrapped-over part of the P shaped member and one of the sear contacting lugs and the remove other end of the anti-bounce weight is attached to a compression spring which abuts the closure member, whereby the spring is compressed by the anti-bounce weight when the block and P shaped member combination are suddenly retarded.

Conveniently, a cam surface is provided on the side wall of the block for cooperating with a bolt cam pin. Advantageously an aperture is provided in the opposing side wall of the block to the cam surface to facilitate removal of said cam pin.

Advantageously, a notch is provided in the top of the P cross-sectionally shaped member adjacent the closure member which is suitable for engagement by a cocking means.

In a preferred embodiment a cartridge extractor claw is provided in a part of the wall of the bolt and said extractor claw is pivotally mounted and spring loaded such that an opening in the claw is engagable with a cannelore on a chambered cartridge and that in operation when the bolt is driven rearwardly the claw withdraws said cartridge.

In said embodiment a spring loaded ejector is provided on an opposing side of the longitudinal axis of the bolt to the extractor claw and the combination of claw and ejector are arranged to provide lateral impetus to a de-chambered, spent cartridge.

According to another respect of said first feature there is provided a gas operated gun having a receiver, a rear wall of said receiver, guide rail means within said receiver for slidably supporting a housing means for a bolt forming part of a bolt carrier assembly, a P cross-sectionally shaped member having the longest side of the P shaped member secured to the housing means, said P shaped member being forwardly extended with respect to the bolt to be, in operation, adjacent the gas cocking system provided a predetermined distance along the barrel, and a main drive spring located alongside the wrapped-over portion of the P shaped member arranged to provide motion to the housing means and P shaped member.

Preferably the main drive spring is supported on a guide rod and constrained between a closure member at one end of the P shaped member remote from the housing means and a tubular collar which is slidable between predetermined limits on the opposite end of the guide rod. Conveniently, the rear wall of the receiver is slidably positionable and mounted internally of the receiver on said rear wall is a lug arranged to cooperate with said tubular collar and on which said collar is normally mounted in use, wherein handle means external of the receiver are provided to slide said collar from said lug so that the rear receiver wall can be re-positioned to permit the bolt carrier assembly to be removed from the receiver.

According to a further aspect of said first feature there is provided a bolt carrier assembly including a housing means for a bolt, said bolt longitudinally extending within said housing means and on the exterior of the bolt from said housing means a plurality of radial lugs for locking said bolt to a barrel, and a latch means biassed, shaped and dimensioned to interleave said lugs, said latch means being longitudinally retractible with respect to said housing means.

Preferably the latch means interleaves between only two adjacent lugs.

Conveniently, the housing means is a block, the bolt is mounted within a bore of said block and the latch means is slidably mounted in a blind groove provided in an outer surface of the block. Preferably, the outer surface of the block is situated adjacent a member arranged to carry a main drive spring.

Preferably the latch means comprises a bar member shaped and dimensioned to engage between adjacent lugs and a compression spring, which may be a coil spring, which are both arranged in the blind groove with the spring between the bar member and the blind groove closure.

Advantageously the bar member has a transverse slot and a transverse pin is arranged in the block to cooperate with said transverse slot to thereby limit the extent of longitudinal travel of the bar member.

According to a second feature of this invention there is provided an automatic or semi-automatic gun having a receiver arranged to accept a magazine in an opening forming a well thereof, said receiver having a first locating means extending from the exterior of the receiver into the interior of the receiver which is arranged to engage with a magazine in use and a second locating means also arranged to engage with a magazine in use extending laterally from the receiver from a position adjacent to the well, said second locating means having a lateral length sufficient to prevent undue sideways, with respect to the longitudinal axis of the receiver, movement of the magazine and the first locating means being arranged to prevent undue fore and aft, with respect to the longitudinal axis of the receiver, movement of the magazine.

Preferably, the first locating means includes two longitudinally spaced pins which are biassed toward the interior of the receiver and conveniently said pins are biassed by a leaf spring which is external of the receiver. In a currently preferred embodiment both the pins are chamferred on the part thereof which is arranged to be initially contacted on insertion into the well by the magazine to facilitate a throat wall of the magazine to bias the pins against the leaf spring. Advantageously, only two pins are provided and corresponding holes are provided in the magazine and one of the pins is arranged to fit tightly with the magazine so as to locate the magazine and the other pin is arranged to be a toleranced fit in its corresponding magazine hole to cater for tolerances between the pin locations.

Advantageously, the pins are loosely coupled to the leaf spring to permit loose location of said pins with respect to the leaf spring but close location with the receiver. Conveniently the leaf spring is L-shaped with a leg of the L positioned to be remote from the pins and to abut the receiver wall. Conveniently, a rod member is arranged to pass through the receiver to abut the leaf spring such that in operation pressure on the rod member on the remote side of the receiver from the leaf spring causes the leaf spring to pull the pins outwardly from said well to thereby release the magazine.

In an alternative arrangement a U-shaped member passes around the receiver so that one arm of the U-shaped member lies between an outer wall of the receiver and the adjacent leaf spring and the other arm of the U-shaped member is adjacent the opposing receiver wall whereby pressure exerted on said other arm of the U-shaped member causes the said one arm of the U-shaped member to push the leaf spring away from the receiver and thereby release the pins from a magazine.

Preferably, a stop is provided to limit the extent of insertion of a magazine and the second locating means has a lateral extent from the underside of said stop to the remotest point of contact with the magazine from the receiver of 2.7 times the width of said well.

Advantageously, the second locating means is a C cross-sectionally shaped member arranged so that the opening lips of the C shape act as a keyway for a corresponding width key on the magazine. Preferably the C shaped member extends inside said well and a tang is provided at the end of the C shaped member inside the well for cooperating with a last round stop in the magazine.

Preferably, a jig simulating the well and the C shaped member is provided for machining the holes in the magazine which cooperate with said pins, said magazine having a longitudinal key with a root radius or chamber whereby the magazine is pushed into the jig so that the root radius or chamber abuts the outer corners of the simulation of the lip opening of the C shaped member and the holes are machined.

Advantageously, the receiver is formed from sheet material in upper and lower overlapping parts and in the region of the well, the lower part is U-shaped into which the upper part is nested.

According to one aspect of a third feature of this invention there is provided a gas operated automatic or semi automatic gun including a receiver for housing a bolt carrier means said receiver being connectible at a rearward location to a buttstock and at a relatively forward location, with respect to said rearward location, to a barrel, said receiver being extended to a further location, more forward of said forward location at which it is connectible to the barrel, and at said further location the receiver being arranged to support the barrel.

Preferably the receiver includes a unitary channel extending from said rearward location to said further location.

Advantageously, the receiver is constructed from an upper and a lower U-shaped channel, said upper channel being inverted and overlapping the limbs of the lower channel and forming said unitary channel. Such an arrangement of U-shaped channels has the advantage that the top longitudinal edge of the lower channel is capable of acting as a rail upon which a bolt carrier means is in operation, reciprocal. Preferably, the channels are each formed from sheet material. Advantageously, the lower channel has a portion thereof cut and bent in the region of a normally provided magazine well so as to form a further U-shaped section on each side of the lower channel into which the limbs of the upper channel locate, thereby forming in said region at each side of the magazine well a treble thickness of channel sheet material.

Preferably, said upper channel is extended forwardly of said lower channel and said further location is formed by a front wall of the receiver which is secured to said upper channel, an aperture in said front wall forming said support for the barrel.

So as to permit insertion and removal of the normally provided bolt carrier means there is secured to said receiver a channel means against which the buttstock is connectible, said channel means being spaced from the upper and lower channels forming the body of the receiver so as to permit insertion therebetween of a slidable rear wall, and also being apertured to facilitate access to the bolt carrier means.

Conveniently said channel means also forms a part of a rear sight mount.

According to a further aspect of the third feature of this invention there is provided a barrel arrangement for a gas operated gun including a bored barrel having a reduced outer diameter portion at one end thereby forming a shoulder, a first screw thread formed adjacent said reduced diameter portion, a block member situated on said reduced diameter portion for securing the barrel to a receiver and a barrel extension member having a second screw thread mating with said first screw thread whereby said block member is sandwiched between said shoulder and said barrel extension member.

Advantageously, a heat shield is sandwiched between said block member and said shoulder which in operation extends along a top part of the barrel.

Normally a gas port is provided a predetermined distance along the barrel between the barrel extension member and said bore and advantageously said port is inclined rearwardly from the bore and is enlarged at the outer end thereof.

According to another aspect of the third feature of this invention there is provided a gas operated automatic or semi-automatic gun including a receiver as defined in said one aspect of the third feature and a barrel arrangement in accordance with the further aspect of the third feature wherein said forward location is defined by the block member and preferably the distance from the rear of the block member to the gas port in relation to the distance from the rear of the block member to said further location formed by a front face of the front wall of the receiver is greater than 1:1 and in a preferred embodiment is given by the ratio 1.3:1.

Advantageously, means are provided for preventing relative movement between the block member, the barrel extension member and the barrel which may be an inclined pin advantageously having a screw thread at its free end to facilitate extraction thereof.

According to one aspect of a fourth feature of this invention there is provided a cocking handle assembly for an automatic or semiautomatic gun of the type which is stationary with respect to a receiver during a normal firing stroke of a bolt means including a member for engaging with said bolt means said member being connected to a rotatable handle and a locking means having a first part which is movable with the rotatable handle and a cooperating second part which is stationarily positioned with respect to the receiver, whereby rotation of said rotatable handle is effective to lock and unlock said locking means and in dependence thereon to permit reciprocal movement of said member.

Preferably said first part of the locking means is a pin secured to the handle and said second part is a notch formed in a leg connected to said receiver.

In a preferred embodiment of said fourth feature a side wall of the receiver is provided with a longitudinal slot having a rearwardly located escape aperture for said member and a bridge secured to the receiver on both sides of said slot which bridge is joined to and forms part of said leg which extends rearwardly with respect to the bridge.

Conveniently the bridge has a C-shaped cross-section and the leg has a U-shaped cross-section, and advantageously the limb of the U shape remote from the receiver has a greater height than the limb adjacent to the receiver.

Advantageously an elongate guide member supports the rotatable handle and, at a forward end of said guide member, said member for engaging with the bolt means is supported, the guide member having a length greater than that of said slot so that when said handle is locked by the locking means the slot is covered by the guide member. Conveniently the guide member passes under the bridge and is supported by the limb of the leg adjacent the receiver and located against the receiver by the limb of the leg remote from the receiver.

Preferably the handle has a cylindrical cross-section with a concentric bush rotatably secured on a screw threaded stud laterally extending from said leg. Conveniently said handle has a closure face to which is secured said pin and said pin is biassed by a spring located in the handle between said pin and a stop pin secured to and laterally extending from said guide member.

Conveniently the said member for engaging with the bolt means is a stud shaped to form, with the guide member, a channel to locate in said slot such that when the channel is in the slot the stud is slidingly secured to the receiver.

Advantageously the travel of the guide member is limited rearwardly by striking a rear portion of the receiver and is limited forwardly by striking the confluence of the C shaped bridge and the U-shaped leg.

According to another aspect of a fourth feature of this invention there is provided a method of cocking an automatic or semiautomatic gun including the steps of rotating a lockable handle in a first direction to unlock the same, said handle being connected to a bolt means, drawing said handle and hence said bolt means rearwardly such that the bolt means is secured by a sear, and returning said handle forwardly and locking same to the receiver by re-rotating the handle counter to said first direction.

Advantageously the handle is biassed counter to the first direction such that when in a forward position the handle is automatically latched by a pin engaging a notch.

According to a further aspect of the fourth feature of this invention there is provided a gas operated gun having a cocking handle assembly of the type which is stationary with respect to a receiver of the gun during a normal firing stroke of a bolt means which includes a member for engaging with said bolt means said member being connected to a rotatable handle and a locking means having a first part which is movable with the rotatable handle and a cooperating second part which is stationarily positioned with respect to the receiver, whereby rotation of said rotatable handle is effective to lock and unlock said locking means and in dependence thereon to permit reciprocal movement of said member.

According to a fifth feature of this invention there is provided a buttstock securing arrangement for a gun including two male members connected to a buttstock, two cooperating female members located on a gun receiver and a releasable locking means for securing said male and female members together.

Preferably the locking means is manually releasable and the male members are rods connected one to each side of the buttstock and the female members are tubular bushes connected one to each side of the receiver with the axes of the bushes extending longitudinally of the receiver.

In a preferred embodiment of said fifth feature the locking means comprises a spring means extending laterally to the axes of the bushes and passing through an aperture in the side wall of each of the bushes to locate in a notch in the mating rod when said rods are fully inserted into the bushes.

Advantageously the aperture in each said bush is adjacent the side of the receiver, the notches in the rods face each other and the spring means is a U-shaped spring member extending under the receiver with each of the arms of the U-shape lying adjacent opposing receiver sides and passing through a corresponding one of the said apertures such that in operation the arms of the spring member are compressed together to release said rods.

Preferably the U-shape spring member is further U-shaped in the longitudinal direction of the receiver so that limbs of the further U-shape extend longitudinally of the receiver and advantageously a slot is provided in the base of the receiver through which the spring member is secured to the receiver whereby the slot is arranged to permit movement of the spring member in the receiver longitudinal direction.

The securing arrangement may be used with a profile buttstock made, for example, from a plastics material and in such an embodiment the rods are conveniently fixed to a channel secured to the sides and end faces of the buttstock or the arrangement may be used with a collapsible rod buttstock in which the rods are a continuation of the buttstock which is formed from a single rod bent into a U-shape with a substantially right angled bend provided in the two arms of the U-shape. With such a rod buttstock, advantageously a rod U-shaped loop is formed externally on both sides of the receiver in the region of the magazine well with the arms of the U-shaped loop extending into the magazine well so as to present a stop for a magazine and the dimensions of the loop being arranged to hold a respective rod when the buttstock is contracted.

When a profile buttstock is used the longitudinal position of the spring member is advantageously adjusted by inserting the rods into respective bushes, pushing the buttstock forwardly so that it tightly abuts the rear of the receiver, moving the spring member forwardly so that the arms thereof abut the forward edge of the notch in the rods, and tightening a screw extending through said slot into said receiver. Conveniently a block is mounted inside the receiver into which said screw is secured and said block is arranged to laterally locate the base of a U-shaped sear buffer having bowed arms which provide the buffer with spring tension.

Preferably the operating distance between the longitudinal axes of the bushes is determined after the bushes are secured to the receiver by machining the bore of said bushes, and so that, with a profile buttstock, the rods align with the bushes. Conveniently each rod is provided with a dog leg at a predetermined distance along its length such that parts of the rod have axes which are offset from one another equal to or greater than one half the maximum allowable tolerance in the width of said channel. Advantageously, to secure the rods to the channel they are mounted in a fixture such that the parts of the rod which are to be inserted into the bore of the bushes are spaced the same distance as the axes of the bores of the bushes on the receiver and by virtue of the dog leg the rods are axially rotated until they abut a respective side of said channel.

According to one aspect of a sixth feature of this invention there is provided a sear buffer for a gas operated gun including a U-shaped member with bowed longitudinal arms, the free ends of the arms being arranged for mounting a sear and locating means for securing said U-shaped member to the gun whereby the arms act as an extension spring and the bow in the arms is arranged to be temporarily reduced when the sear is contacted by a reciprocating bolt means.

According to a further aspect of the sixth feature of this invention there is provided a gas operated gun having a receiver within which reciprocates a bolt means arranged to be actuated by a pivotable sear and a sear buffer, said sear buffer including a U-shaped member with bowed longitudinal arms, the free ends of which are secured to the pivotal sear, and locating means securing the sear buffer to the receiver whereby the arms act as an extension spring and the bow in the arms is temporarily reduced when the sear is contacted by the bolt means.

Conveniently the sear is located between the free ends of the bowed arms.

Preferably the arms are bowed inwardly of one another and the free end of each of the arms has a foot arranged with the heel portion of each foot abutting the receiver lower wall and the toe portion of each foot supporting the pivotal sear by a rod passing through the feet and sear.

Advantageously the locating means include a block provided adjacent the base of the U-shaped member between said arms which block is secured to the receiver lower wall and laterally locates the U-shaped member. The receiver is advantageously formed from sheet material and in the region of the base of the U-shaped member preferably has each side wall formed from a treble material thickness. The locating means preferably further includes a rod passing through the arms of the U-shaped member adjacent the base thereof and also through the treble material thickness of each receiver side wall to thereby longitudinally locate said U-shaped member.

Advantageously the locating means includes a further rod passing transversely through the receiver side walls which abuts the top edge of the bowed arms and which, in conjunction with said heels locate the arms in a third, vertical, direction.

According to a seventh feature of this invention there is provided a sear actuator for a gun comprising a rotatable member and movable with said member a transfer means arranged such that in a first position of the member said transfer means interconnects motion of the trigger to the sear, and in a second position of the member said transfer means is rotated so that the interconnection between trigger and sear is removed.

Preferably the rotatable member extends between opposing walls of a receiver of the gun and the transfer means is a slidable rod extending transversely to said member. For compactness the rod is advantageously positioned through said member.

In a preferred embodiment including a trigger and a sear the rotatable member is a cylinder having two non-parallel surfaces and said rod is slidable between said surfaces and arranged such that in said first position an abutment face of the sear is in parallel contact with one of said surfaces and the rod holds an abutment face of the trigger out of contact with the other of said surfaces, and in said second position the abutment face of the trigger is in parallel contact with the said other of said surfaces and the rod holds the abutment face of the sear out of contact with said one surface.

Advantageously the rod is biassed, in said first position, toward the trigger and conveniently a cantilever spring biasses said rod, said spring being located in the cylinder with free ends of the spring mounted in mutually perpendicular holes in the cylinder and rod.

According to an eigth feature of this invention, there is provided a gun including a trigger mechanism comprising a pivotally mounted trigger connected to rotate a pivotal sear having a rear part which is provided to selectively engage a lug on a reciprocal bolt means and a notch in an upper surface of the sear adjacent the bolt means which is also arranged to cooperate and engage with said lug, and mounted on the trigger axis, a member arranged to cooperate with a portion of the sear and which is spring biassed for movement with the trigger, whereby when the trigger is pulled to rotate the sear in a first direction out of engagement with the lug the member is initially prevented from moving with the trigger by the sear portion and when the lug is released by the sear the sear is further rotated in said first direction by the lugs contacting the sear upper surface to free the member to move toward the trigger and under the sear portion, thereby preventing the sear from rotating in a direction counter to said first direction until the trigger is released.

Preferably the sear portion is an L-shaped extension on the same side of the sear pivot as that side driven by the trigger.

Advantageously, the member is spring biassed to contact a portion of the trigger on a side of the trigger pivot remote from the sear pivot.

According to a ninth feature of this invention there is provided in one aspect a rear sight for a gun including a sight mount having a ramp along which a slider means carrying two substantially mutually perpendicularly arranged sight apertures is movable, said slider means being connected by a screw thread to an adjusting screw, and locating means being provided for positioning the slider means in one of two predetermined attitudes whereby in one of said attitudes one of the sight apertures is used and in the other of said attitudes the other sight aperture is used.

According to a further aspect of said ninth feature there is provided a gun including a rear sight mount having a ramp along which a slider means is arranged to carry two substantially mutually perpendicularly provided sight apertures, said slider means being connected by a screw thread to an adjusting screw, and locating means being provided for positioning the slider means in one of two predetermined attitudes, whereby in one of said attitues one of the sight apertures is used and in the other of said attitues the other sight aperture is used.

Preferably, the slider means comprises a sight bar alongside which is located the adjusting screw, and a slider having a spring biassed plunger on which, in a semi-circular portion thereof, is provided said screw thread, whereby depression of said plunger releases the screw thread engagement. P Advantageously, the adjusting screw is secured to the sight bar by the plunger in one direction, a radial enlargement of the adjusting screw engaging in a slot in the sight bar securing the adjusting screw in a direction perpendicular to said one direction and a spring biassing said enlargement to one side of said slot. Conveniently, the spring biassing said enlargement is arranged to cooperate with the underside of a finger knob, said finger knob having a plurality, e.g. four, indentations in the underside thereof, the combination of spring and indentations providing a click-stop adjustment of the adjusting screw.

Preferably the sight bar is pivotally connected to the sight mount by a windage screw adjuster, said windage screw adjuster having a finger knob which is spring biassed towards the sight mount and having a positive lock therebetween. Conveniently, the positive lock comprises a quadrilateral protrusion on the base of a finger knob of the windage screw adjuster and a cooperating quadrilateral aperture in the sight mount.

Advantageously, the sight bar is mounted on the screw threads of the windage screw adjuster between the limbs of a U-shaped sight mount, one end of the windage screw adjuster being rotatably secured to one side limb of the sight mount and the other end of the windage screw adjuster being connected to the finger knob by a spring biassed cross-pin extending through a transverse slot in the knob.

According to a tenth feature of this invention there is provided in one aspect a bipod for a gun including a pair of legs connected to a mounting means, the mounting means comprising a forwardly facing part spherical ball for connection within an aperture in the underside of the gun and a rearwardly facing mouth for cooperating with a lug, also on the underside of the gun, which is axially displaced from the aperture, the arrangement of the ball and mouth being such as to permit the gun to roll and sweep in X and Y planes.

According to a further aspect of said tenth feature there is provided a gun including a bipod having a pair of legs connected to a mounting means comprising a forwardly facing part spherical ball arranged to engage with an aperture in the underside of the gun and a rearwardly facing mouth arranged to cooperate with a lug on the underside of the gun, the lug being axially displaced from the aperture, whereby the ball and mouth are arranged so as to permit the gun to roll and sweep in X and Y planes.

Preferably, the part spherical ball is spring biassed forwardly towards the gun aperture to facilitate attachment/detachment from the gun.

Advantageously, the legs are both pivotally connected to the mounting means and arranged to adopt at least two predeterminedly fixed positions. In a preferred embodiment, each leg is supported from an axle secured to the mounting means and disposed along the leg axis is a pin arranged to cooperate in turn with one of two perpendicularly displaced open-ended slots in the mounting means, the leg being spring biassed toward said slots.

In the preferred embodiment each leg is spring biassed toward said slots by the arrangement of a hanger circumferentially encircling the leg having one end mounted on the axle and its other, remote end connected to a pin passing through an axial slot in the leg, and a compression spring between the pin and a closure of the leg positioned toward the axle, whereby the spring is compressed to withdraw the pin from a respective one of the slots.

The mounting means preferably, comprise a yoke-shaped sub-frame having two wings upwardly extending from the mouth and a forwardly extending tube within which is mounted the part spherical ball, and a U-shaped bracket having limbs extending from the front of the tube to a respective one of the wings.

Advantageously, each of the legs comprise at least two telescopically arranged tubes having a latch therebetween for predeterminedly selecting a desired extension between the tubes.

The terms "forward" and "rearward" and similar adverbially phrases used herein are used in relation to the gun muzzle so that, for example, the buttstock is positioned rearwardly of the muzzle.

Figure 5A:
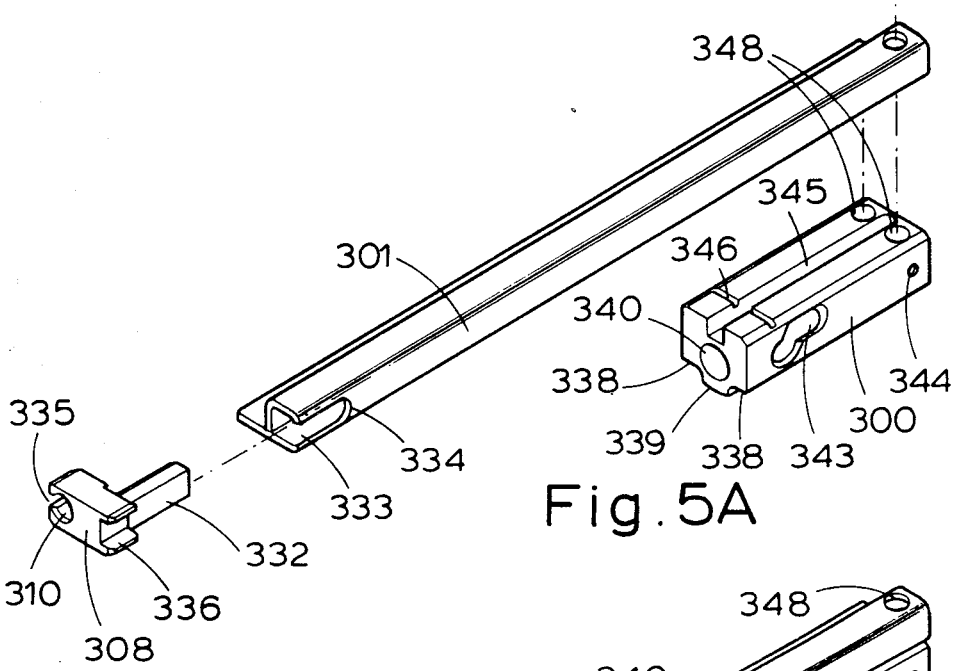
Figure 5B:
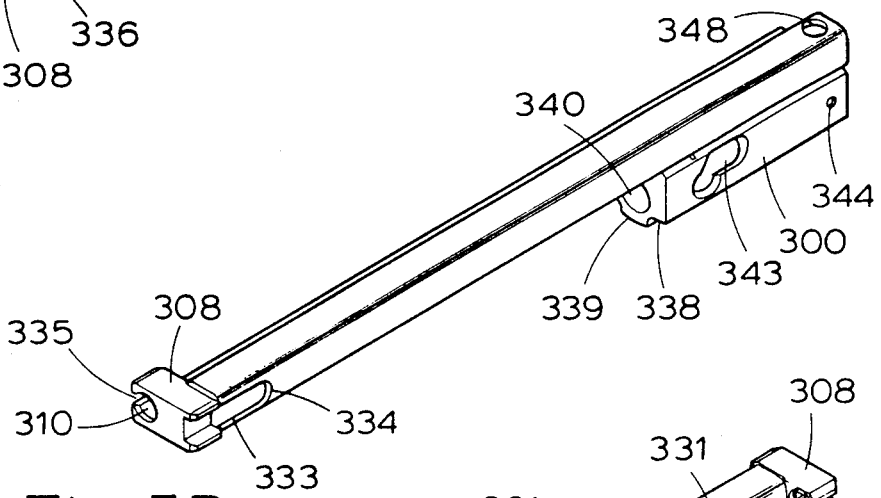
Figure 5C:
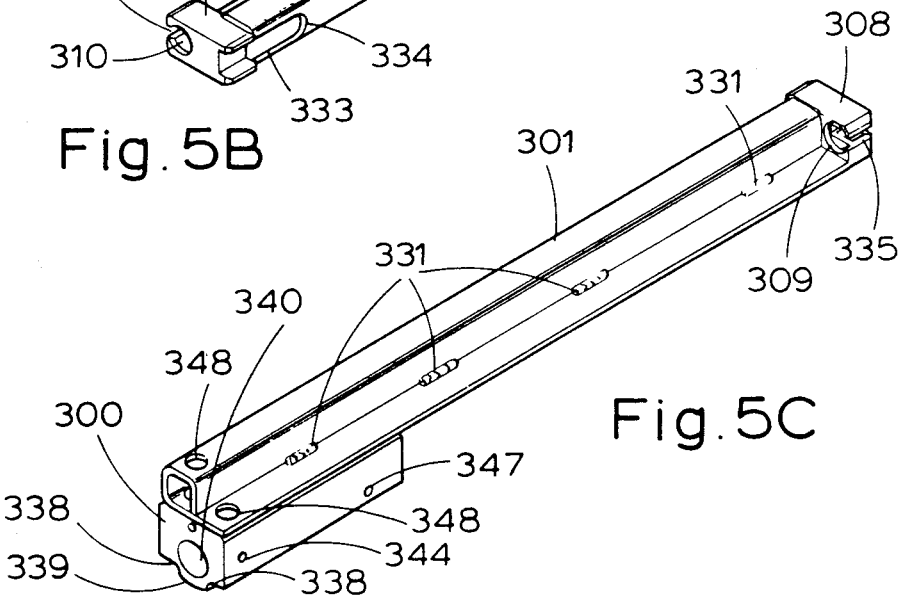
Figure 6A:
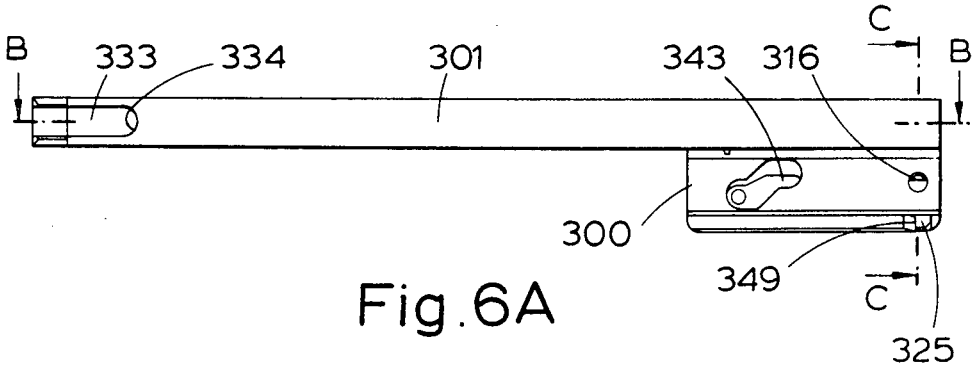
Figure 6B:
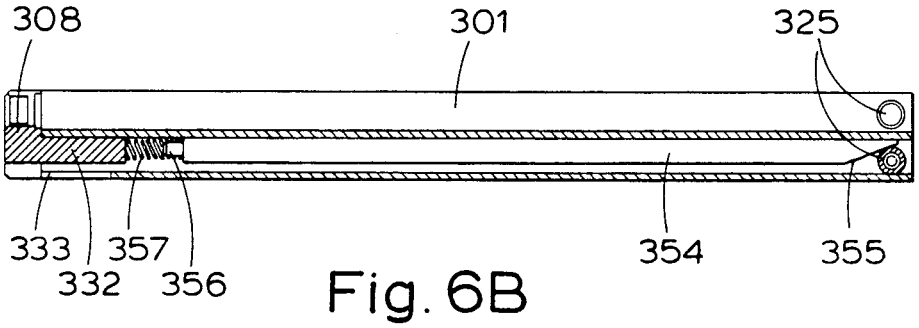
Figure 6C:
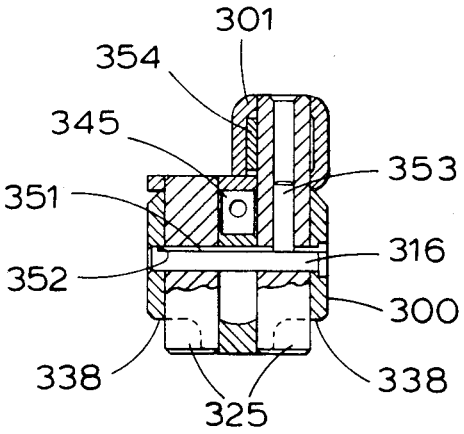
Figure 7A:
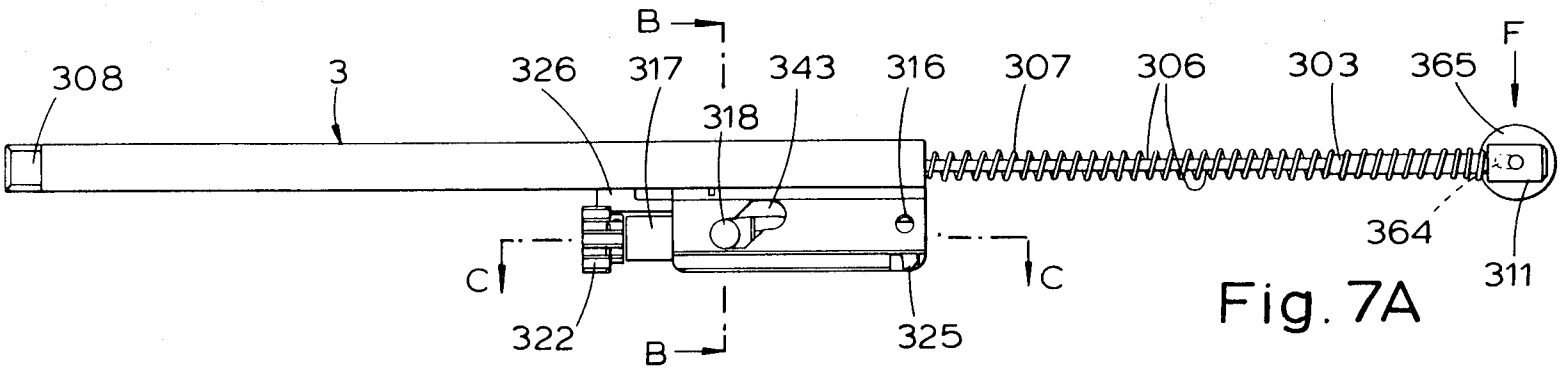
Figure 7C:
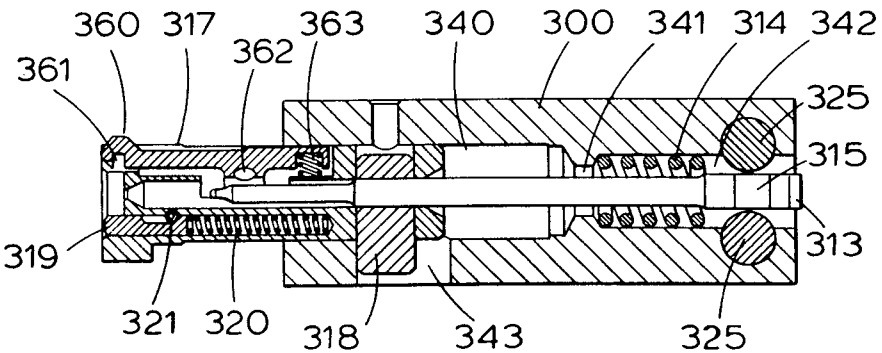
Figure 7B:
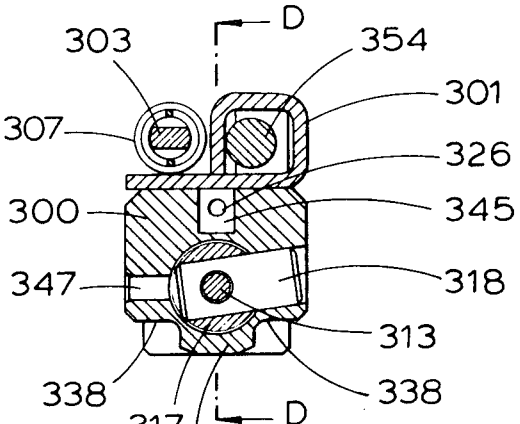
Figure 7D:
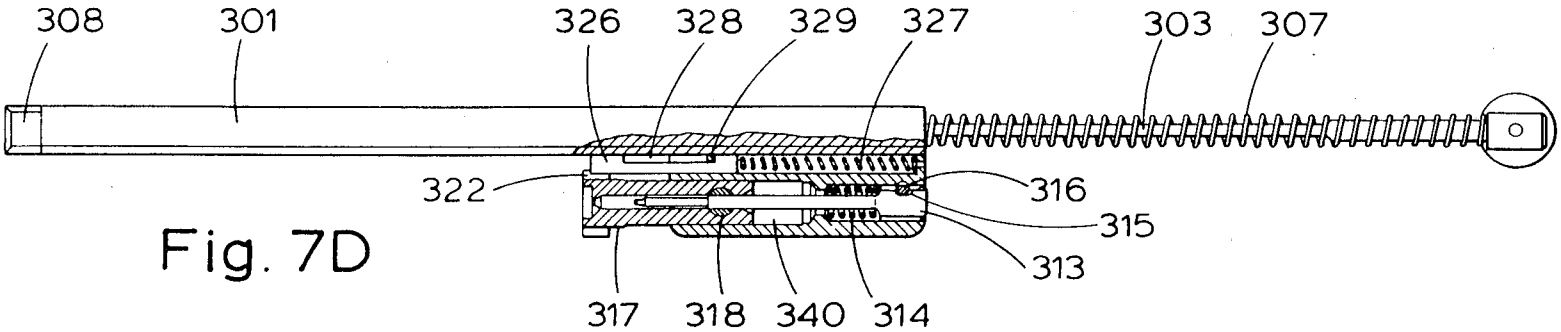
Figure 7E:
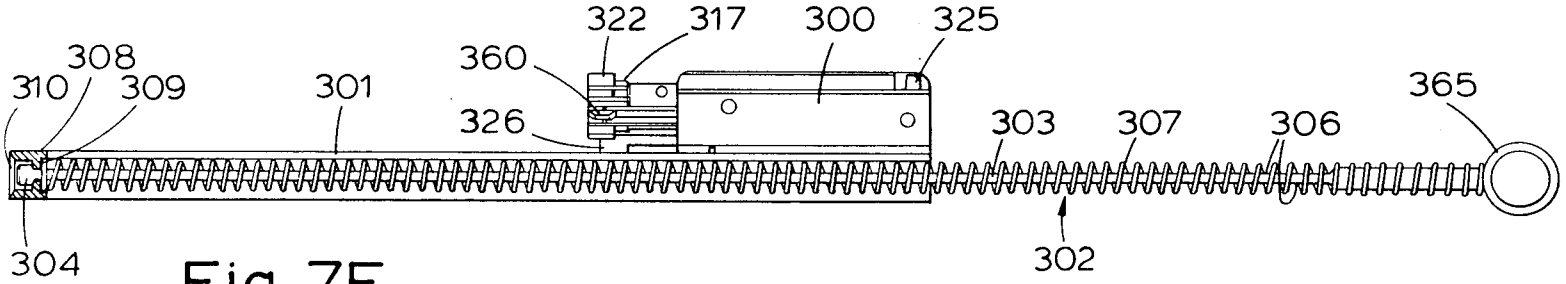
Figure 7F:
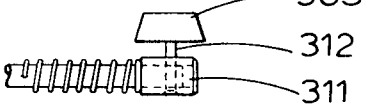
Figure 8A:
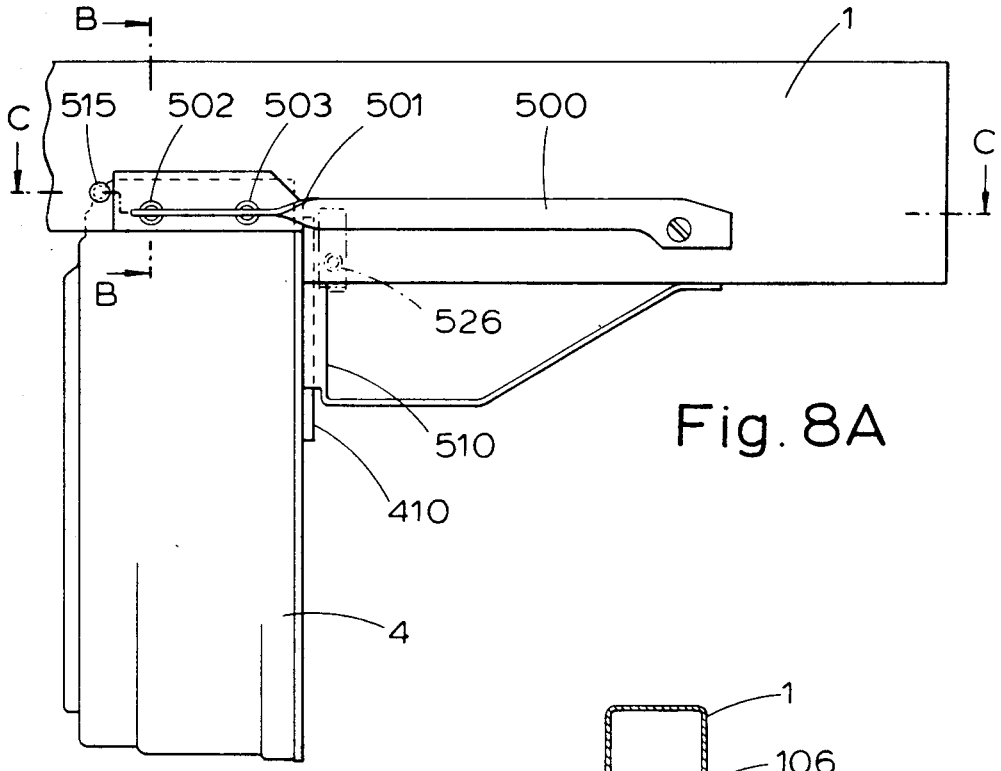
Figure 8B:
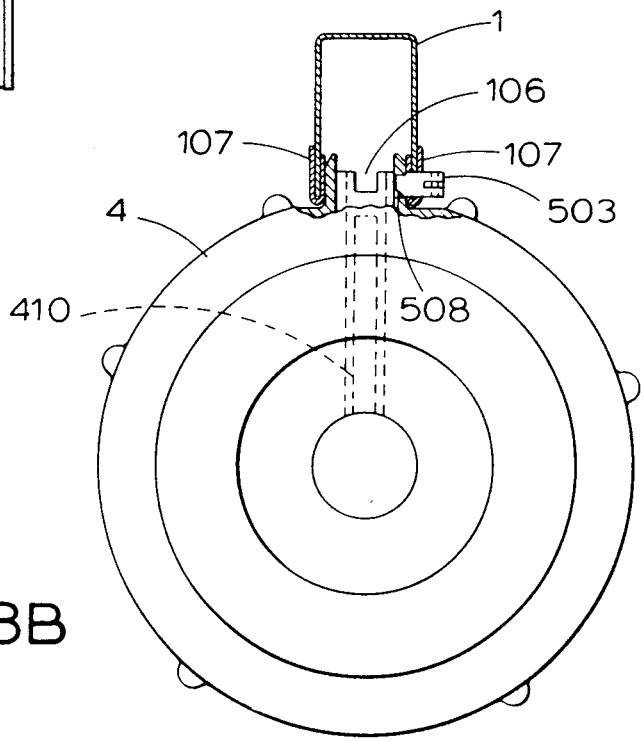
Figure 8C:
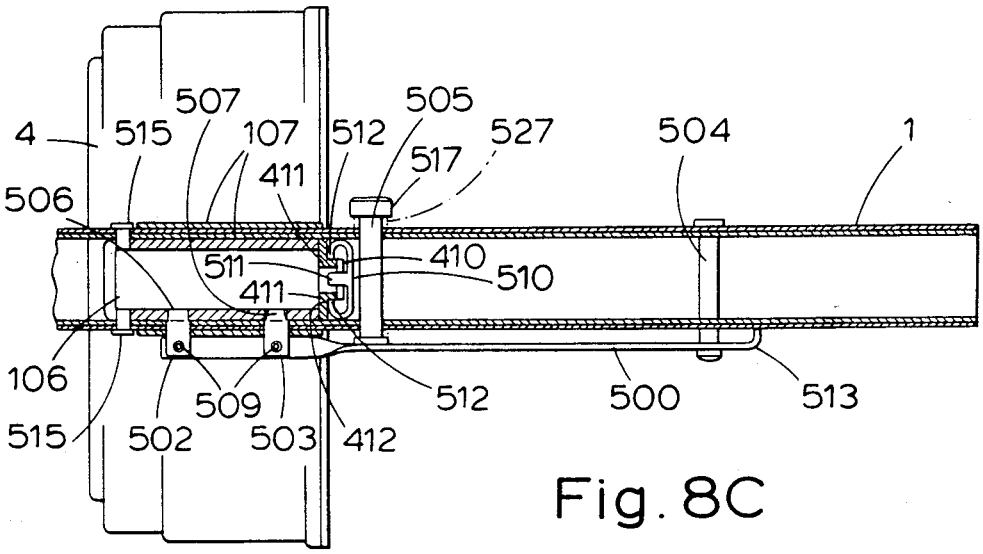
Figure 9A:
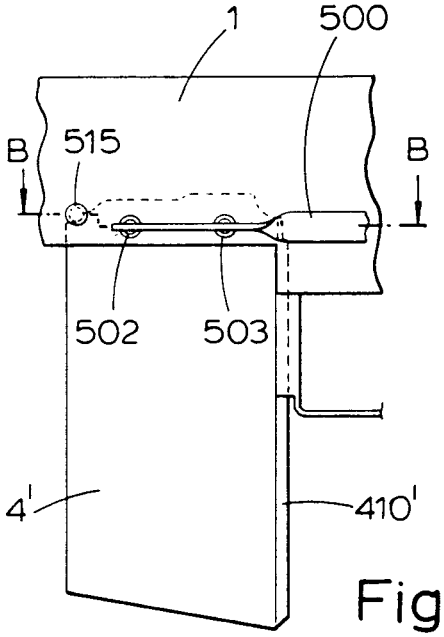
Figure 9B:
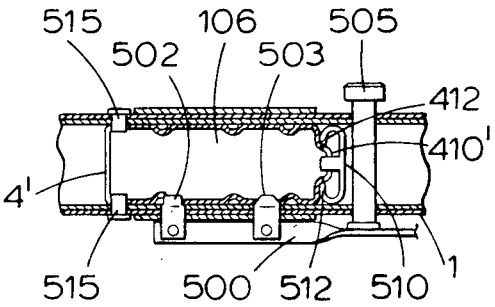
Figures 10A, 10B, 10C, 10D:
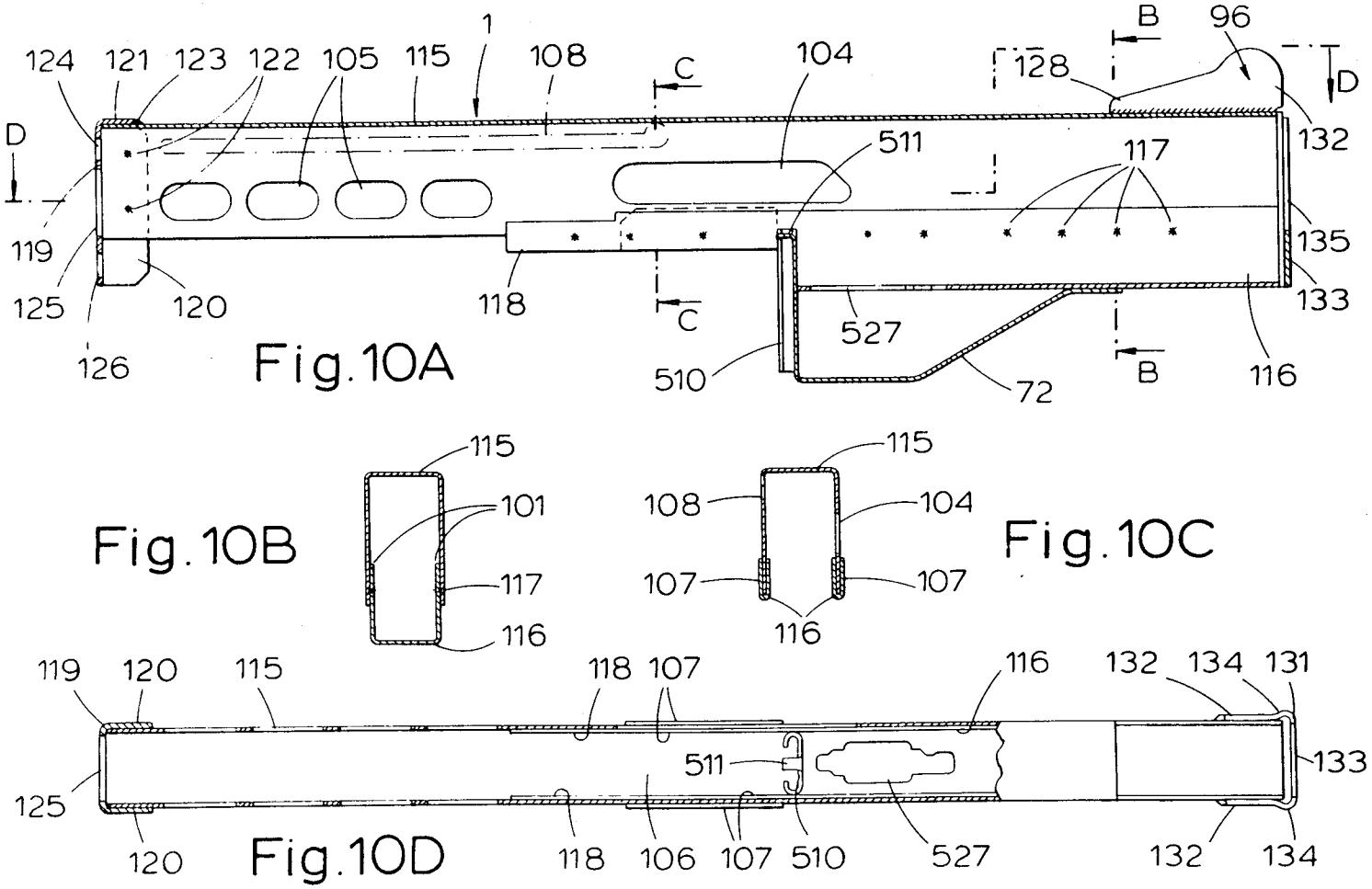
Figure 11:
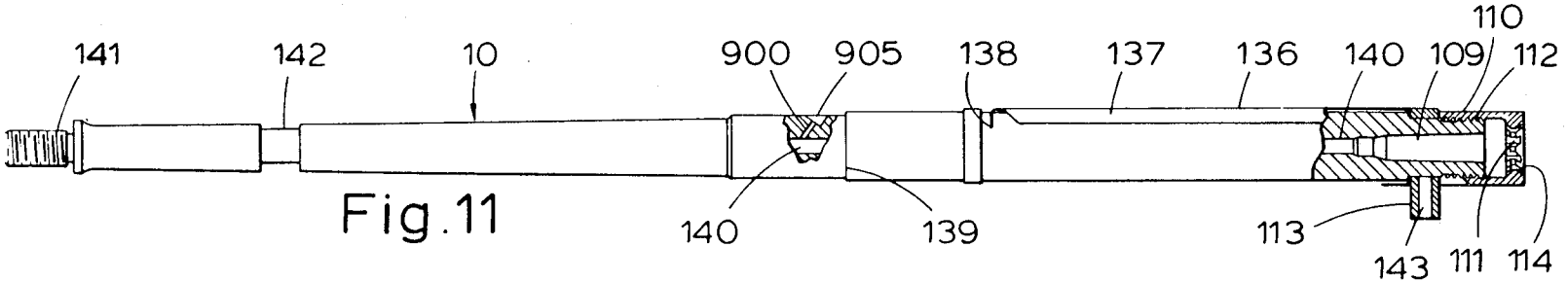
Figure 12A:
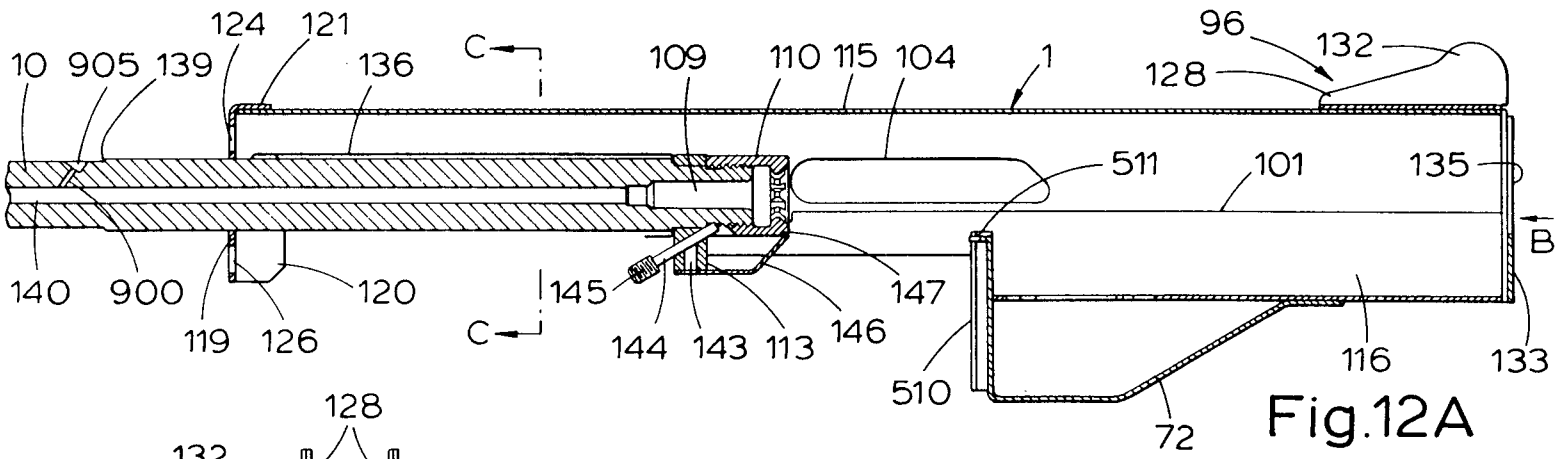
Figure 12C:
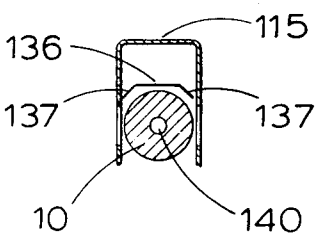
Figure 12B:
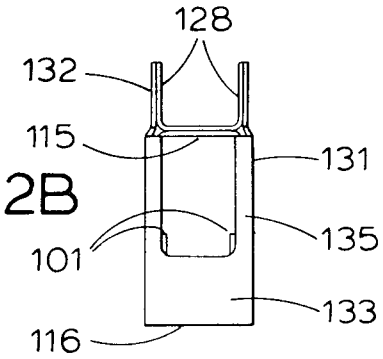
Figure 13A:
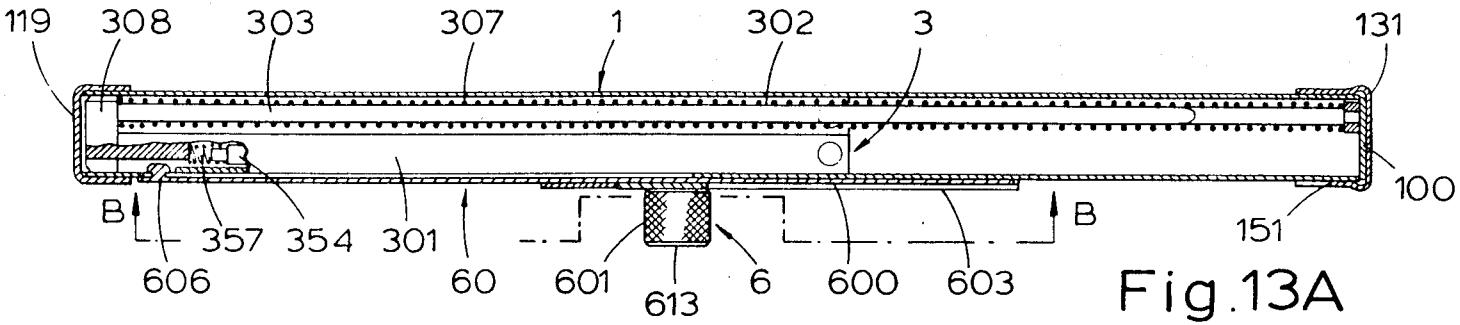
Figure 13B:
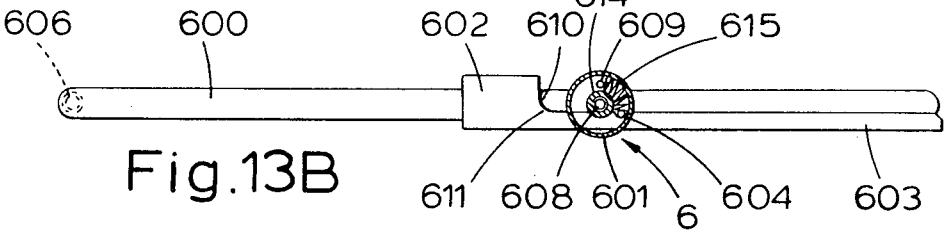
Figure 14:
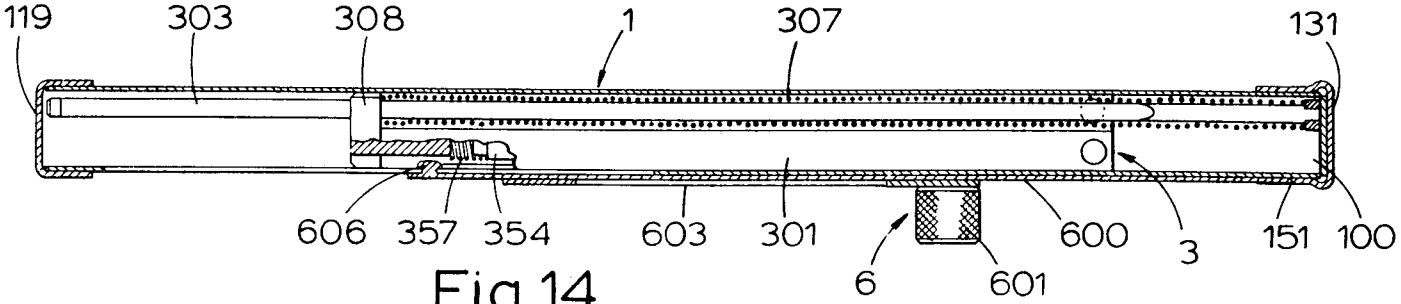
Figure 15A:
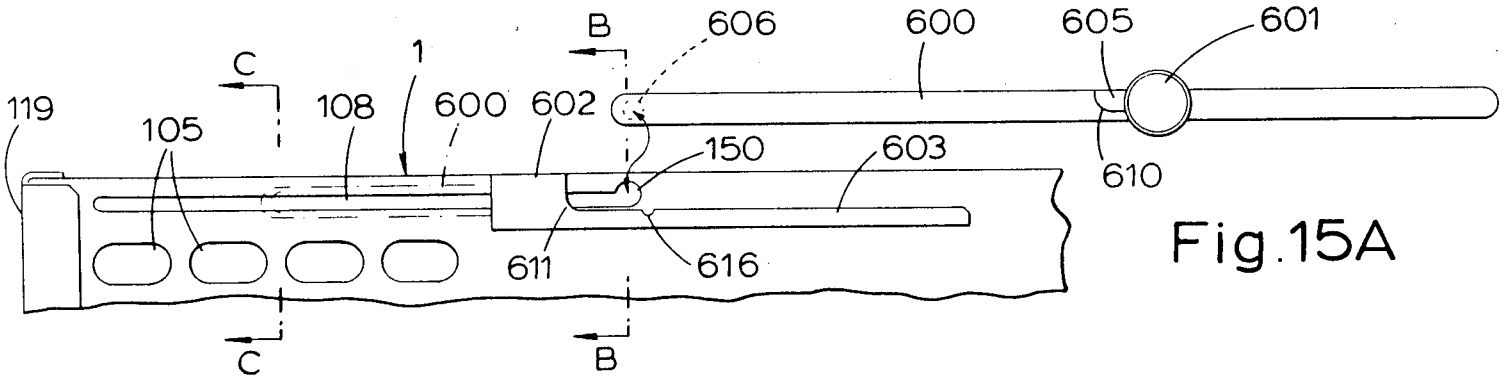
Figure 15C:
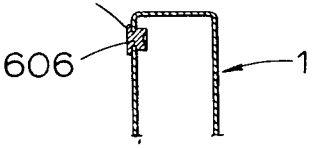
Figure 15B:
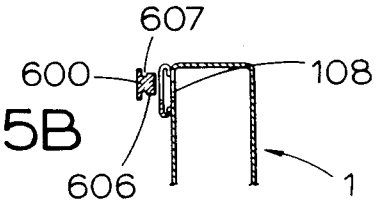
Figure 16:
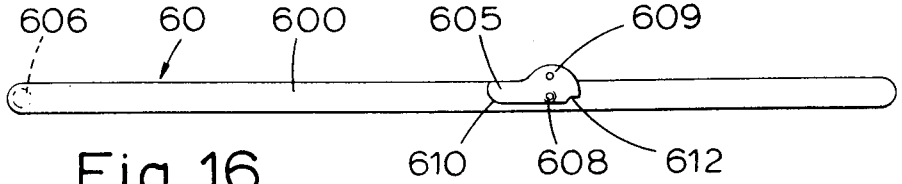
Figure 17A:
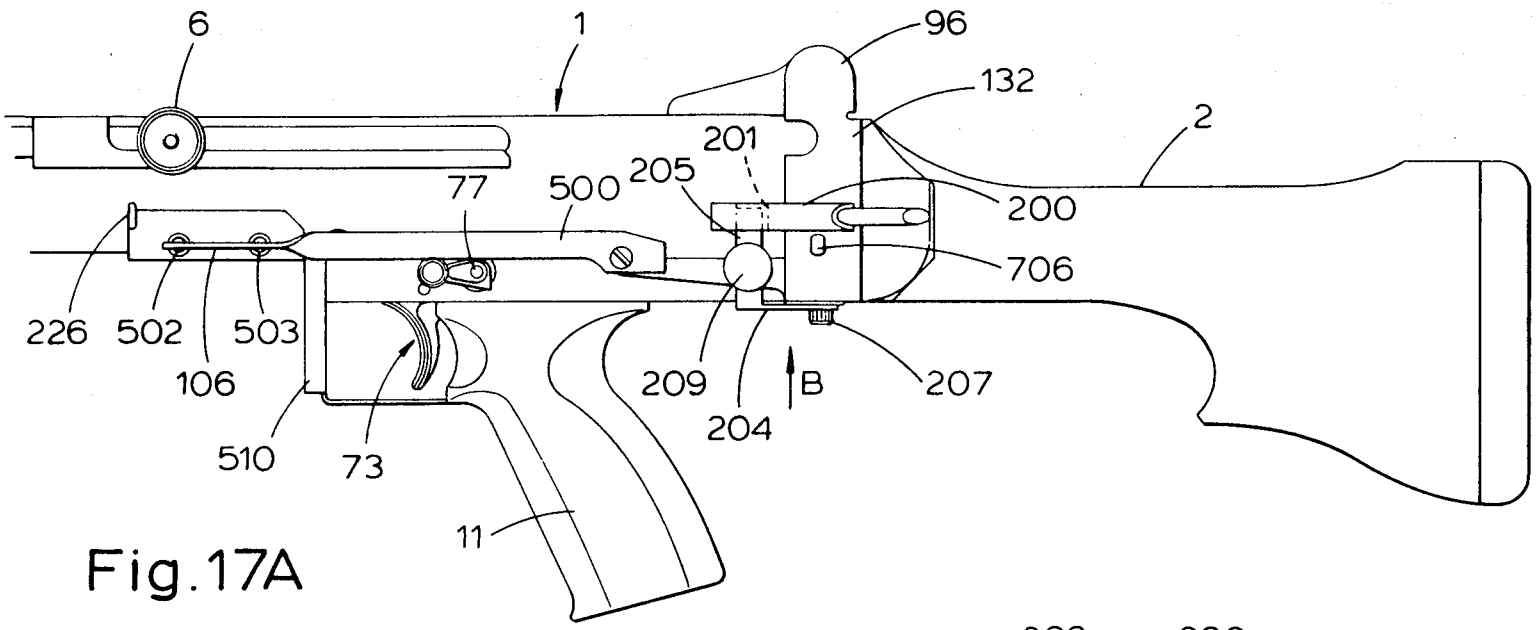
Figure 17B:
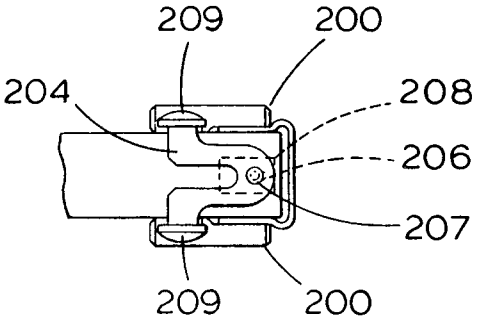
Figure 18:
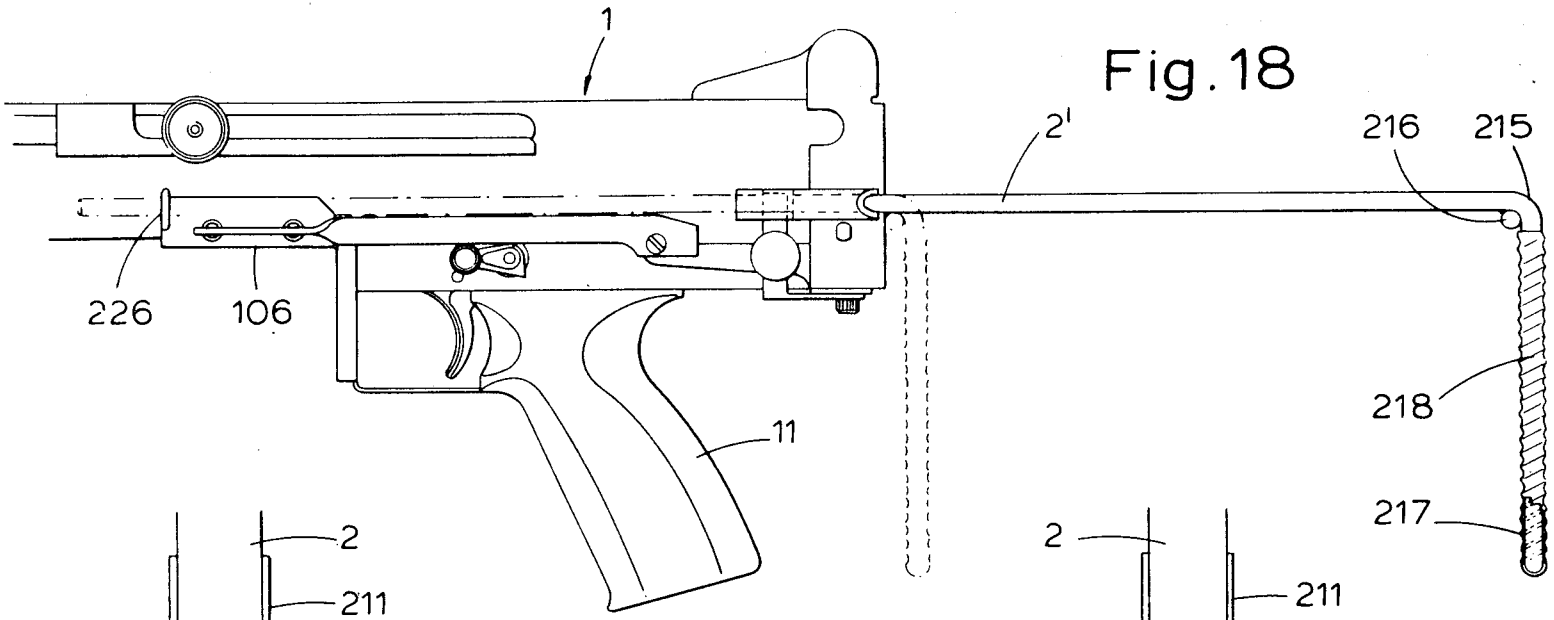
Figure 21:
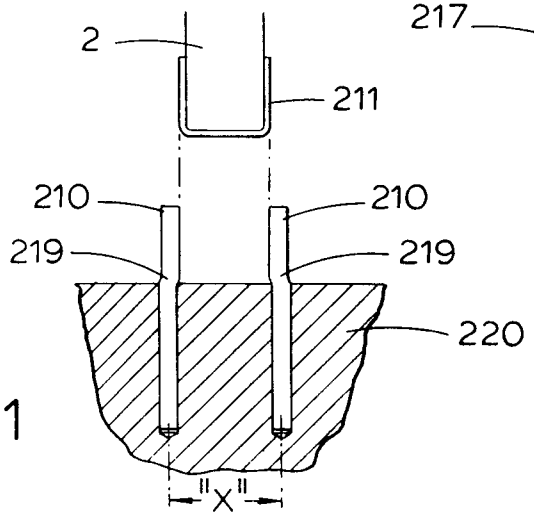
Figure 20:
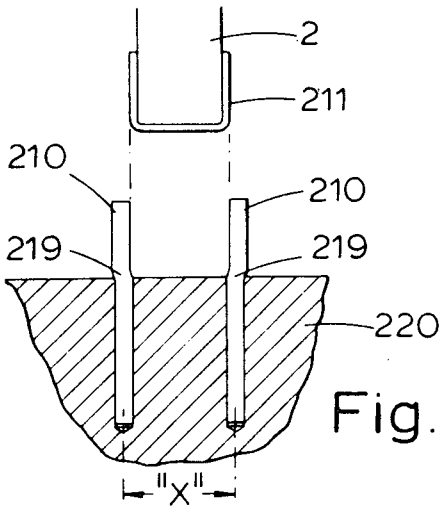
Figure 19A:
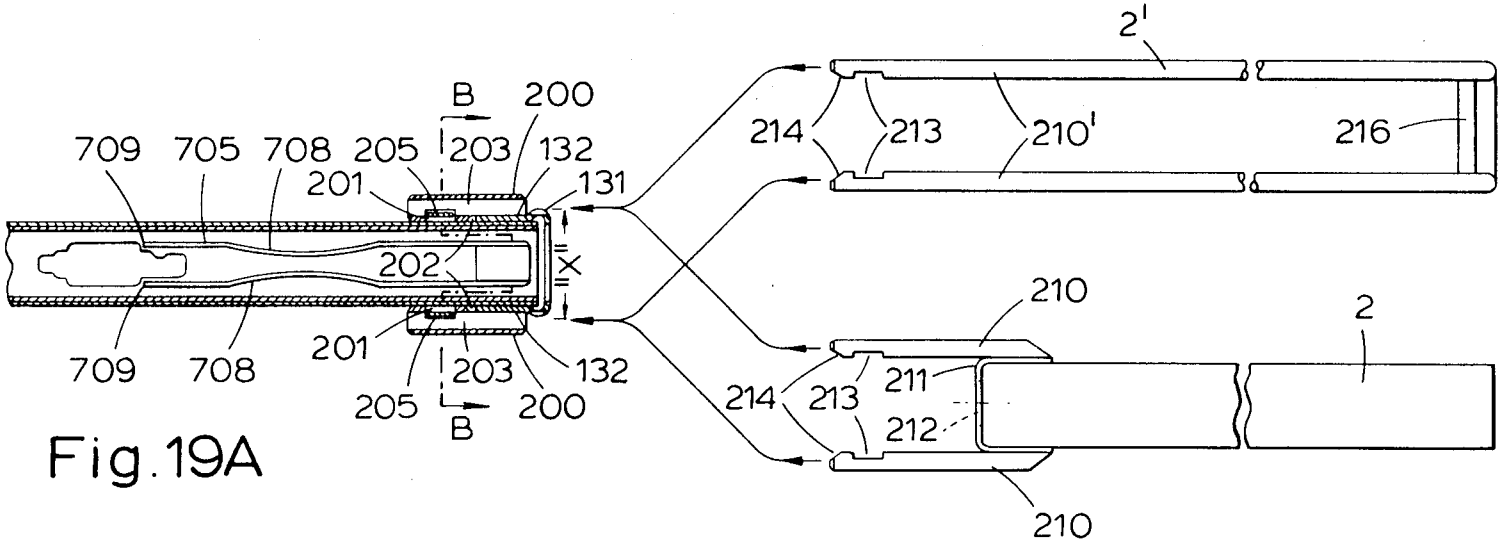
Figure 19B:
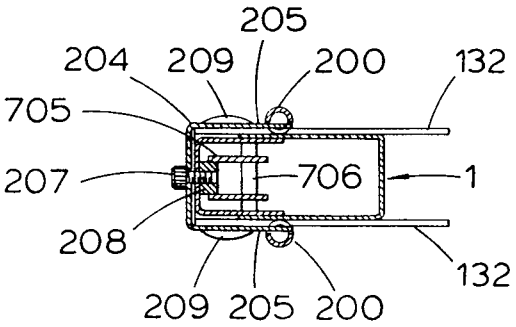
Figure 22A:
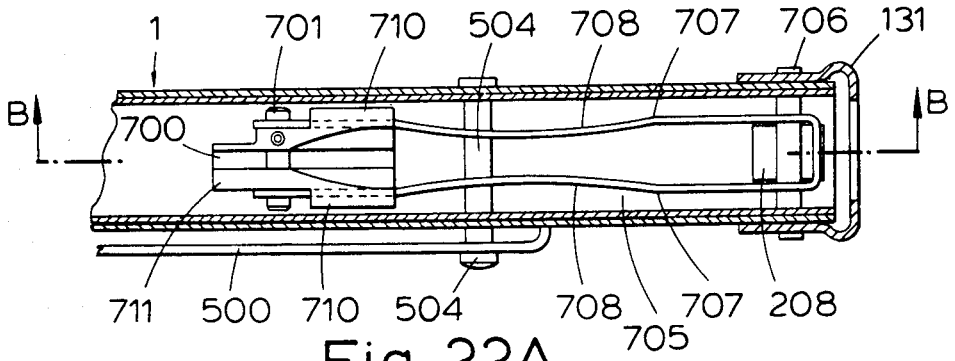
Figure 22B:
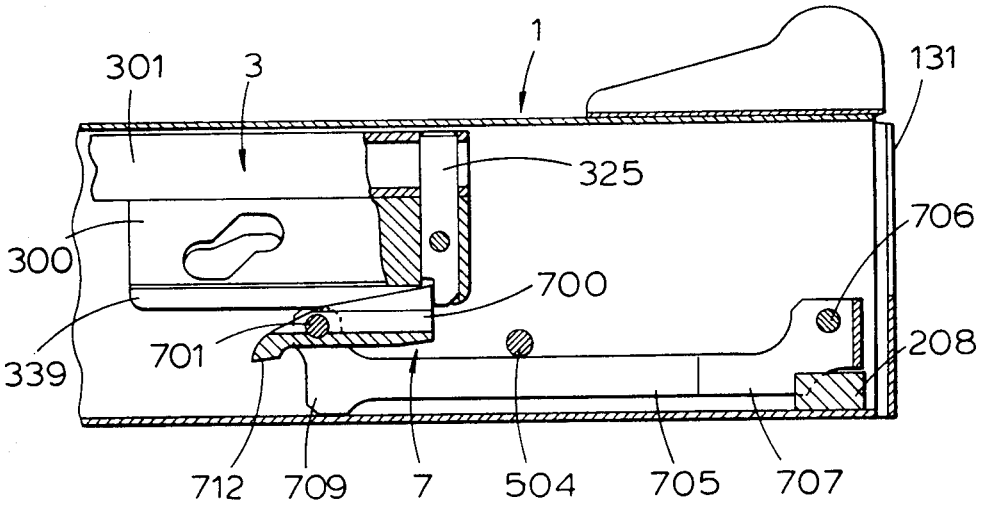
Figure 25:
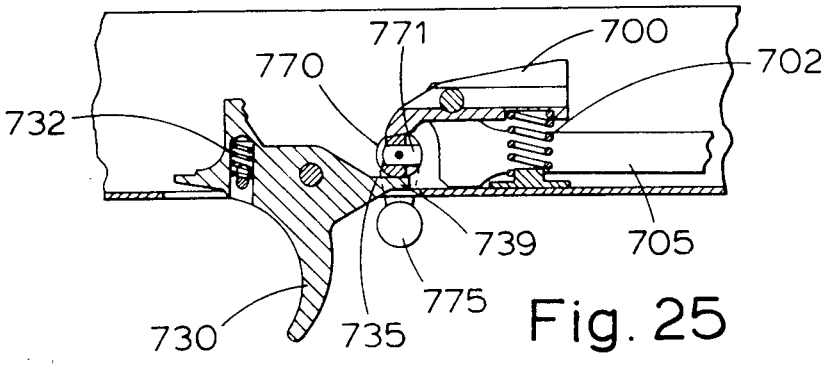
Figure 23A:
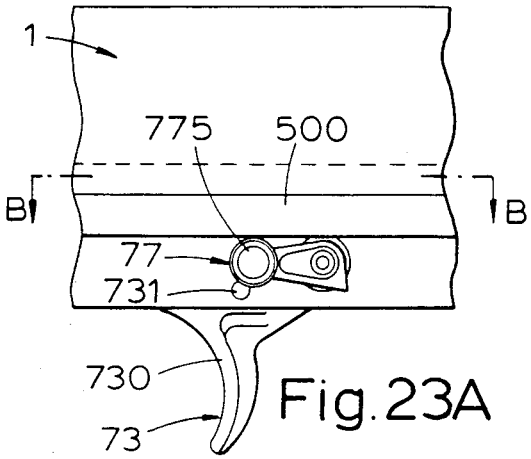
Figure 23D:
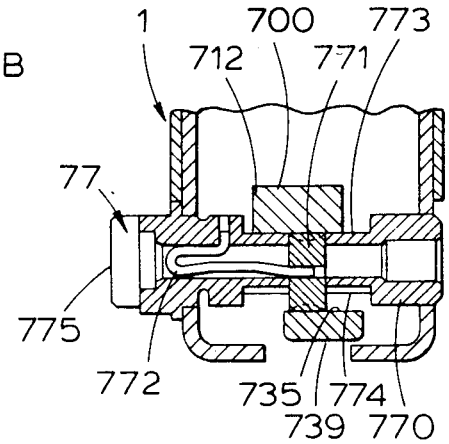
Figure 23B:
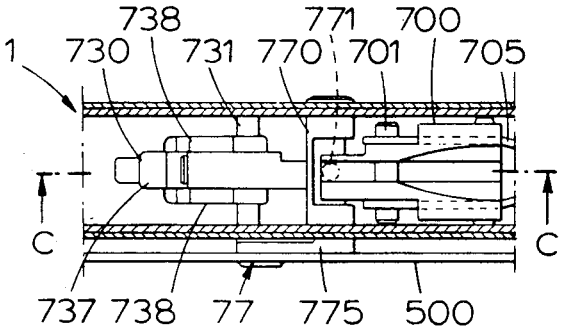
Figure 24:
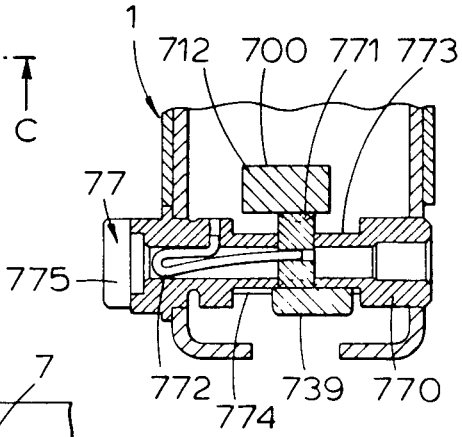
Figure 23C:
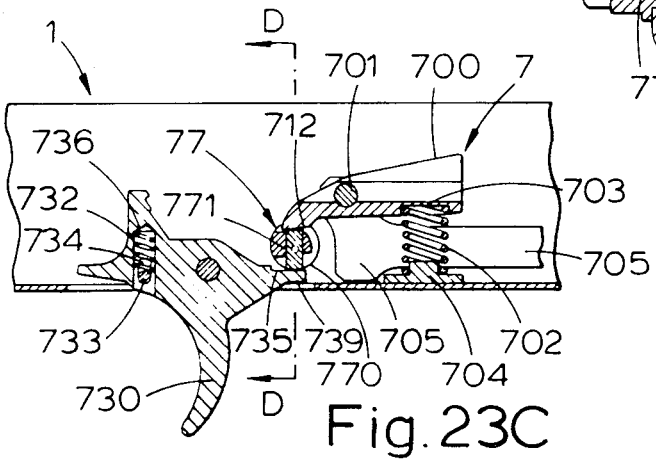
Figure 26:
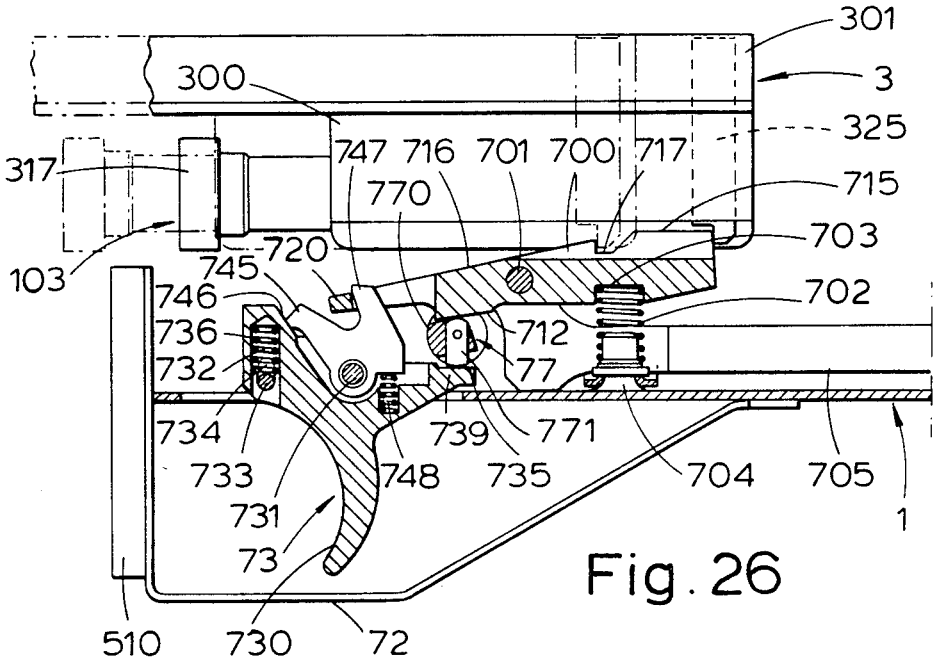
Figure 27:
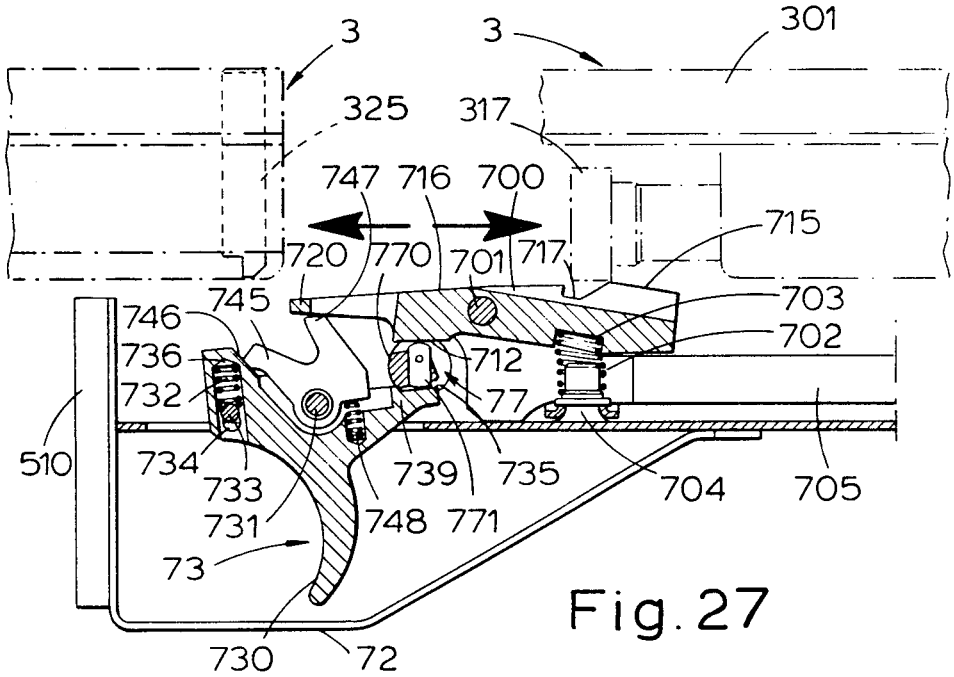
Figure 28A:
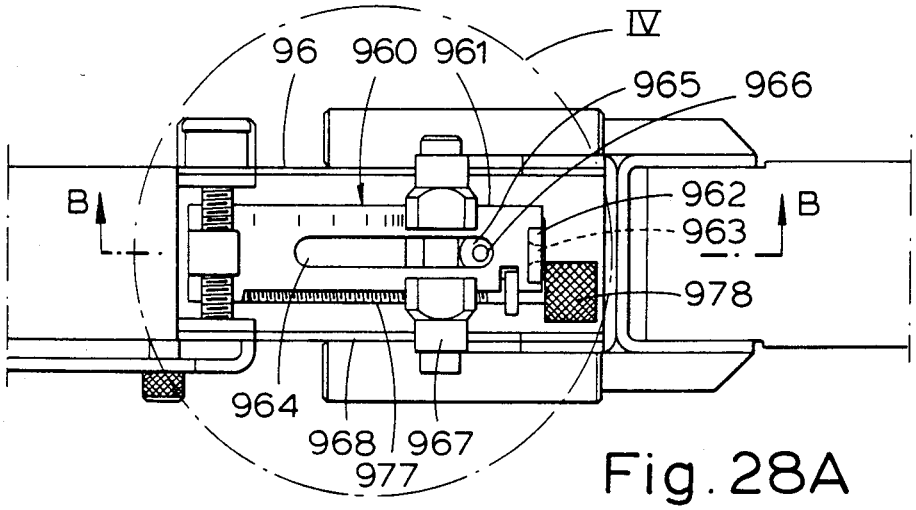
Figure 28B:
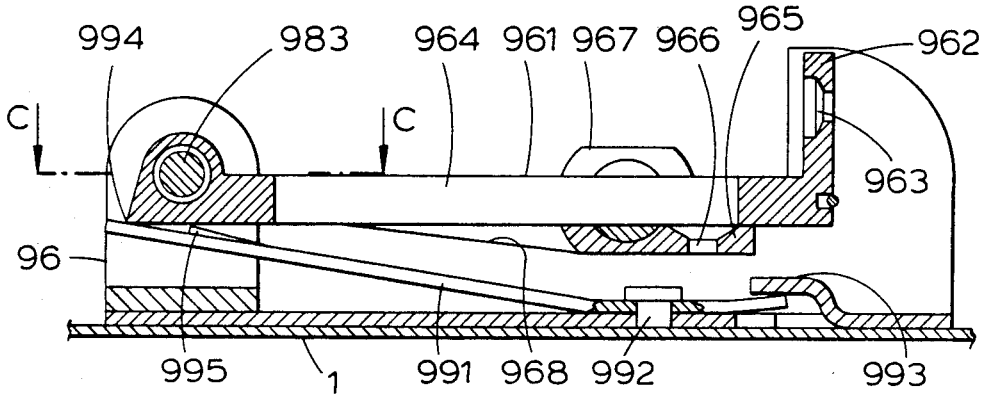
Figure 28C:
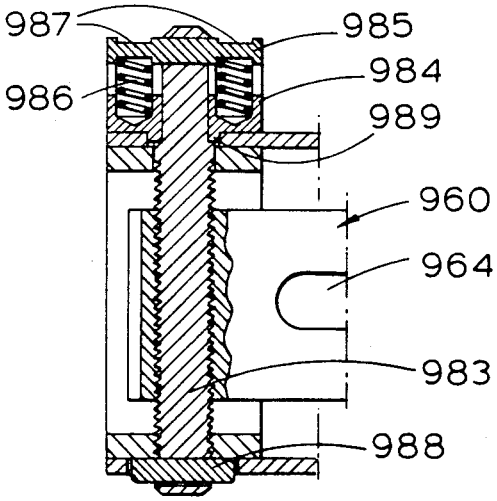
Figure 29:
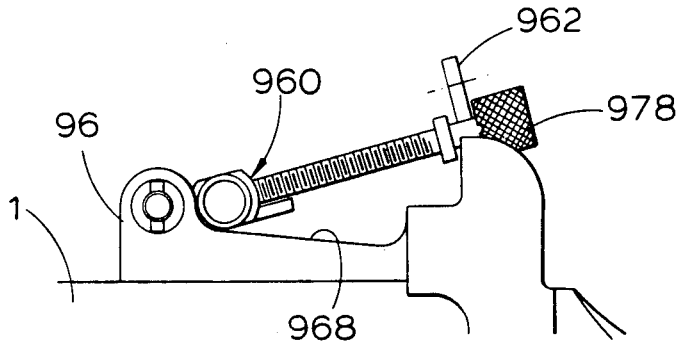
Figure 30:
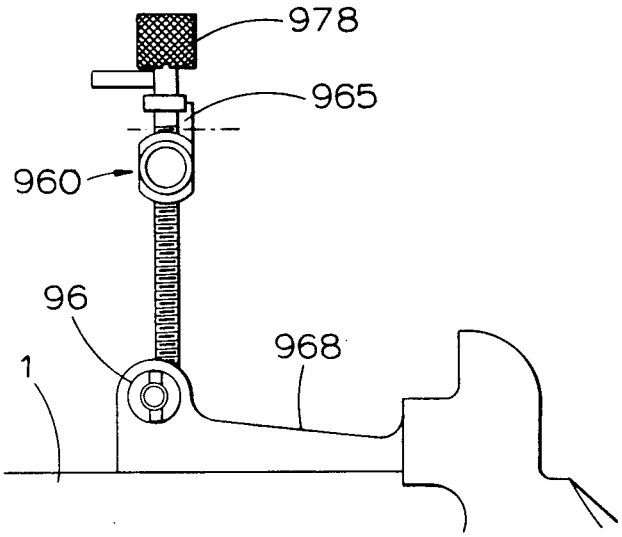
Figure 31:
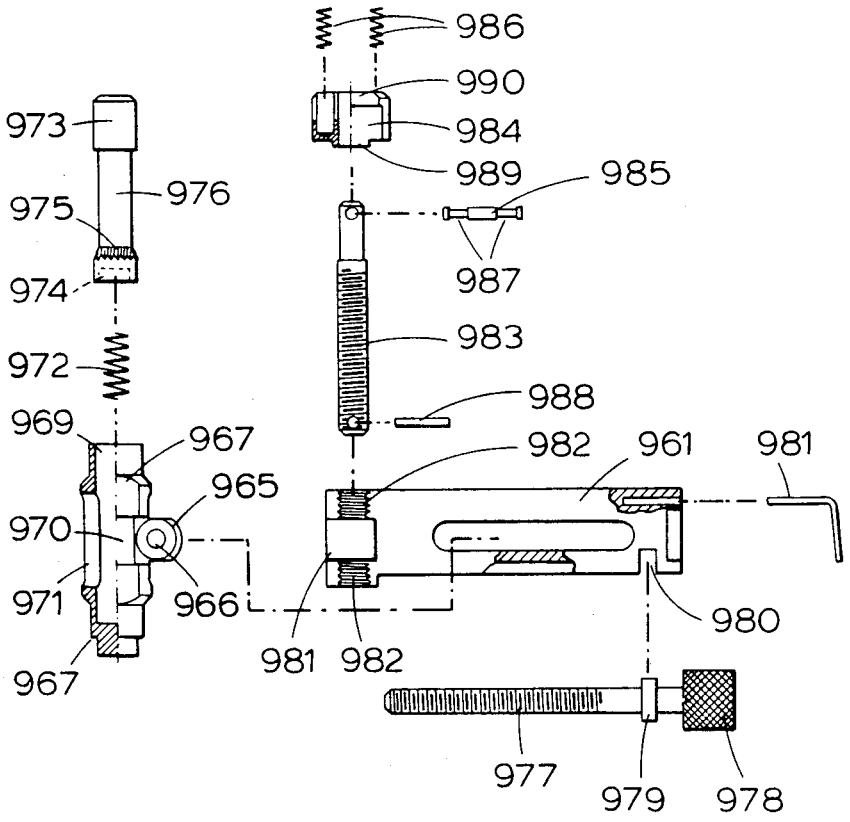

The invention will now be described by way of example with reference to the accompanying drawings, in which, FIG. 1 shows a left hand side view of a gas operated fully automatic gun in accordance with this invention, drawn to a reduced scale in comparison with the remaining figures, FIG. 2 shows a partial, longitudinal, cross-sectional, right hand side view of the gun shown in FIG. 1 with the gun cocked and ready to fire, FIG. 3 shows a partial longitudinal, cross-sectional, right hand side view of the gun shown in FIGS. 1 and 2 but with the trigger squeezed and the bolt in the firing position, FIG. 4 shows a partial longitudinal, cross-sectional, right hand side view of the gun shown in the preceding Figures but with the trigger squeezed and the bolt in its most rearward position thereby permitting a further cartridge to feed, FIGS. 5A, 5B, and 5C show pictorial views of the parts of the bolt carrier assembly which are welded together with FIG. 5A being an exploded view and FIGS. 5B and 5C showing opposing sides of the assembly, FIG. 6A shows the bolt carrier assembly with the introduction of a pair of sear lugs, FIG. 6B is a cross-sectional view on double arrow headed line B—B of FIG. 6A showing an anti-bounce weight, FIG. 6C is a cross-sectional view on double arrow headed line C—C of FIG. 6A drawn to a larger scale, FIG. 7A shows the complete bolt carrier assembly in accordance with the first feature of the invention, FIG. 7B is a cross-section on double arrow headed line B—B of FIG. 7A drawn to a larger scale, FIG. 7C is a cross-section on double arrow headed line C—C of FIG. 7A drawn to a larger scale, FIG. 7D is a cross-section on double arrow headed line D—D of FIG. 7B drawn to the same scale as FIG. 7A, FIG. 7E shows in partial cross-section a first angle projection of the bolt carrier assembly shown in FIG. 7A, FIG. 7F is a partial view in the direction of arrow headed line F in FIG. 7A, FIG. 8A is a partial view of FIG. 1 showing the latch assembly in accordance with the second feature of this invention and holding a drum magazine, FIG. 8B is a cross-section on double arrow headed line B—B of FIG. 8A, FIG. 8C is a cross-section on double arrow headed line C—C of FIG. 8A, FIG. 9A is a partial view of the gun shown in FIG. 1 showing the latch assembly in accordance with the second feature of this invention in which a flat box type magazine is being held, FIG. 9B is a cross-section on double arrow headed line B—B of FIG. 9A, FIG. 10A shows a side view of a receiver assembly in accordance with the third feature of this invention, FIG. 10B shows a cross-section on double arrow headed line B—B of FIG. 10A, FIG. 10C shows a cross-section on double arrow headed line C—C of FIG. 10A, FIG. 10D shows a cross-section along double arrow headed line D—D of FIG. 10A, FIG. 11 shows a barrel assembly partially in section, FIG. 12A shows part of a partially sectioned barrel assembly and receiver assembly combination in accordance with the third feature of this invention, FIG. 12B shows a view in the direction of arrow headed line B of FIG. 12A, FIG. 12C shows a cross-section along double arrow headed line C—C of FIG. 12A with the front wall of receiver omitted, FIG. 13A shows a sectional plan view of a cocking handle assembly in accordance with the fourth feature of this invention the cocking handle in a forward position, FIG. 13B shows a partial sectional view on double arrow headed line B—B of FIG. 13A with the cocking handle in a locked position, FIG. 14 is a sectional plan view similar to that of FIG. 13A except that the cocking handle is in its rearward position so that the bolt carrier assembly cocks the gun, FIG. 15A is a partial side view of the gun receiver with the cocking handle extracted and a part thereof in situ shown in phantom lines, FIG. 15B is a view on double arrow headed line B—B of FIG. 15A with the cocking handle shown removed to one side of the receiver, FIG. 15C is a view on double arrow headed line C—C of FIG. 15A, FIG. 16 shows a cocking bar welding assembly, FIG. 17A shows a partial side view of the gun shown in FIG. 1 without the magazine and with a conventionally styled buttstock incorporating the securing arrangement of the fifth feature of this invention, FIG. 17B shows a view on arrow headed line B—B of FIG. 17A, FIG. 18 shows a partial side view of the gun shown in FIG. 1 without the magazine and having a collapsible wire buttstock utilising the fixing arrangement in accordance with the fifth feature of this invention, FIG. 19A shows a partial, sectionalised, plan view of the gun and the interchangeable buttstocks, FIG. 19B shows a cross-section on double headed line B—B of FIG. 19A, FIGS. 20 and 21 show a method by which tolerancing errors on buttstocks of differing widths are accommodated, FIG. 22A shows a partial sectional plan view of the rear of the gun receiver demonstrating the sear buffer in accordance with the sixth feature of this invention, FIG. 22B is a cross-section along double arrow headed line B—B of FIG. 22A, FIG. 23A is a partial side view of the receiver shown in FIG. 1, FIG. 23B is a cross-section along double arrow headed line B—B of FIG. 23A showing the sear actuator in accordance with the seventh feature of this invention, FIG. 23C is a cross-section along double arrow headed line C—C of FIG. 23B, FIG. 23D is a cross-section along double arrow headed line D—D of FIG. 23C drawn to a larger scale, FIG. 24 is a cross-section similar to FIG. 23D but with the trigger pulled, and FIG. 25 is a cross-section similar to FIG. 23C but with the sear actuator rotated to prevent operation of the trigger, FIG. 26 shows a partially sectioned part view of a gun in accordance with the eigth feature of this invention showing the trigger mechanism in a rest position, FIG. 27 shows the trigger mechanism of FIG. 26 shown with the trigger pulled, FIG. 28A shows a top plan view of a rear sight in accordance with a ninth feature of this invention, FIG. 28B shows a cross-section along double arrow headed line B—B of FIG. 28A on a larger scale, FIG. 28C shows a cross-section looking along double arrow headed line C—C of FIG. 28B, FIG. 29 shows a side view of the rear sight mounted on a part view of a gun with the sight in its lower operating mode but with the sight at its highest position in that mode, FIG. 30 shows a further side view of the rear sight with the sight in its higher operating mode and with the sight in its highest position in that mode, and FIG. 31 shows an exploded view of the parts encircled IV in FIG. 28A in partial section.

Figure 32A:
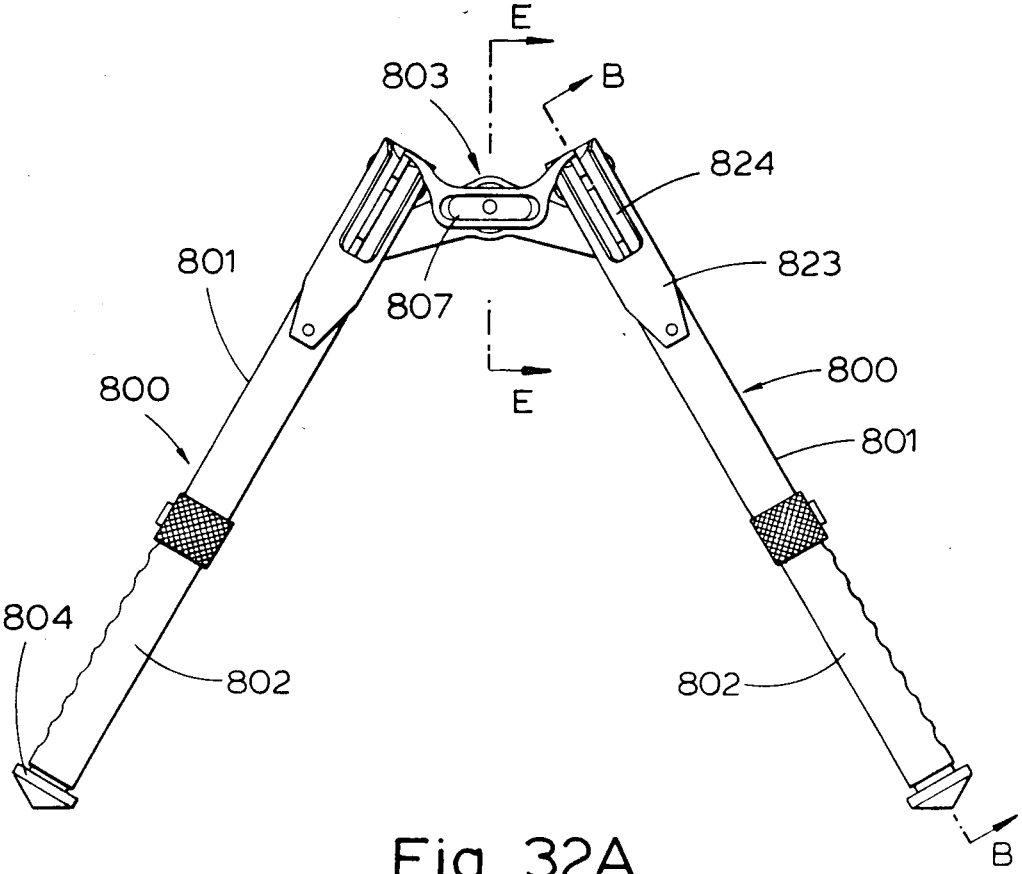
Figure 32E:
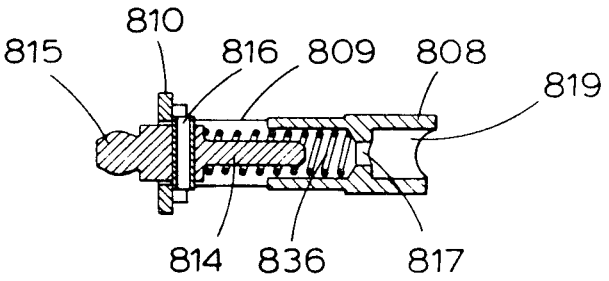
Figure 32B:
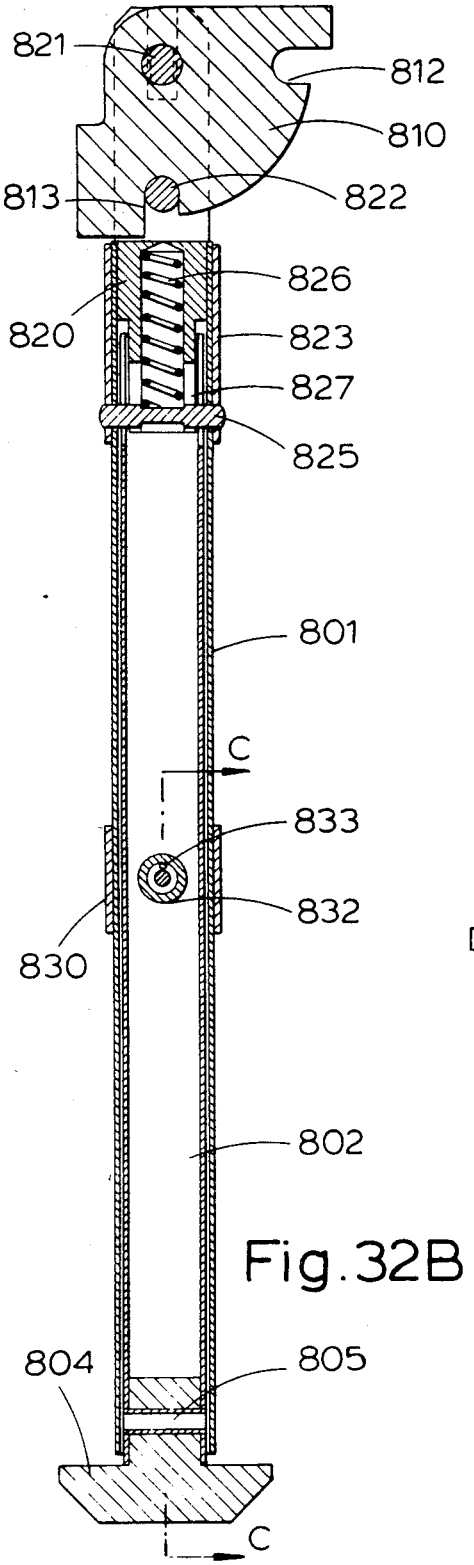
Figure 32D:
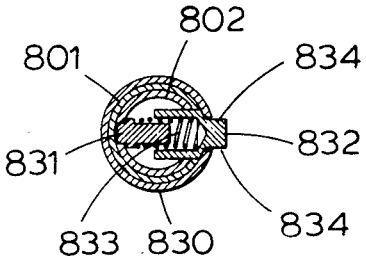
Figure 32C:
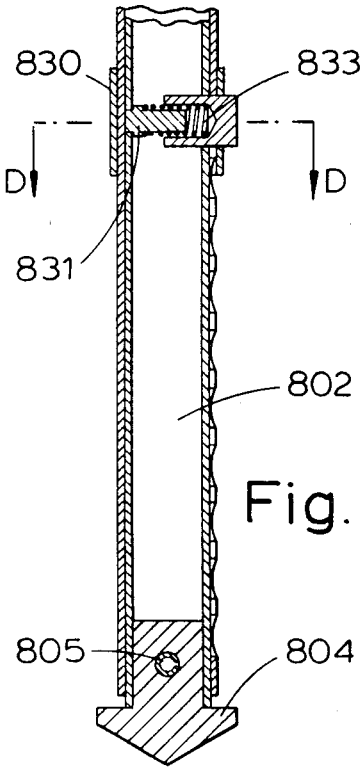
Figure 33:
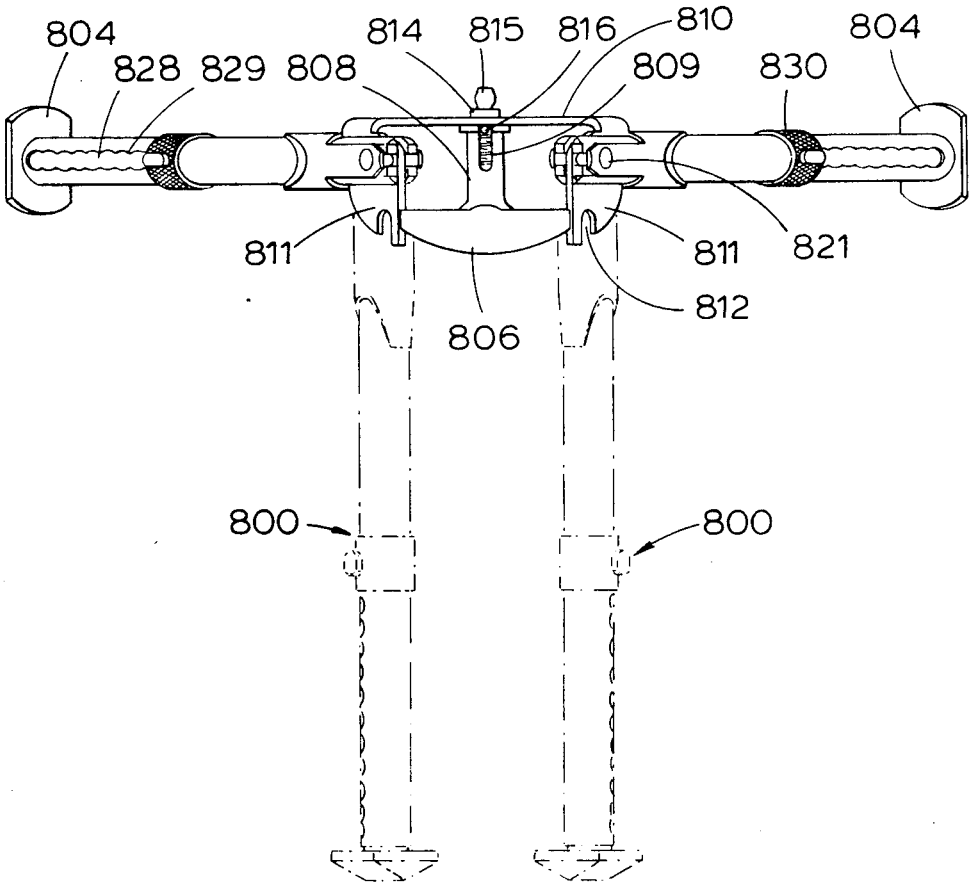
Figure 34:
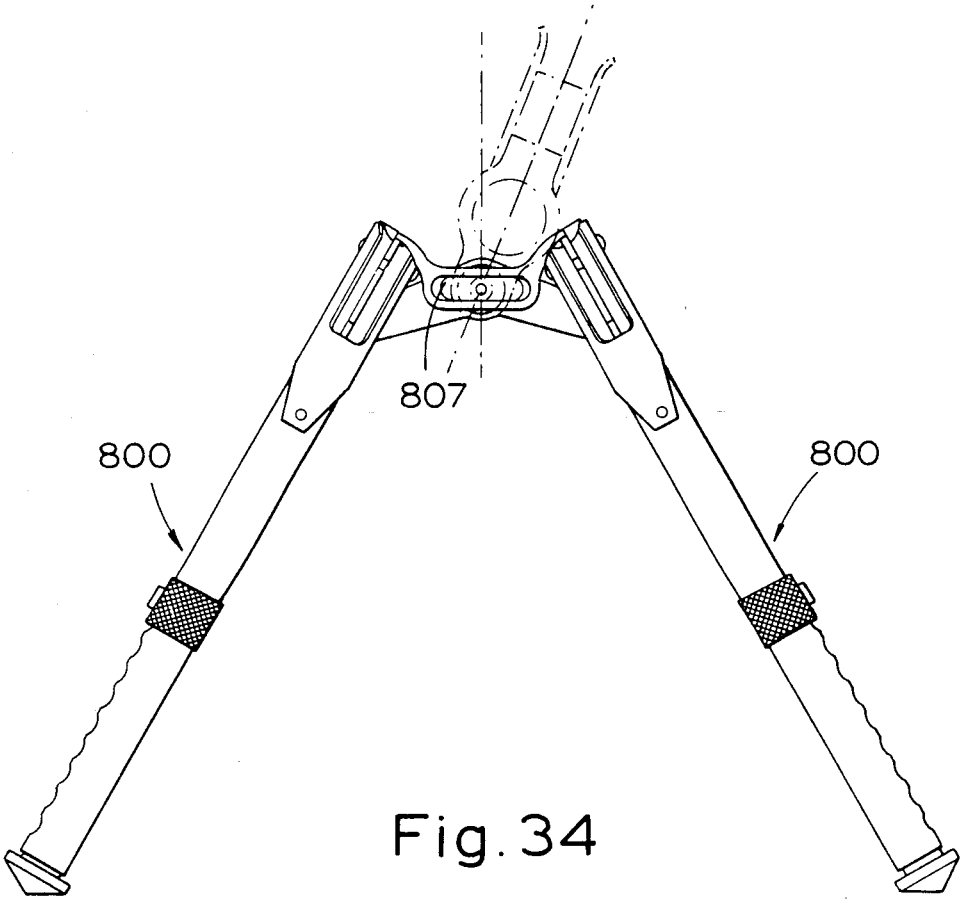
Figure 35:
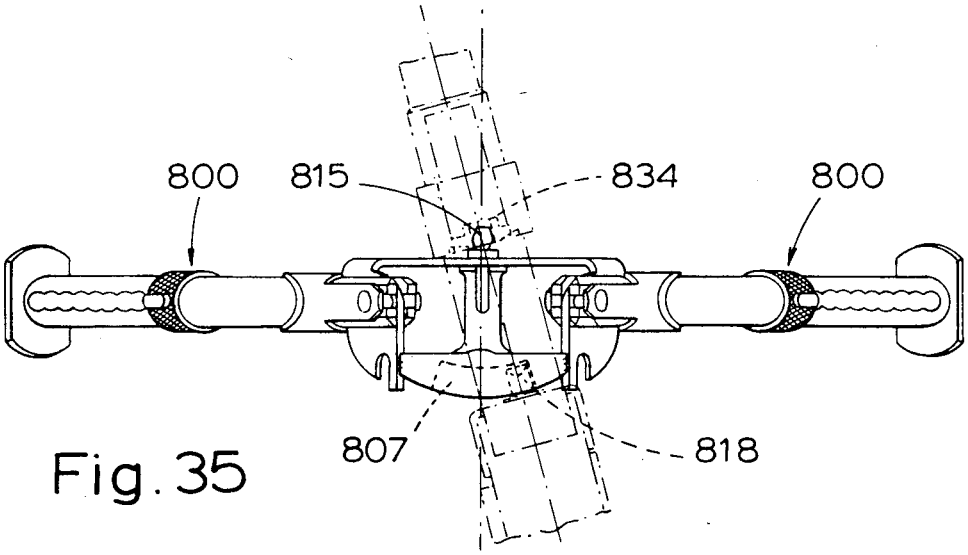
Figure 36:
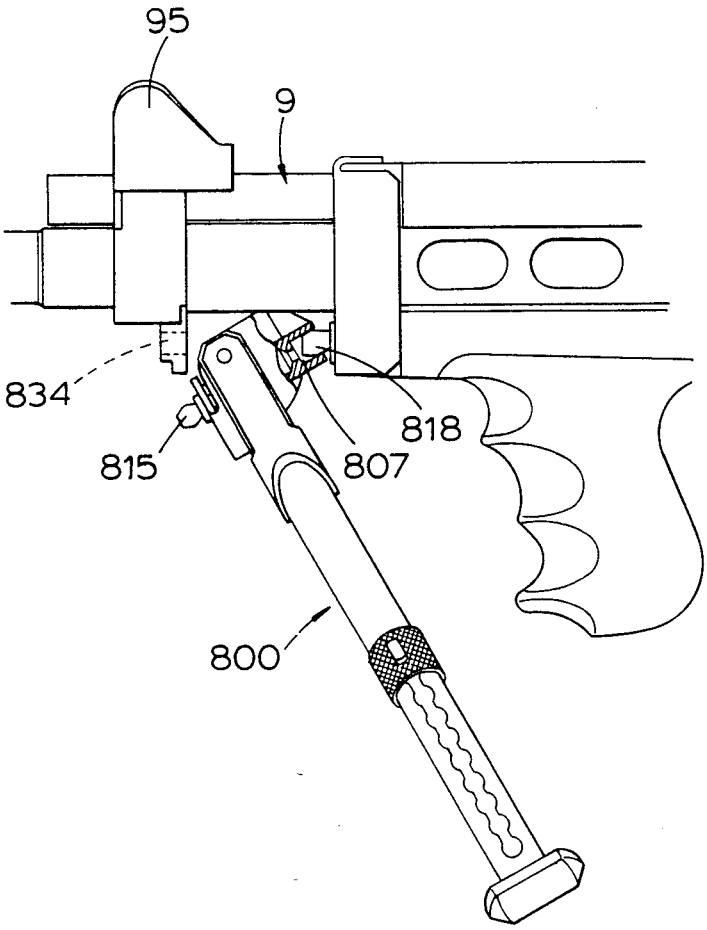

FIG. 32A shows a rear side view of a bipod in accordance with a tenth feature of this invention, FIG. 32B shows a cross-section of the bipod along double arrow-headed lines B—B of FIG. 32A, FIG. 32C shows a cross-section along double arrow-headed lines C—C of FIG. 32B, FIG. 32D shows a cross section along double arrow-headed lines D—D of FIG. 32C, FIG. 32E shows a cross-section along double arrow-headed lines E—E of FIG. 32A, FIG. 33 shows a top plan view of the bipod shown in FIG. 32A and, in phantom lines, with the legs raised, FIG. 34 shows the bipod of the invention connected to a gun depicting the gun rolling in a Y-plane, FIG. 35 shows the bipod of the invention connected to a gun depicting the gun sweeping in an X-plane, and FIG. 36 shows the bipod in partial section being attached/detached to a gun.

In the Figures like reference numerals denote like parts.

The gas operated automatic gun shown in FIG. 1 has a receiver 1 to the rear wall channel 131 of which is connected a buttstock 2 and at the opposite end of the receiver 1 from the buttstock 2 there is connected a barrel 10. A pistol grip 11 is connected by a screw and nut underneath the receiver 1 and a fore grip 12 is connected by screws on the underside of the barrel 10. The pistol grip 11 is connected to the receiver 1 through the intermediary of a trigger guard 72 shrouding a trigger assembly 73 having a rotatable sear actuator (safety catch) 77.

Mounted in the bottom well of the receiver 1 is a cartridge magazine 4 which is of the drum type although it may be a flat box-type magazine. The magazine 4 is held to the receiver by a magazine latch assembly 5 having a spring arm 500 which is provided with a 90 degree twist 501 and pins 502, 503 which extend through the side wall of the receiver to engage cooperating holes in the magazine 4. The pins 502, 503 prevent fore and aft rocking of the magazine and to prevent lateral rocking of the magazine (with respect to the longitudinal axis of the gun) the magazine is provided with a vertical key 410 mounted within a "C" cross-sectionally shaped bulk-head 510 which is formed as a vertical front part of the trigger guard 72.

The spring arm 500 is arranged to be pushed outwardly, away, from the receiver by force being applied to the right end (looking forwardly) of an actuator rod 505 which passes through both side walls of the receiver 1 so that the pins 502, 503 disengage from the magazine 4.

A cocking handle assembly 6 is mounted on the left hand side of the receiver 1 incorporating a cocking bar sub-assembly 60 including a cocking bar 600 to which is connected a rotatable cocking handle 601. The cocking bar 600 is guided by a "C" cross-sectionally shaped sheet member 602 which has opposing open faces of the "C" welded to the receiver and which has an upper portion of the "C" removed to form a U-shaped, in cross-section, leg 603 that acts as a rail for the cocking bar 600. The cocking handle 601 is provided with a locking pin 604 which cooperates with a slot (not shown) in the leg 603 to selectively prevent longitudinal movement of the cocking bar and cocking handle.

Mounted on the top rear of the receiver 1 is a rear sight mount 96 and on the right hand side of the receiver is a carrying handle 97. Also on the right hand side of the receiver is an ejector slot 104 and in both sides at the front of the receiver are provided four cooling apertures 105 to assist in removing heat from the rear end of the barrel 10. A gas system 9 is connected in between the front of the receiver 1 and a foresight assembly 95. A bayonet lug attachment 98 is provided on the barrel and at the muzzle there is a flash suppressor 99.

Turning now to FIGS. 2, 3 and 4, the trigger assembly 73 has an arcuate finger pull trigger 730 pivotally mounted on a rod 731, the trigger 730 being biassed by a spring 732 acting in a blind hole 736 within the trigger 730 with one end of the spring 732 against the closure of the blind hole 736 and the other end of the spring against a trigger spring retainer 733 which is stationary with respect to the receiver. The retainer 733 is located in a guide slot 734 in the trigger. A top rear face 735 of the trigger 730 acts against the conventionally supplied sear assembly 7 through the intermediary of a sear actuator 77. The sear actuator 77 has a hollow cylinder 770 which extends between the major walls of the receiver and slidingly mounted across the axis of the cylinder is an actuator 771 which is spring biassed toward the trigger top rear face 735. The sear assembly 7 has a sear 700 pivotally mounted on a transverse rod 701 which passes through the side limits of a U-shaped sear buffer 705 into opposing side walls of the receiver. Toward the bottom of the U shaped sear buffer 705, i.e. rearward of the gun, is a cross rod 706 which secures the buffer to the receiver and the buffer 705 is also located by a circularly cross-sectioned cross bar 504 which secures one end of the spring arm 500 and assists in holding the buffer 705 downwardly. The sear 700 is biassed into a non-firing position by a compression spring 702 located between a recess 703 in the sear 700 and a stud 704 mounted on the base of the receiver.

A bolt carrier assembly 3 is slidably mounted upon a rail 101 in the receiver and the bolt carrier assembly comprises a block 300 which is suitably shaped to contact with the rail 101 and in which is secured a pair of vertical (as shown in FIGS. 2, 3 and 4) sear locking lugs 325, one on each side of the gun longitudinal axis (only one of which is shown in the sectional view of FIGS. 2, 3 and 4). Secured, for example, by welding to the top of the block 300 is a "P" cross-sectionally shaped sheet member 301 with the upright of the "P" being horizontally disposed so the "P", as it were, lies on its back. Inside the wrapped over, enclosed portion of the "P" is a spring biassed antibounce weight (not shown) and longitudinally disposed adjacent to the non-enclosed portion of the "P" is a main drive spring assembly 302. For ease of explanation, it should here be stated that the main drive assembly 302 has been shown as if it were on the axial centre line of the gun but in practice the assembly 302 is offset to the right of the centre line when viewed forwardly so it does not interfere with the gas piston (hereinafter described). The main drive spring assembly 302 has a guide rod 303 of circular cross-section having end portions 304, 305 respectively, the part between the end portions 304, 305 being provided with parallel flats 306. Mounted over the guide rod 303 is a main drive spring 307. At the end of the P shaped member 301 remote from the block 300 is a bush 308 having a recess 309 into which the spring 307 is located and a circular cross-sectioned recess 310 to slidingly accept the end 304 of the guide rod 303. At the remote end of the main drive spring 307 from the bush 308 is a collar 311 which is secured to the guide rod 303 by a cross pin 312; the purpose of the collar 311 being to provide an end retainer for the spring 307 and to support the rear end of the guide rod 303 on a lug 102 on a receiver rear wall 100 which is mounted in the channel 131. The cross pin 312 extends through a slot in the side wall of the receiver and hence prevents the rear wall 100, which is slidably mounted, from dropping unless the collar 311 is removed from the lug 102 by sliding the cross pin 312 forwardly.

Mounted on the longitudinal axis of the barrel and inside the block 300 is a firing pin 313 which is biassed in a rearward position by a compression spring 314 with the limits of travel of the firing pin being maintained by a slot 315 in the firing pin cooperating with a cross pin 316, the spring 314 and pin 316 being provided essentially for a removal of the firing pin.

Encompassing the front portion of the firing pin is a bolt 317 which is slidingly rotatable on the longitudinal axis of the barrel inside the block 300 and is thus movable relative to the carrier assembly. The bolt 317 is conventionally provided with a cam pin 318 which pin 318 cooperates in known manner with a cam slot (not shown) in the left hand side (looking forwardly) of the block 300. Further, the bolt 317 is provided in conventional manner with an ejector pin 319 which is offset to the left (looking forwardly) of the barrel longitudinal axis and which pin is forwardly biassed by a coil spring 320, the forward extent of travel of the pin 319 being limited by a stop 321 acting in a slot in the pin 319. The bolt 317 also has a spring biassed claw (not shown since it is positioned on the right of the longitudinal centre line looking forwardly) which in operation engages the cannelore of a cartridge for removal of the cartridge from a chamber 109 that is situated in a barrel extension 110. At the rearward end of the barrel extension 110 are locking lugs 111 with which corresponding lugs 322 on the bolt 317 interleave and when the bolt is rotated by the action of the cam pin 318 in its cooperating cam slot locks the bolt lugs 322 into engagement with the lugs 111 so that the bolt 317 is unable to move in a rearwards direction. So as to ensure that the lugs 322 of the bolt correctly interleave with the lugs 111, the bolt when withdrawn from the barrel extension 110 is prevented from rotating by a latch 326 which is generally of V-shaped cross-section and is forwardly biassed by a spring 327 to engage between two of the top-most lugs 322. The latch and spring 327 are on the longitudinal axis of the gun and movable within the block 300 by an amount determined (in the ultimate) by a slot 328 in the latch 326 and a transverse stop pin pin 329.

A feed ramp 114 is provided on the lower internal periphery of the barrel extension to facilitate entry of a cartridge into the chamber 109. The barrel extension 110 which is secured to the barrel 10 by an external screw thread 112 on the barrel is connected to the receiver 1 by a block 113.

Located at a predetermined distance along the barrel 10 is the gas system 9 having a rearwardly inclined gas port 900 which is connected to a gas cylinder 901 in which operates a piston 902. The gas cylinder 901 is mounted between the conventional foresight assembly 95 and a bush 904 which is arranged to align the gas cylinder 901 with the receiver 1. A compression spring 903 biasses the piston 902 in a forwards direction toward the foresight assembly 95. It will be seen that the guide rod 303 is extended forwardly of the barrel extension so that the end 304 is adjacent the bush 904. When the bolt carrier assembly is in its extreme forward position the piston 902 is arranged to substantially abut the forward end bush 308 of the "P" shaped member 301.

In operation, to cock the gun, the cocking handle 601 is rotated anticlockwise as viewed in FIG. 1 to release the locking pin 604 and the handle 601 pulled rearwardly which in turn pulls the bolt carrier assembly 3 rearwardly so that it is held by the sear 700 engaging lugs 325; the various elements adopting the positions shown in FIG. 2. The cocking handle 601 is then returned to its original position and the locking pin 604 rests in its associated recess to prevent unwanted movement of the cocking handle assembly 6.

To fire the gun, the trigger 730 is pulled rearwards, as shown in FIGS. 3 and 4, against the force of spring 732 so that the face 735 rotates clockwise about rod 731 and as a consequence face 735 pushes actuator 771 upwardly so as to tilt the sear 700 anticlockwise, as viewed in FIGS. 2, 3, 4, against the compressive force of spring 703. As the sear 700 tilts it releases the lugs 325 thereby releasing the bolt carrier assembly 3 which is driven forwardly by the tension created in cocking the main drive spring 307. As the bolt carrier assembly 3 moves forward toward the barrel extension 110 the lower edge of the bolt strips a cartridge 499 from the magazine 4 and continued travel of the bolt carrier assembly causes the cartridge 499 to ride over the feed ramp 114 in the barrel extension to thereby insert the cartridge into the chamber 109. However, as the bolt lugs 322 interleave the barrel extension lugs 111 the latch 326 which normally engages the lugs 322 of the bolt to prevent rotation thereof is pushed rearwardly against spring 327 by a member 130 so as to release the bolt and thus enable the bolt to rotate by the motion of the cam pin 318 along the cam slot. Rotation of the bolt 317, causes the lugs 322 on the bolt to rotate and engage, i.e lock, with the lugs 111 of the barrel extension 110 thus locking the bolt 317 against rearward travel. The cartridge 499 is thus locked into the chamber 109 and the ejector pin 319 is pushed rearwardly so that the parts are in the position shown in FIG. 3. Continued forward motion of the bolt carrier assembly 3 drives the firing pin 313 into the rear of the cartridge thereby igniting the cartridge charge. The bush 308 of the "P" shaped member 301 is then in substantially the same plane as the front part of end portion 304.

As the cartridge fires, it produces gas pressure and when the bullet passes the gas port 900 so the gas under pressure enters port 900 to expand in the cylinder 901. Pressure in the cylinder 901 causes the piston 902 to be driven rearwardly and because the piston 902 is arranged to normally abut the bush 308 on the guide rod 303 (although in practice there will be a small gap between the adjacent faces owing to tolerances) so the bush 308 is driven rearwardly to compress the main drive spring 307. It is to be noted that, as shown in FIG. 4, the length of travel of the piston 902 is much less than that of the bolt carrier assembly 3, the piston stopping against a shoulder but the bolt carrier assembly continuing rearwardly due to the energy and impulse stored within its mass during acceleration by the gas system. Because the gas pressure in the barrel ceases as soon as the bullet leaves the barrel, the position and amount of gas permitted to enter the gas cylinder 901 is carefully arranged. The rearward motion of the bolt carrier assembly 3 and hence cam slot causes the cam pin 318 to retraverse the cam slot and thereby rotate and unlock the bolt 322 from the barrel extension lugs 111. Continued rearward motion of the bolt carrier retracts the bolt 317 and causes the cartridge extraction claw (not shown) carried by the bolt, which when in the locked position engaged the cannelore of the cartridge, to pull rearwardly on the cartridge and to thus remove the cartridge from the chamber 109. Further rearward motion of the bolt carrier assembly 3 causes the spent cartridge to align with the ejector slot 104 in the right hand side of the receiver. The ejector pin 319, due to its offset on the left side of the longitudinal axis of the spent cartridge and the claw on the bolt holding the right side of the cartridge, combined with the spring tension of spring 320 pushing the pin 319 forwardly causes the cartridge to be ejected out of the ejector slot 104. Continued rearward motion of the bolt carrier assembly uncovers the top cartridge in the magazine and carries the lugs 325 beyond the rear of the sear 700 so as to thereby recock the gun and the parts pass through the position shown in FIG. 4 with a fresh cartridge 499′ having risen into the feed area 103. Provided the trigger 730 is still squeezed the bolt carrier returns forward and the cycle of events will repeat until such time as either the trigger is released so that the sear 700 re-engages the lugs 325 with the shock of the engagement being taken by the buffer 705 (as shown in FIG. 2) or the final cartridge is fired when, if the trigger is still squeezed, will result in the bolt finishing the cycle of events locked to the barrel extension as shown in FIG. 3.

It is to be noted that in the present invention the bolt carrier assembly 3 is retarded solely by the action of the main drive spring 307 and unlike known gas operated automatic guns, the present invention does not have a bolt carrier assembly which imparts in any way against the rear receiver wall 100, i.e., the aforementioned buffer of the M16 and comparable weapons is not provided and with no buffer impact or direct impact the controllability of the gun is improved.

Various features of the present invention will now be described.

Bolt Carrier Assembly

Referring to FIGS. 5A, 5B and 5C the metal block 300 is seam welded to the P cross-sectionally shaped member 301 so that the block 300 underlies one end of the outer, longest, flat surface of the P shaped member. At the opposing end of the P cross-sectionally shaped member 301 from the block 300 is a bush 308 having a leg 332 which is shaped and arranged to fit within the wrapped over portion of the P shaped member 301 and the bush 308 is welded to the P shaped member 301.

The P cross-sectionally shaped member 301 is formed from a metal sheet and the wrapped over join of the enclosed part of the P is seam welded at locations 331. The P shaped member 301 has a slot 333 cut into the top of the P shape at the end of the member 301 adjacent to the bush 308. The slot 333 has an arcuate end and is dimensioned to act as a cocking handle shoulder 334 and it is with this shoulder that the cocking handle assembly cooperates to draw the member 301 rearwardly and thus cock the gun. It is to be noted that the length of the slot 333 is less than that of the leg 332 so that the interior of the wrapped over portion of the P shaped member 301 is closed at its end adjacent the bush 308.

It is to be noted that the face of the bush 308 remote from the P shaped member 301 is the surface upon which the gas piston 902 strikes. The bush 308 has the recess 309 to accept one end of the main drive spring 307 and the circularly cross-sectioned recess 310 to accept the end 304 of the guide rod 303. In the left hand side (as shown in FIGS. 5A and 5B) of the bush 308 is a slot 335 to facilitate mounting the main drive spring assembly 302 (see also FIG. 7E). In this respect, the width of the slot 335 is only slightly greater than the width between the flats 306 on the guide rod 303 so that the guide rod 303 can be inserted into the bush 308 and the main drive spring 307 holds the circular end 304 of the guide rod in the recess 310. The slot 335 is thus too small to permit the drive spring 307 to pass therethrough. On the opposite side of the bush 308 to the slot 335 is a groove 336 which aligns with the slot 333 in the P shaped member 301.

The block 300 has two parallel bearing surfaces 338 upon which the bolt carrier assembly 3 runs on guide rails 101, and an extended portion 339 having the same depth as the sear locking lugs 325. The purpose of the extended portion 339 is to ensure that a cartridge is held downwardly in the magazine when the bolt carrier assembly 3 makes a rearward traverse thus ensuring that the locking lugs 332 on the bolt do not strike the shoulder of the cartridge and thereby damage the cartridge. As best shown in FIG. 7C, the block 300 has a longitudinal bore 340 within which slides the bolt 317 and the bore 340 is linked via a passage 341 to a further bore 342 which is coaxial with the bore 340 and which houses the spring 314 for the firing pin 313.

In the right hand side (as viewed in FIGS. 5A and 5B) of the block 300 is the cam 343 whithin which the cam pin 318 operates. A transverse hole 344 is provided through the block 300 for the cross pin 316.

In the top of the block 300, i.e. in the surface adjacent the P shaped member 301 is a blind longitudinal groove 345 in which the bolt latch 326 is subsequently positioned and a transverse groove 346 is provided for positioning the stop pin 329. The forward end of the block 300 has a transverse clearance hole 347 opposite the cam 343 dimensioned to permit a tool to be inserted thereinto so that pressure can be applied to the cam pin and thereby enable the cam pin to be removed.

Extending downwardly through the rear end of the P shaped member 301 and block 300 are a pair of holes 348 for the sear locking lugs 325.

Referring now to FIGS. 6A, 6B and 6C, the sear locking lugs 325 are seen to be of circular cross-section with the lower end of the lugs being provided with a forwardly facing flat surface 349 which cooperates with the rear top portion of the sear 700. By mounting the locking lugs 325 through both the P shaped member 301 and the block 300 improved strength is provided to the join between the member 301 and block 300. The locking lugs 325 are held in position by a cross pin 316 having a circular cross-section with a flat upper face 351 which is machined to form an abutment face 352. The pin 316 is contacted on its flat upper face 351 by an orthogonally extending pin 353, the pin 353 being provided to prevent total removal of the cross pin 316 by the pin 353 contacting abutment face 352.

As shown in FIGS. 2, 3, 4 and in 7D, the cross pin 316 also maintains the longitudinal position of the firing pin 313. The reason for the cross pin 316 being permitted to be partially withdrawn is so that the firing pin 313 may be removed for dissassembly of the cam pin and bolt from the bolt carrier. The purpose of the spring 314 associated with the firing pin is to ensure constant contact with the cross pin. It will be seen from FIGS. 7D and 7C that the firing pin is generally of circular cross-section with the rearward end of the firing pin having a rectangular cross-section and the slot 315 being provided in the upper edge to accommodate cross pin 316.

An anti-bounce weight in the form of a square cross-sectionally shaped rod 354 has a chamfer 355 at one end and a reduced circularly cross-sectioned end 356 at the other to accommodate a compression spring 357. The anti-bounce weight is thus positioned so that the chamfer 355 rests between the wrapped over part of the "P" and the locking lug 325 at one end, and is under tension by the compression spring 357 abutting leg 332. The function of the anti-bounce weight 354 occurs after the bolt 317 hits the barrel extension 110 and the cam pin 318 is rotated by the cam 343. The block 300 continues to travel forwardly to drive the firing pin 313 into the back of the cartridge and simultaneously to impact barrel extension. When the block 300 strikes the barrel extension the block and the members secured to it tend to bounce rearwardly away from the barrel. The purpose of the anti-bounce weight is that, as the block 300 strikes the barrel extension and tries to rebound, the anti-bounce weight mass impetus carries it forwardly against the force of spring 357 until it impacts the leg 332 thereby substantially cancelling the rebound of the bolt carrier. In this manner, substantially zero restitution is provided. Once the shock impact has been overcome so the anti-bounce weight is driven rearwardly by the compression spring 357 and the chamfer 355 ensures that the anti-bounce weight 354 is nested between the "P" shaped member 301 and locking lug 325 and in this manner the anti-bounce weight 354 is wedged to prevent multiple bouncing back and furth within the bolt carrier.

Referring to FIG. 7A, the cam pin 318 is shown at the bottom of the cam 343 and in such a position the lugs 322 of the bolt are arranged to interleave with the lugs 111 of the barrel extension and the lugs are locked in position by the latch 326. As previously described, the latch 326 has a slot 328 removed from its top surface (as viewed in FIGS. 2, 3, 4, 7A and 7D) and, as shown particularly in FIG. 7D, the latch 326 is biassed forwardly by the spring 327. The stop pin 329, mounted in groove 346, in conjunction with slot 328 determines the limit of travel of the latch 326. As shown in FIG. 7C, on opposing sides of the axis of the bolt 317 is the ejector pin 319 and the extractor claw 360. The pin 319, which is housed within the wall of the bolt, has been described above and so will not be described in any further detail.

The extractor claw 360 forms part of the peripheral wall of the bolt. The claw has an opening 361 for permitting the rim of the cartridge to enter thereinto and is pivoted about an axle 362 by a compression coil spring 363 so that the opening 361 is biassed toward the axis of the bolt 317.

As mentioned above, the main drive spring 307 is located at one end in recess 309 and at the other end it is held by the collar 311. The collar 311 has the cross pin 312 guided by a slot 364 and the free end of the cross pin 312 lying outside the collar 311 is connected to a handle 365. The collar 311 is arranged such that, when forced rearwardly by the main drive spring 307 so the collar, which is tubular, is located on the lug 102 on the rear receiver wall 100. A slot is provided in the right hand side receiver wall, looking forwardly, to permit the cross pin 312 to pass therethrough so that the handle 365 is on the outside of the receiver. To permit dissassembly of the bolt carrier assembly 3 the buttstock 2 is removed and the rear receiver wall 100 is arranged to be vertically slidable. So as to permit the wall 100 to slide, the handle 365 is pushed forwardly (within the confines of the slot 364) so that the collar 311 disengages the lug 102. The wall 100 is thus able to move downwardly and the bolt carrier assembly may be slid rearwardly along rail 101 and removed from the receiver 1.

In operation, as the bolt carrier assembly 3 lugs 322 interleave the lugs 111 on the barrel extension so the member 130 pushes the latch 326 rearwardly against the compressive force of spring 327. The bolt is thus unlatched and free to rotate and as the bolt carrier assembly 3 continues its forward motion so the bolt chambers the cartridge and continued forward movement of the block 300 causes the cam pin 318 to be driven up (as viewed in FIG. 7A) the cam 343 thereby rotating the bolt and locking the bolt to the barrel extension. The impact of the block 300 against the barrel extension causes the anti-bounce weight 354 to be driven forwardly against the force of spring 357 and, due to the careful calculation of the weight of the bar 354, so the tendancy for the block 300 to bounce is substantially eliminated.

The bolt carrier assembly of this feature of the invention has the following advantages:

1. high column strength is provided by virtue of the P shaped cross-section of member 301,
2. a tunnel within the wrapped over portion of the "P" is provided for the anti-bounce weight 354,
3. the arrangement of the main drive spring 307 lying alongside the wrapped over portion of the "P" and adjacent the planar surface facilitates the maximum diameter to be given to the main drive spring since it is not necessary for it to be bounded on all sides by a sheathing,
4. the planar back face of the P shaped member 301 masks the spring from barrel heat,
5. by arranging for the sear studs to traverse the P shaped member 301 and the block 300, increased strength and rigidity is provided.

Magazine Well and Latch Assembly

In the FIGS. 8A–9B both the flat box 4' and drum 4 magazines are provided with a vertical key 410, 410' on the rear wall of the magazine and the magazines are mounted in a well 106. In the drum magazine 4, the key is formed, in essence, by two vertical ribs 411, whereas in the flat box type magazine 4' the key is provided by stamping a protusion 410' in the rear wall of the magazine.

Secured to the rear wall of the well 106, by welding, is the C cross-sectionally shaped bulkhead 510 which, as described, is also formed to provide the trigger guard 72. The bulkhead 510 is C-shaped in horizontal cross-section and has, at the top, a tang 511, the function of which will be later described. The C-shape of the bulkhead 510 acts as a keyway for the key 411, 411' and also serves to strengthen the receiver behind the magazine.

In both type of magazine the key 410, 410' has a fillet radius or chamfer 412 at the root of the key and the lips 512 of the bulkhead are arranged to cooperate with the root radius of chamfer 412. The cooperation between the lips 512 and root radius or chamfer 412 is accomplished by a jig fixture to be described later.

The purpose of the bulkhead 510 is to reduce to a minimum sideways (with respect to the barrel axis) rocking of the magazine 4. Thus, the longer the key 410 and keyway of the magazine and bulkhead respectively, are made, so the better the reduction in the sideways rocking. In the currently preferred embodiment the lateral extent of the bulkhead from the underside of pins 515 to the lowest gripping point on the key 410 of the lips 512 is given by the ratio 2.7:1, where unity is the inside width of the magazine well 106 in the receiver.

The magazine latch has the spring arm 500 secured to two latch pins 502, 503 which are arranged to be slidable through clearance associated holes in the left hand (looking forwardly) receiver wall. Both latch pins 502 and 503 have a full diameter extending through the receiver wall and a reduced diameter portion 506, 507 respectively including an initial chamfer to facilitate location of the pins 502, 503 in corresponding holes in the magazine. The latch pin 502 has only a very small chamfer and the free end of the reduced diameter portion 506 thereof is of approximately the same diameter as its corresponding hole in the magazine so as to locate the magazine in a fore and aft direction with the chamfer increasing in diameter toward the full diameter so that it is a greater diameter than that of the corresponding hole in the magazine to securely hold the magazine. The latch pin 503 has the reduced portion 507 in the region which cooperates with the hole in the magazine tapered on the fore and aft side only so as to allow for any tolerance in the spacing between the two pins with respect to the holes in the magazine. Both pins 502 and 503 are chamfered 508 on their under surface (as shown in FIG. 8B) so that the pins are pushed to move the spring arm 500 outwardly away from the receiver when the magazine is inserted from below.

The spring arm 500 is provided with the 90° twist 501 to provide a sideways (with respect to the receiver) relatively inflexible front portion and a flexible rear portion. The pins 502 and 503 are secured to the front portion of the arm 500 by axial slots in the pins engaging the major surfaces of the arm 500. The pins 502 and 503 are arranged to be a close sliding fit in the holes formed in the receiver 1, but are loosely secured to the spring arm 500 by cross pins 509. The reason for the pins 502 and 503 being mounted in loose fitting holes in the spring arm 500 is so that the latch pins can move longitudinally, and thus, change their attitude with respect to the arm 500 when the arm swings outwardly at an angle and, hence, pins 502, 503 are moved outwardly from the position shown in FIGS. 8B and 8C during insertion and release of a magazine. The spring arm 500 has the crossbar 504 as a fulcrum and an L-shape with a leg 513 providing the spring arm with its required tension to enable the spring arm 500 to act as a leaf spring in holding the latch pins 502, 503 in engagement with the magazine.

To release the magazine 4 there is preferably provided the actuator rod 505 which extends transversely through the receiver 1 to the spring arm 500 and, thus, pressure on an enlarged diameter button 517, causes the arm 500 to be swung downwardly (as viewed in FIG. 8C), thereby withdrawing the latch pins 502, 503 from the magazine 4. A spring (not shown) is, preferably, inserted between the outer wall of the receiver and the button 506 to assist in holding the actuator rod 505 away from the spring arm and to prevent the rod 505 from vibrating.

The latch pins 502, 503 thus fit through the latch holes in the receiver 1 and when the magazine 4 is in position, the latch pins fit into latch holes in the magazine. The purpose of the latch pins 502, 503 is to hold the magazine in the gun, to decrease fore and aft movements and fore and aft rocking of the magazine and to hold the magazine rearwardly against the bulkhead 510 thereby ensuring proper keyway contact. The distance between the latch pins 502 and 503 is dimensioned to be sufficient to prevent the aforesaid fore and aft movement and rocking.

Two fixed pins 515 at the front of the magazine well 106 extend inwardly from each side of the magazine well 106 and the purpose of these pins 515 is to form a stop for the magazine so that when the magazine is inserted into the magazine well it is not pushed upwardly beyond the latch pin 502, 503 location.

Because the key root radius or chamfer 412 is susceptible to tolerance variations, the latch pin securing holes in the magazine which cooperate with the latch pins 502, 503 are drilled utilising a jig. The drilling jig is arranged to accurately simulate the gun magazine well and key, it being understood that the distance between the lips 512 of the bulkhead is accurately predetermined and may, if necessary, be accurately milled to size. Thus, in the drilling jig, the magazine is pushed rearwardly until the root radius or chamfer 412 of the key abuts the outer corners of the simulated lips 512 in the jig. The latch pin holes are then drilled in a well of the throat of the magazine. By using such a jig the latch hole pattern in the magazine is an extremely good match with the latch pins in the spring arm when the key root radius or chamfer 412 is pushed rearwardly into contact with the outer corners of the lips 512 of the bulkhead 510.

The receiver is conveniently made from sheet material in an upper and a lower part and the side walls are advantageously strengthened by providing U-shaped lower channel sections 107 in the region of the magazine well 106 into which the upper part of the receiver is nestably mounted. The triple wall provides sufficient thickness to adequately support the latch pins and the natural radius of the U-shaped sections 107 provides a rounded entry to facilitate rapid installation of the magazine 4.

FIGS. 9A and 9B are similar to FIGS. 8A and 8C except that a flat box type cartridge 4' is shown in position in the magazine well 106.

To insert a magazine 4 into the magazine well 106, the key 410 of the magazine is inserted between the lips 512, pushed upwardly (with reference to FIGS. 8A and 9A) and after being guided by the U-shaped sections 107 so the throat walls of the magazine reach the chamfer 508 on the lower side of the pins 502, 503. Continued upward force biasses the pins 502, 503 outwardly against spring arm 500 and upon meeting with the latch fixing holes in the magazine so the pins 502, 503 are forced by the spring arm 500 so as to lock the magazine in position ready for use, the pins 515 preventing excess upward travel of the magazine.

Magazines often have a last round stop actuator which, when the last cartridge is fired, moves upwardly out of the magazine and this last round stop actuator in the magazine is used to push against the tang 511 so that the rear of the magazine is forced downwardly. Thus, when the button 505 is pushed inwardly with respect to the receiver so the rod 505 pushes the spring arm 500, the pins 502, 503 are released from engagement with the magazine, and so the force of the last round stop on the tang 511 assists in ejecting the magazine 4 from the magazine well 106. It will, thus, be seen that the operation of inserting and ejecting a magazine is extremely quick and reliable.

In some guns it is not possible to have the actuator rod 505 extending through the receiver, since the interior of the receiver is occupied by, for example, a hammer trigger mechanism. Referring to FIGS. 8A and 8C, to overcome this problem, an actuator rod 526 (shown in broken lines in FIG. 8A) is mounted lower on the receiver wall and way or may not extend through both receiver side walls. A U-shaped arm 527 (shown in broken lines) is provided which extends from the rod 526 under the receiver to be positioned between the spring arm 500 and the receiver side wall adjacent therewith. A compression spring may be inserted between the receiver wall and the arm 527 which abuts an enlarged diameter head of the rod 526. The U-shaped arm 527 is, preferably, located in position on the side of the receiver adjacent the spring arm 500 by being inserted over a pin (not shown) in the receiver wall, which pin may be an extension of the rod 526. In operation of such an embodiment, depression of the rod 526 causes arm 527 to push outwardly against spring arm 500 to thereby release pins 502, 503.

Receiver and Barrel Construction

Referring to FIGS. 10A–10D, the receiver 1 is formed from an inverted U shaped upper channel 115 which is secured by welding 117 to a shorter U shaped lower channel 116 having extended arms 118. Both channels are formed from sheet material.

A region of the lower channel 116 is cut and bent to form U shaped channel sections 107 into which the upper receiver channel 115 is nested so as to thereby form a wall of increased thickness around the magazine well 106.

By arranging the lower channel 116 to be mounted inside the upper channel 115 the top minor surface edge of the channel 116 is able to act as the guide rail 101 upon which the bolt carrier assembly 3 slides.

At the forward end of the upper channel 115 and forming the front wall 119 of the receiver is a further generally U shaped member having limbs 120 and a cap 121 which are secured to the channel 115 by welding 122 the limbs 120 to the channel 115 and fillet welding 123 the cap 121 to the channel 115. The front wall 119 has a circular aperture 124 for the gas cylinder, a further circular aperture 125 for the barrel 10 and another circular hole 126 for the fore grip attachment. The upper channel 115 has cooling apertures 105, an ejector slot 104 in the right hand side through which spent cartridges are ejected from the receiver and a longitudinal slot 108 (shown in phantom lines since it is on the left hand side of the receiver) for the cocking handle assembly.

The bulkhead 510 of C shaped cross-section has an upper tang 511 the purpose of which is to assist in ejection of spent magazines. The lower channel 116 has an aperture 527 for the trigger 730 and secured to the bulkhead 510 and lower channel 116 is the trigger guard 72.

At the rear of the receiver 1 is a channel 131 having side arms 132 which are spot welded to the upper and lower channels 115, 116 respectively and a back 133 spaced from the channels 115, 116 by bowed sections 134 so as to permit sliding entry therebetween of the rear wall 100 (shown in FIGS. 1–4). The back 133 has a rectangular aperture 135 so as to permit access to the interior of the receiver for removal of the bolt carrier assembly 3 when the receiver rear wall 100 is slid downwardly.

The rear sight assembly 96 is formed in part by the arms 132 and a channel 128 of U shaped cross-section.

The barrel 10, shown particularly in FIG. 11, at one end has the external screw thread 112 to which thread is secured, by virtue of a cooperating internal screw thread, the barrel extension 110. The barrel extension 100 sandwiches the barrel extension block 113, having a rectangular cross section and a barrel heat shield 136 on to a shoulder of the barrel. The barrel heat shield 136 is formed of narrow gauge stainless steel and at its end adjacent the block 113 is U shaped and apertured to pass over the screw thread 112. The heat shield 136 has longitudinal wings 137 and, at its forward end is a lip 138 which partially circumferentially surrounds the barrel 10. A vertical screw threaded hole 143 is provided in the barrel extension block 113 to permit securement of the foregrip 12.

The barrel has a bore 140 and the rearwardly inclined gas port 900 extends from the exterior of the barrel to the bore 140 and at the outer end of the gas port 900 is an axial (to port 900) enlargement 905. Although the gas port 900 is shown in FIG. 11 as being formed in the barrel at the intermediate assembly stage, the gas port is not in fact provided until the barrel is inserted into the receiver; in such a sequence it is ensured that the port 900 is appropriately aligned. Located behind the enlargement 905 is a shoulder 139 against which the foresight 95 and part of the gas system is mounted. At the end of the barrel 10 remote from the barrel extension 110 is an external screw thread 141 upon which the flash suppressor 99 is secured. An under-cut 142 is provided between the screw thread 141 and the gas port 900 upon which the bayonet lug attachment 98 is secured.

The barrel 10 is generally reduced in cross-section from the barrel extension 110 to the screw thread 141 so as to reduce weight and harmonic motion at the screw thread 141 end of the barrel.

The barrel extension 110 is broached in conventional manner to provide the locking lugs 111 and feed ramp 114 and the barrel is machined to provide the cartridge chamber 109.

In assembling the barrel 10, the heat shield 136 and barrel extension block 113 are slid over their seating shoulder on the barrel and the barrel extension 110 is then screwed on to thread 112 so as to prevent axial movement of the shield and barrel extension block.

Referring now to FIGS. 12A, 12B, and 12C, the barrel sub-assembly is arranged in the receiver such that the screw threaded hole 143 is vertically downwardly directed and a magazine guide 146 is welded to the barrel extension block 113. The magazine guide 146 has a face 147 which prevents the cartridges from becoming jammed under the rear edge of the barrel extension. The barrel extension block 113 is then welded in position to the receiver channels 115 and 116. An inclined drilling is made in the block 113, through the barrel extension 110 into the barrel and a pin 144 having an external screw threaded end 145 is inserted to prevent relative rotation between the parts thus secured. The purpose of the screw thread end 145 is to enable removal of the pin 144 should this become necessary for dissassembly of the parts locked thereby. The thus pinned barrel sub-assembly is then machined to provide gas port 900 and enlargement 905.

From FIG. 12A, it will be seen that the barrel 10 extends through the aperture 125 in the front wall of the receiver and is arranged to be a sliding toleranced fit. The ratio distance from the rear end of the block 113 to the gas port 900: rear of the block 113 to the front face of the receiver front wall 119 is, 1.327:1. By the expedient of such a ratio, since the barrel is secured at its rear end by the block 113 and downward leverage is produced at the gas port 900, so the leverage is reduced by arranging the receiver front wall 119 to support the barrel as close as possible to the gas port 900.

Furthermore, it will be realised that the receiver 1 utilises a single, unitary, upper channel 115 which extends from the front support surface defined by the aperture 125 to the receiver back 133 upon which the buttstock 2 abuts, with the result that a rugged and yet, because of the U shaped channel design, light weight construction is provided. Additional strength is provided by the present particular receiver construction in that the recoil force of a cartridge discharge is exerted through the barrel extension to the block 113 hence through a double thickness wall produced by the overlapping channels 115, 116 to the buttstock. The arrangement of the upper U shaped channel 115 overlapping the lower U shaped channel 116 has the advantage, previously mentioned, that the rail 101 upon which the bolt carrier assembly slides is provided.

The front wall 119 has the added function of keeping dirt out of the receiver since it will be appreciated that although the front portion of the receiver 1 has cooling slots 105, dirt is unable to pass through the slots upwardly and rearwardly due to the provision of the heat shield 136, the wings 137 of which are arranged to contact the interior side walls of the channel 115. In the finished gun a cover is provided over the ejector port 104 so that the bolt carrier assembly 3 is kept free of dirt.

Cocking Handle Assembly

Referring to FIGS. 13A and 14 there is shown housed within the receiver 1 the bolt carrier assembly 3 including the P shaped member 301 having the forward bush 308 through which the guide rod 303 for the main drive spring 307 is forwardly located. The guide rod 303 extends substantially between the front wall 119 and the rear wall 100 of the receiver which is located by the channel 131. Mounted within the closed portion of the P shaped member 301 is the anti-bounce weight 354 which is biassed by spring 357.

The cocking bar sub-assembly 60 (shown particularly in FIG. 16) has the cocking bar 600 having rounded ends to which is welded a limit plate 605 and a forwardly disposed T-shaped stud 606 of circular cross-section forming, with the bar 600 a groove 607 which is arranged to cooperate with a slot 108 in the receiver (shown in FIGS. 15A, 15B and 15C) so as to thereby provide a guide for the cocking bar. Secured to the limit plate 605 is an externally threaded stud 608 for securing the handle 601 and a stop pin 609. The limit plate 605 has a rounded lower front edge 610, to nest, when the bar 600 is forwardly positioned, with a corresponding radius 611 of C shaped member 602 (shown in FIGS. 13B and 15A) and a notch 612.

The cocking handle 601 (shown in FIG. 13B) is cylindrical having an end closure face 613, a knurled outer surface and an inner concentric part 614 having an internal screw thread which cooperates with the stud 608. The locking pin 604 is secured to the end face 613 and within the annular portion of the handle 601 is a compression spring 615 which acts between the fixed stop pin 609 and the movable locking pin 604. With the cocking handle 601 and spring 615 assembled to the cocking bar sub-assembly 60, the handle is free to rotate about the threaded stud 608 and the rotation of the handle 601 is limited to less than one half revolution by the locking pin 604 contacting the forward lower part of the limit plate 605 in the clockwise direction (viewed in FIG. 13B) and the notch 612 in the anti-clockwise direction, thus preventing the handle from being unscrewed.

As shown in FIG. 15A, the longitudinal slot 108 has an escape hole 150 for the stud 606 and the C shaped sheet member 602 is welded to the receiver at each side of the slot 108 to provide rigidity to the receiver and a forward stop, by virtue of the limit plate 605 nesting with radius 611, for the cocking bar sub-assembly 60. The member 602 has the upper portion of the C removed to form the U-shaped, extended, leg 603, the leg 603 acting as a rail for the cocking bar 600. It is to be noted that the limbs of the U shape leg 603 are of different height with the limb remote from the receiver being longer to locate the bar 600. A notch 616 is formed in the leg 603 with which the locking pin 604 of the cocking handle cooperates as will be described hereinafter. In FIG. 15A, the cocking bar sub-assembly is shown in phantom lines at the section of double arrow headed line B—B so as to show the cocking bar removed from the receiver, and at the section of double arrow headed line C—C the front portion of the cocking bar is shown in phantom lines mounted in position of the receiver 1—the respective sections being shown in FIGS. 15B and 15C.

Prior to insertion of the cocking bar sub-assembly 60 into the receiver 1 the bar 600 is provided with a set so as to ensure that the rearward end of bar abuts a recess 151 in the wrapped portion of channel 131.

To assemble the cocking bar sub-assembly 60 to the receiver 1 the stud 606 is inserted into the escape hole 150 and the bar 600 pushed forwardly (to the left in the FIGS. 13A, 14 and 15A) so that the bar passes under the bridge formed by the C shaped member 602 and the stud 606 is guided and trapped within the slot 108 by groove 607. The bar is also guided by the rail formed by leg 603 by sitting upon the upper edge of the U-shape adjacent the receiver. The spring 615 biasses the locking pin 604 so that the pin 604 runs along the top of the other upper edge of the U-shape leg 603 remote from the receiver. As the front edge 610 of the limit plate 605 abuts the internal radius 611 of the bridge, so the locking pin 604 is biassed in a clockwise direction into notch 616. The cocking handle 601 is thus locked against fore and aft motion and the stud 606 engages a slot in the bolt carrier assembly, this position being shown in FIG. 13A.

To cock the gun, since the cocking bar is normally forward of a user, the user in moving his hand forwardly onto the top of the cocking handle 601 naturally tends to continue his hand movement so that the handle 601 is rotated anti-clockwise (as viewed in FIG. 13B) and the locking pin 604 is rotated out of notch 616 and strikes the underside of notch 612. The bolt carrier assembly is then drawn rearwardly by stud 606 to cock the gun by pulling the handle 601 to the right as shown in FIGS. 13A and 14, so that the handle 601 adopts the position shown in FIG. 14 and the rear rounded end of the cocking bar abuts the recess 151 in the channel 131. The bolt carrier assembly is held rearwardly by the sear 7 (shown in FIGS. 2–4). The gun is now cocked, but before use the handle 601 is pushed forwardly so that it is in its locked position as shown in FIGS. 13A and 13B by the locking pin 604 being biassed by the spring 615 into the notch 616. The gun is thus ready for firing and it will be realised that when the cocking bar is in its forward position, the bar covers the slot 108 so as to prevent the ingress of dirt.

By providing a rotatable cocking handle 601 which, when being turned for cocking, moves in a direction that is natural to a user, a fast cocking operation may be performed.

Buttstock Securing Arrangement

As described above, the gun now shown in FIG. 17A has the buttstock 2 connected to the rear end of the receiver 1. Mounted alongside the receiver is a magazine latching assembly 5 and in FIGS. 17A and 18 on each side of the receiver is a rod 226 formed into a U-shape extending into the receiver interior which acts as a magazine stop arranged to prevent over insertion of a magazine in the base of the receiver. The cocking handle assembly 6 is provided and a trigger assembly 73 has a sear actuator 77. The rear sight assembly 96 is provided at the rear of the receiver.

The buttstock securing arrangement has two tubular bushes 200 welded to each side of the receiver 1, the bushes having a groove 201 cut into a part of the wall thereof and, to accommodate side arms 132 of a channel 131 supporting the rear wall 100 of the receiver a cut out 202 is made in the bushes 200. At this stage, the hole 203 running longitudinally through the bushes is of smaller size than is eventually required.

Referring to FIGS. 17B and 19B, a spring 204 having a U-shape in plan elevation under the receiver and a U-shape in end elevation to provide arms 205 extending up the receiver side walls is secured in a slot 206 in the receiver by a screw 207 passing through the spring 204, receiver lower wall and into a tapped rectangular block 208. The extent of the arms 205 up the receiver walls is such that they pass through the grooves 201 in the bushes with a large clearance. A release button 209 is provided on each of the arms 205 below the bushes so that by squeezing the buttons 209 inwardly of the receiver the natural spring tension of the arms 205 which is arranged to be outwardly from the receiver, may be overcome. As shown in FIGS. 19A and 19B the sear buffer 705 is a generally U-shaped spring having limbs 707 which are each provided with an inward, with respect to the plan cross-section of the receiver, bow 708 to provide a spring tension when the open ends 709 of the buffer are pulled in a leftwards direction (viewed in FIG. 19A). The sear buffer 705 has an internal cross-section in the region of the rectangular block 208 of similar dimensions to the width of the block so that the block 208 laterally locates the bottom of the U shaped sear buffer. The rod 706 passes through the arms of the sear buffer into the opposing side walls of the receiver thereby securing the rear end of the sear buffer against longitudinal motion.

In FIG. 19A both types of buttstock envisaged to be used with the gun are shown with the conventionally styled profile buttstock 2 being shown in the lower position and a telescoping rod buttstock 2' being shown in the upper position. The buttstock 2 is made of a plastics material and it is therefore not possible to weld securing guide rods 210, which cooperate with the bushes 200, directly to the buttstock. To overcome this problem, the guide rods 210 are firstly welded to a sheet metal U-shaped channel 211 having a countersink hole 212 therein and a counter-sink screw is then passed through the hole 212 into the end of the buttstock. The guide rods 210 have notches 213 which face one another and cooperate with the arms 205 of the spring 204 and the ends of the guide rods 210 which, in operation, firstly engage with the bushes 200 are provided with an internal bevel 214 to assist entry of the guide rods into the bushes. The rod buttstock 2' has similar guide rods 210' except (as shown in FIG. 18) that they are extended and folded to a U-shape and subsequently the arms of the U-shape are provided with a right angled bend 215 and a strengthening cross piece 216 is welded across the internal radius of the bend 215. A wire 217 is wrapped around the downwardly (as viewed in FIG. 18) portion of the buttstock 2' and subsequently coated with a plastics material 218.

In FIG. 18, the collapsible buttstock 2' is shown in both extended and contracted positions and in the contracted position (shown by chain dotted line) the rods 210' are inserted through the U-shaped loop of a rod 226 provided one on each side of the receiver at the front of the magazine well 106. The lower limb of the U-shaped rod 226 has a dual function namely that of providing a bottom guide for the rod 210' and, (as previously mentioned) a limit stop for a magazine (not shown).

The distance "X" between the axial centre line of the bushes 200 is accurately determined using a jig fixture and by drilling the internal diameter of the bushes to the required size after the bushes have been welded to the receiver. This precaution is taken to overcome tolerance variations in the receiver width and in welding the bushes to the receiver. Because the bushes 200 are welded to each side of the receiver they serve to reinforce the rear end structure of the receiver.

Since the guide rods 210 are required to fit the bushes 200 on the receiver their distance apart must also be "X" but because variations are found in the width of buttstocks, the width of channel 211 and the straightness of the rods 210, a particular method is required to ensure that the spacing of the rods 210 is also "X".

As shown in FIGS. 20 and 21 the rods 210 are provided with a dog leg 219 at a predetermined distance along their length such that the top and bottom parts of the rods have axes which are offset from one another by an amount equal to or greater than one half of the maximum allowable tolerance in the width of the channel 211. The two rods 210 are then mounted into a jig fixture 220 which has holes for receiving the rods 210 spaced apart by the distance "X". The rods 210 are rotated in the jig fixture 220 so that the distance between the free ends of the rods is able to vary between "X" plus the tolerance on the high side of the width of the channel 211 to "X" minus the tolerance on the low limit of the width of the channel 211—these positions being shown in FIGS. 20 and 21 respectively. The rods are thus able to closely abut the channel 211 and are then welded thereto. By utilising such a method of securing the rods 210 to the channel 211 the ends of the rods 210 which are to be inserted into the bushes maintain the required distance "X" apart.

Because of tolerances in the distance from the channel 211 to the notches 213 in relation to the distance from the rear channel 131 of the receiver to the arms 205, the spring 204 is provided with adjustment by virtue of the slot 206. Such adjustment is necessary with a profile buttstock since such stocks are usually used where accuracy is required and for such accuracy the buttstock must be firmly secured to the receiver. The length of the slot 206 is thus equal to or greater than the tolerance variations that are incurred in the relevant buttstock parts. With the screw 207 loosened, the rods 210 are inserted into the bushes 200 until the arms 205 engage in the slots 213. The buttstock is pushed tightly against the rear receiver channel 131 and the forward, i.e., left hand (as viewed in FIG. 17B and 19A) edge of the arms 205 are pushed forwardly against the front of the notches 213. The buttstock is thus trapped in a forward, tight fitting, engagement with the receiver and the screw 207 is then tightened. The location of the arms 205 which form the latch for the buttstock are thus set for that particular buttstock and each time the same buttstock is replaced on the gun it will be located by the latch and fit firmly against the receiver rear channel 131.

To release the buttstock 210 or 210' the buttons 209 are squeezed together and the buttstock pulled rearwardly.

It will be realised that although the buttstock securing arrangement has been described in connection with a gas operated gun, the invention is not so limited and may be applied to other types of gun.

Sear Buffer Arrangement

The sear buffer 705 shown particularly in FIGS. 22A and 22B, is a U-shaped member having side limbs 707 with a rod 706 extending through the part of the limbs near the base of the U-shape and through three thicknesses of receiver wall. The buffer is thus supported in a longitudinal direction by the rod 706, and to support the buffer laterally a block 208 is provided between the limbs 707 which is secured to the receiver base. The limbs of the buffer are also located in a vertical direction, by the cross bar 504 of the magazine latch abutting the top of the limbs. The limbs 707 are inwardly bowed 708 with respect to one another so as to provide the limbs with resilience. The open ends 709 of limbs have feet comprising a heel which rests on the lower wall of the receiver and, a toe portion through which the transverse rod 701 extends to pivotally support the sear 700 between the feet.

The sear 700 has wings 710 which overlap the top of the limbs and rest on the limbs when the trigger is released. The sear also has a longitudinal groove 711 to permit a longitudinally extended portion 339 of the bolt carrier assembly block 300 to pass therethrough. As previously described, mounted at the rear of the bolt carrier assembly 3 are two sear locking lugs 325, which are arranged to cooperate with the rear of the sear, such that when the sear 700 is in the position shown in FIGS. 2 and 22B the bolt carrier assembly 3 is prevented from moving forwardly to a firing position.

When the forward lip 712 of the sear is rotated in a clockwise direction (as viewed in FIG. 22B) by the trigger assembly 73 and sear actuator 77 the rear of the sear is removed from engagement with the lugs 325 and the main drive spring 307 drives the bolt carrier assembly 3 forwardly to the firing position. In the present gas operated gun the bolt carrier assembly 3 is driven rearwardly by the gas system 9 so that the lugs 325 are behind the rear of the sear 700. If the trigger is still pulled so that the sear is rotated out of the path of the sear lugs then the gun will continue on an automatic cycle. If, however, the trigger is released so that the sear returns to the position shown in FIG. 22B then the sear lugs 325 will contact the rear of the sear and cause an extension of the limbs 707 of the sear buffer with the result that the bow in the limbs is slightly reduced, but because the limbs 707 are made of a material which has a degree of elasticity, for example tempered steel, the normal bow in the limbs is returned after impact by the locking lugs 325, i.e. the limbs act as an extension spring.

The principle purpose of the buffer 705 is to reduce damage to the abutting surfaces and vulnerable adjacent edges of the sear and sear lugs caused by contact when the sear is only partially rotated toward the rest position shown in FIG. 22B.

Sear Actuator

The partial view of FIG. 23A shows the receiver 1, trigger assembly 73, trigger 730 the sear actuator or safety catch 77, and the spring arm 500 of the magazine latch assembly 5.

Referring now to FIGS. 23B and 23C the trigger assembly 73 has an arcuate finger pull trigger 730 pivotally mounted on the rod 731, the trigger 730 being biassed by the spring 732 disposed in a blind hole 736 within the trigger 730, one end of the spring 732 acting against the closure of the blind hole 736 and the other end of the spring acting against the trigger spring retainer 733 which is stationary in respect to the receiver. The retainer 733 is located in a guide slot 734 in the trigger to permit the trigger to move arcuately. The trigger has a central portion 737 and two wings 738, the rod 731 passing through the wings 738 into the receiver side walls. The trigger has a tail 739 on which is provided the top rear face 735 which operates the sear 700 through the intermediary of the sear actuator 77. The sear 700 is pivotally mounted by the transverse rod 701 onto the buffer 705 and the sear 700 is biassed in an anti-clockwise direction (as viewed in FIG. 23C) by the compression spring 702 which is located on the stud 704, secured to the base of the receiver, and in the recess 703 in the sear.

The selector 77 (shown in FIGS. 23A–23D) has a lever 775 connected to the hollow cylinder 770 which extends between the side walls of the receiver 1 and slidingly mounted across the axis of the cylinder is the actuator 771 having a circular cross-section. The actuator 771 is biassed downwardly toward the trigger tail 739 by a cantilever spring 772 which is secured by fitting free ends of the spring in a cross bore in the actuator 771 and through a mutually perpendicular radial wall of the cylinder 770. Within the receiver, the cylinder 770 is provided with opposing non-parallel flat surfaces 773 and 774.

In operation, with the lever 775 horizontal and the trigger released, as shown in FIGS. 23A–23D, the lip 712 of the sear abutting the surface 773 is in parallel contact with the surface 773 and the actuator 771 is biassed downwardly by spring 772 to abut the trigger top rear face 735 which is out of contact and not parallel with the surface 774, as shown in FIG. 23D. When the trigger 730 is pulled to the rear of the receiver, i.e., to the right as shown in the FIGS. 1, 23A to 23C and 25, then the trigger rotates against the force of spring 732 and the trigger pushes the actuator 771 upwardly against the force of spring 772 to the position shown in FIGS. 3, 24 and 25 so that the tail top rear surface 735 of the trigger is then in contact with and parallel with surface 774 and the actuator 771 pushes against lip 712 thereby rotating the sear 700 in a clockwise direction as viewed in FIG. 23C against the pressure of biassing spring 702. The top rear of the sear is thus rotated out of the path of the sear lugs 325 to permit the bolt carrier assembly 3 to move forwardly toward the firing position.

When the lever 775 is rotated through 90 degrees anticlockwise (as viewed in FIGS. 1, 23A, 23C) to the position shown in FIG. 25 so the actuator 771 is rotated out of abutment from the trigger and the trigger tail top rear face 735 abut the full diameter circular portion of the cylinder 770. Thus, when attempt is made to pull the trigger it does not move since it is in contact only with the cylinder 770 and thus does not impart any force to the sear through the actuator 771, and thereby renders the sear inoperable.

The lower edge of spring arm 500 acts as a stop surface to limit rotation of the selector 77 to a right angle by, in one direction a knob 777 abutting the arm 500 and in the other direction a corner 776 of the lever 775 abutting the arm 500. However, in some embodiments it may be desirable for the selector 77 to have three predetermined positions and the corner 776 is then removed to permit the lever 775 to rotate through 180° with the predetermined positions being angularly spaced at 0°, 90° and 180°.

Trigger Mechanism

The trigger mechanism shown in FIG. 26 is mounted within a receiver 1 and comprises a trigger assembly 73 connected to a sear 700 through the intermediary of a sear selector 77. Secured to the lower receiver is a trigger guard 72 which is integral with a bulk head 510 that is arranged to partially locate a cartridge magazine (not shown). A bolt carrier assembly 3 having a block 300 within which is slidably and rotatably mounted a bolt 317, has a P cross-sectionally shaped sheet member 301 with the upright of the P being horizontally disposed and welded to the block. Inside the wrapped over, enclosed portion of the P is a spring biassed anti-bounce weight (not shown) and longitudinally disposed adjacent to the non-enclosed portion of the P is a main drive spring assembly (also not shown for clarity). Mounted through the P-shaped member 301 and block 300 are a pair of vertical sear lugs 325, one on each side of the gun longitudinal axis (only one of which is shown in the sectional view of FIGS. 26 and 27), and the bolt carrier assembly, shown in solid lines, is shown with the lugs 325 engaged with a top rear portion of the sear 700.

The trigger assembly 73 has an arcuate finger pull trigger 730 pivotally mounted on a rod 731, the trigger 730 being biassed by a spring 732 disposed in a blind hole 736 within the trigger 730, one end of the spring 732 acting against the closure of the blind hole 736 and the other end of the spring acting against the trigger spring retainer 733 which is stationary in respect to the receiver 1. The retainer 733 is located in a guide slot 734 in the trigger to permit the trigger to move arcuately. The trigger has a tail 739 having a top rear face 735 which operates the sear 700 through the sear selector 77.

The sear selector is a rotatable safety catch having a lever (not shown) external of the receiver to rotate a hollow cylinder 770 which extends between the side walls of the receiver and slidingly mounted across the axis of the cylinder is an actuator 771 having a circular cross-section. The actuator 771 is directed downwardly toward the trigger tail 739 by a cantilever spring (not shown) and in the position shown in the FIGS. 26 and 27, the actuator 771 is able to transmit motion of the tail 739 to a lip 712 of the sear.

The sear 700 is pivotally mounted on a transverse rod 701 which secures the sear 700 to a sear buffer 705. The lip 712 of the sear is biassed downwardly toward the trigger tail 739 by a compression spring 702 that is mounted within a recess 703 in the sear and on a stud 704 secured to the lower receiver wall. Positioned in front of the lip 712 is an L-shaped nose 720 having the base of the L remote from the lip 712.

Secured on the same pivot rod 731 of the trigger is a prop member 745 having a nose 746 which abuts with the trigger and a tail 747 which is arranged to cooperate with the L-shaped nose 720. The nose 746 is biassed by a spring 748 toward the trigger.

The top of the sear has a rear portion 715 which is angled and has a greater depth than a front portion 716, the front and rear portions being separated by a safety, sear lug engaging, notch 717. A review of FIGS. 26 and 27 will show that the rear portion 715 is arranged to be substantially horizontal when the trigger is at the rest position and the front portion is arranged to be angled slightly downwardly with respect to the horizontal when the trigger is pulled (as shown in FIG. 27).

In FIG. 26 the bolt carrier assembly 3 is shown in phantom lines with the lugs 325 held by the safety notch 717 and the forward extent of the bolt 317 will be observed. It will be realised, therefore, that the bolt 317, if not held by the rear portion of the sear, will be held by the notch 717 so that a cartridge in the feed area 103 will not be inadvertently chambered.

In operation with the bolt assembly 3 held by the sear, either at the rear of the sear on in the notch 717, the tail 747 of the prop member is situated in the angular space formed by the L-shaped nose 720. As the finger pull 730 is pulled rearwardly, so the trigger rotates in a counter clockwise direction (as viewed in the Figures) with the result that the top rear face 735 of the trigger pushes the actuator 771 against the lip 712 of the sear to thereby rotate the sear in a clockwise direction. As the trigger and sear rotate, a position is reached where the lugs 325 are no longer held by the sear but the tail 747 is arranged to be of such a length that although the lugs are released by the sear the tail 747 is held in abutment with the inside, base, edge of the L-shaped nose 720. Assuming that the lugs 325 are initially held at the rear portion of the sear then as the bolt moves forwardly (to the left as viewed in the Figures) then the sear will be further rotated in a clockwise direction by the sear lugs engaged on the top surface of the sear. Such action, by itself, is sufficient to rotate the nose of the sear out of contact with the tail 747. It will be realised that normally the trigger will continue to be rotated in a counter clockwise direction and that whilst the trigger is rotating counter clockwise and the tail 747 is held by the nose 720 then the nose 746 will move out of contact with the trigger. As soon as the tail 747 is released by the nose 720 so the member 745 flips in a counter clockwise direction so that the nose 746 abuts the trigger and the tail 747 moves under the base of the L-shaped nose 20 (as shown in FIG. 27). Such action moves the notch 717 out of the path of the lugs 325. As long as the trigger is pulled and there are cartridges to be fired so the bolt carrier assembly 3 will move backwards and forwards as shown in phantom lines in FIG. 27.

When now the trigger is released, i.e. it moves in a clockwise direction, so the trigger rotates the prop member 745 in a clockwise direction with the result that the tail 747 begins to move from under the base of the L-shaped nose 720. Coincident with rotation of the prop member 745 is, of course, counter clockwise rotation of the sear 700. Continued release of the trigger causes the actuator 771 to move out of contact from the lip 712 and the sear to be held by the nose 720 being supported by the tail 747. As the trigger is released further, so the prop member is rotated until the tail 747 no longer supports the nose 720 and the member 745 flops causing the sear to flop onto the actuator 771.

The time taken for the sear to flop from release of support by the tail 747 to being supported by the actuator 771 is determined by the force exerted by the spring 702 and the mass of the sear 700 and this time is predetermined to be greater than the time taken for the lugs 302 to travel from the rear of the sear past the notch 717 in a normal firing cycle. In this manner, it is not possible for the bolt carrier assembly lugs 325 to be inadvertently caught by the notch 717 during a firing cycle.

Additionally, quick release of the sear when the trigger is released enables the sear to rise into the path of the lugs in a greatly reduced portion of the gun cycle time as compared with a system where the sear moves coincident with the slow release of the trigger. Thus an additional advantage of the present invention is provided in that there is a higher probability of full area engagement between the sear and the lugs during the impact of stopping the bolt.

Adjustable rear sight for a gun and a gun embodying the same

In the FIGS. 28A–31 a gun receiver 1 is provided with a rear sight mount 96 within which is pivotally mounted a rear sight 960. The rear sight 960 has a sight bar 961 provided with a shorter range mode viewfinder 962 in which is disposed a sight aperture 963 for operation in the mode of FIG. 29. The sight bar 961 has a longitudinal slot 964 through which the longer range mode viewfinder 965 having an aperture 966 may be used when the sight is in the mode shown in FIG. 30. Combined with the longer range viewfinder 965 is a sight slide 967 which moves along a ramp 968 of the sight mount 96.

Referring now to FIG. 31, the slide 967 has an axial blind bore 969 and a relieved transverse portion 970 which extends into the bore 969, and extending along the axis of the bore 969 is a slot 971 which combines with the portion 970 to form, in an axially transverse direction, a C-shaped opening through the slide 967. A compression spring 972 is inserted into the bottom of the blind bore to bias a plunger 973 which is formed from a circularly cross-sectioned rod having in an outwardly facing end a blind hole 974 for receiving one end of the spring 972. The plunger 973 is provided with a transverse, tapped hole 975 and a transverse groove 976 is formed which cuts along the axis of the tapped hole 975 to remove one half portion of the tapped hole. When the plunger 973 is inserted into the slider 967 and the spring 972 is compressed, the remaining tapped portion of hole 975 is arranged to engage an adjusting screw 977 which is mounted in a contoured part of the sight bar 961.

The adjusting screw 977 has a knurled finger knob 978 and a circularly cross-sectioned enlargement, protrusion 979 which is located in a slot 980 of the sight bar 961. The adjusting screw 977 is biassed by an L-shaped torsion spring 981 having one limb inserted into a hole in the sight bar 961 and the other limb of the spring 981 extending partially under the knob 978. The knob 978 is provided with grooves to cooperate with the spring 981 at 90° intervals so that a click-stop arrangement for the adjusting screw is provided at quarter turn intervals. The spring 981 has the further function of tensioning the screw 977 so that the protrusion 979 is in firm abutment with one side of the slot 980. The internal C-shape of the slide 967 extends from the top of the slot 964 underneath the sight bar 961, around the adjusting screw 977 to the bottom (as viewed in FIGS. 28A and 31) of the slot 964, and the internal screw threads 975 of the plunger 973 are biassed by the spring 972 into engagement with the external screw threads of the adjusting screw 977. Thus, the slide 967 is reciprocal along the sight bar 961 by rotation of the adjusting screw 977 and also by depressing the plunger 973 so that the cooperating screw threads are moved out of engagement and the slide 967 is rapidly adjustable by movement along the sight bar. At the end of the sight bar 961, remote from the slot 980, is an internally screw threaded boss 981, the screw threads 982 also being formed in a relieved portion of the sight bar. Extending through the boss 981 and provided with cooperating external screw threads is a windage adjusting screw 983 which extends through the side limbs of the U-shaped rear sight mount 96.

Referring now to FIGS. 28C and 31, a windage control knob 984 is connected to the adjusting screw 983 by a spring biassed cross-pin 985 extending through a slot in the top of the control knob 984 and diametrically through the adjusting screw 983. The cross-pin 985 has relieved portions 987, into which one end of a respective coil spring 986 locates. A further cross-pin 988 extends through the opposite end of the adjusting screw 983 from the windage knob and the cross-pin 988 is arranged on an outer side of one of the U-shaped limbs of the mount 96 so that by the combination of springs 986 and cross-pin 985 the windage control knob 984 is biassed inwardly toward the sight bar 961.

The cross-pin 988 is mounted in a circular recess in the outer side of one of the limbs of the U-shaped mount 96 and the windage adjusting screw 983 is arranged so that it can be pushed inwardly towards the sight mount thereby compressing the springs 986 so that the cross-pin 988 is displaced from the relieved portion of the mount and thereby facilitating insertion and removal of the cross-pin 988. The cross-pin 988 is mounted in the circular recess to ensure that in use the pin 988 does not fall out of the adjusting screw 983. The windage control knob 984 has a square sectioned base protrusion 989 which is arranged to locate in a corresponding square-sectioned aperture in the other limb of the U-shaped mount 96 opposite from the limb against which the cross-pin 988 is located. The provision of the square-sectioned aperture and protrusion thus provides a positive lock and enables the windage control knob 984 to be rotated in 90° intervals by the knob 984 being pulled outwardly away from the mount 96 and rotated in whichever direction is required and then released for location of the protrusion 989 into the cooperating aperture (not shown). The control knob 984 has opposing flat sides and a raised lip 990 to assist in pulling the knob outwardly from the mount 96.

Referring now to FIG. 28B, a leaf spring 991 is located on the base of the U-shaped sight mount 96 by a locating pin 992 extending through a hole in the leaf spring and into a hole in the bottom of the U-shaped sight mount 96. The rear end of the leaf spring 991 is located under a stamped portion 993 of the base of the U-shaped mount 96. The end of the leaf spring remote from the rivet 992 is biassed upwardly towards the boss 981 of the sight bar 961 and the base end of the sight bar 961 has a corner 994 which abuts a stop 995 in the leaf spring when the sight bar 961 is vertically positioned thus limiting rotation of the sight bar 961.

Referring now to FIG. 29, the sight is shown in the shorter range mode but with the slide 967 at its highest position along the ramp 968 so that the sight is set to the maximum range in the shorter mode. In this respect, in a preferred embodiment and with the sight used in connection with a gun employing a 5.56 mm cartridge, the shorter range viewfinder has a range of 100–800 meters. When in use in the shorter range mode the sight may be adjusted coarsely by depressing the plunger 973 and moving the slide 967 along the ramp 968, with fine adjustment being performed by click-stop rotation of the adjusting screw 977 if desired. With the sight set to the shorter range mode, then aim is made via the aperture 963.

With the sight set to the longer range mode, as shown in FIG. 30, the face 994 is held parallel with the face of the leaf spring 991 so that the sight bar 961 is held perpendicularly relative to the gun receiver 1. In FIG. 30 the longer range viewfinder is used so that aim is taken through the aperture 966 and in the position of FIG. 30 the viewfinder ris set to the longest range which, in the present example, is arranged to be 2 km and in the longer range mode aim is taken down to 800 meters. The quarter turn adjustment with the adjusting screw 977 is arranged so that the quarter turn is equivalent to an elevational adjustment of 25 mm at 100 meters. Similarly, a quarter turn adjustment of the windage control knob 984 provides an azimuth change of 25 mm at 100 meters.

Bipod

The bipod shown in FIGS. 32A and 33 has a pair of telescoped tubular legs 800, each having an outer leg 801 and an inner leg 802. The top of the outer leg 801 is pivotally connected to a mounting assembly 803 and the lower end of each of the inner legs is connected to a foot 804 by a split pin 805.

The mounting assembly 803 is formed by a yoke-shaped sub-frame 806 having upwardly extending wings, an elongate slotted mouth 807 and a forwardly extending tube 808 which has an axially extending slot 809 in the outer periphery thereof. Connected to the sub-frame 806 and forming the other part of the mounting assembly 803 is a generally U-shaped bracket 810 having side limbs which have a major downwardly sloping surface that provides the bipod with its apex angle. Each side limb 811 is connected to a respective wing of the yoke-shaped sub-frame 806 by welding and the lower rearwardly facing portion of each side limbs 811 is arcuately contoured. Additionally, each limb is provided with a rearwardly facing slot 812 and a downwardly extending slot 813, the slots 812 and 813 being provided for predeterminedly securing the legs 800 in either a downward position for contacting the ground or in a raised position in which the legs extend rearwardly alongside the gun receiver. Referring to FIG. 32E, mounted in the tube 808 and extending forwardly through the bracket 810 is a plunger 814 on which is machined, at its outer extremity, a part spherical ball 815 which forms one part of a ball joint. The plunger 814 is biassed by a compression spring 836 and captured within the tube 808 by a cross-pin 816. The spring 836 is retained within the tube 808 by an interior wall in which is disposed an axial hole 817 having a diameter sufficient to permit the plunger stem to pass therethrough to abut a circularly cross sectioned gun mounting lug 818 (shown in FIG. 35) which is inserted, in operation, into a port 819 of the tube 808. The purpose for the abutting relationship is to reduce the possibility of the bipod being accidentally detached from the gun.

Referring now to FIG. 32B, inserted into the top of the outer leg 801 and shaped to fit inside the leg 801 is a rod 820 having its upper portion cut in an axial direction with a cruciform shape (not shown in detail). One part of the cruciform, shown in FIG. 32A and FIG. 33, is for permitting traverse of the arcuate portion of the bracket 810 and the other part of the cruciform is provided to permit the leg to be inserted over an axle 821. The axle 821 has a circular cross-section and two pairs of flat surfaces which are axially spaced with flat surfaces of each pair being diametrically opposed and the flat surfaces of the axle 821 cooperate with the said other part of the cruciform in the rod 820. Inserted into a hole in the rod 820 is a stop pin 822 which cooperates with the slots 812 and 813 of the bracket. Also suspended from the axle 821 is a hanger 823 having relieved upper portions 824 to enable hanger to rotate around the arcuate portion of the bracket 810 and relieved lower portions to provide clearance between the hanger and the gun receiver when the legs are raised. Inserted through the combination of hanger 823 and rod 820 is a take-down pin 825 having a central reduced portion to accommodate a compression spring which is located thereby and biassed therebetween and the top of an axial closed bore in the rod 820. A slot 827 passing diametrically through the rod 820 permits the leg to be axially movable so that the stop pin 822 may be removed from the slot 813 and the leg rotated around the arcuate surface of the bracket to the slot 812 with the bias of the spring 826 effectively pushing on the hanger 823 through the pin 825 causing the stop pin 822 to be pushed away from the takedown pin 825 and, therefore, into the slots 812 or 813.

In the outer wall of each of the lower inner legs 802 is formed a series of axially extending holes 828 linked together by slots 829 to form a continuous slot with a series of local expansions, as shown in FIGS. 33, 35 and 36. Circumferentially surrounding the lower end of the outer leg is a collar 830. Referring now particularly to FIGS. 32B and 32C and 32D, secured in an inner wall portion of the inner leg 802 is a pin 831 which is spring biassed against a latch button 832 by a compression spring 833, the spring being secured over a portion of the pin 831 and inside a bore of the latch button 832. The latch button 832 is circular in cross-section but has two diametrically opposed flat surfaces 834 which protrude through an aperture in the collar and in this manner, by virtue of the spring 833 and pin 831, the button is biassed outwardly against the interior wall of the collar 830. The distance between the flat surfaces 834 of the button is arranged so that the button is able to slide in the slot 829 of the inner leg and the full diameter of the button 832 is such that it is able to engage the local hole expansions 828, and by virtue of the force of the spring 833 so the button is pushed outwardly to lock the inner leg to one of the expanded hole portions in the outer leg. The collar has the added function of circumferentially surrounding the outer leg and since the outer leg is weakened by the provision of the linked holes so the collar provides a support for the lower portion of the outer leg to prevent the outer leg from splitting.

Referring now to FIG. 36, the bipod is shown partially mounted onto the lug 818 and to enable the mouth of the bipod to be inserted over the lug 818, the lug is undercut at its lower root portion and chamfered at its top outer portion. When secured to the gun the lug 818 is situated in the mouth 807 and the ball 815 is sprung loaded into a socket 834 axially arranged in front of the lug 818. The socket 834 is simply a hole drilled through a plate member and to release the bipod from the gun, the ball 815 is depressed from a forwards direction of the gun against the force of the spring 816.

To move the legs from a lowered postion, where the gun is standing upon the legs (as viewed in FIGS. 34 and 35), to the raised position where the legs lie alongside the gun receiver (as shown in phantom lines in FIG. 33 but without the gun being shown), the upper leg 801 is pulled away from the bracket 810 so that the stop pin 822 is removed from the slot 813. The leg is then rotated around the arcuate surface of the bracket 810 until the bias of the spring 826 pushes the pin 822 into the slot 812.

To extend the inner leg 802 with respect to the outer leg 801 the button 832 is depressed and the collar 830 pulled away from the bracket 810 until the desired extension is reached when the button is released to engage with one of the holes 828.

Referring now to FIG. 34, the ability of the present bipod to permit a gun to roll in the Y plane is demonstrated, and the gun (shown in phantom lines) rolls about the ball 815 and lug 818. The present invention also permits the gun to sweep in the X plane and this is shown in FIG. 35 where the gun (shown in phantom lines) is shown at one particular angle of sweep, the maximum angle being determined by the width of the mouth 807.

I claim:

1. A gun including a trigger mechanism, a reciprocal bolt means, and a lug on said bolt means, said trigger mechanism comprising a pivotally mounted trigger, a pivotal sear connected to be rotated by said trigger, said sear having a rear part which is provided to selectively engage said lug, and a notch in an upper surface of the sear (adjacent said bolt means, said notch being arranged to cooperate and engage) for engaging with said lug when said lug is not engaged with said sear rear part, an axis of said trigger about which said trigger is rotatable, and mounted on said axis a member arranged to cooperate with a portion of the sear, spring bias means for said member so that said member moves with said trigger, (whereby) the trigger mechanism being arranged such that when the trigger is pulled to rotate the sear in the first direction out of engagement with said lug the member is initially prevented from moving with the trigger by the sear portion and when the lug is released by the sear the sear is further rotated in said first direction by the lug contacting the sear upper surface to free the member to move toward the trigger and under the sear portion, thereby preventing the sear from rotating in a direction counter to said first direction until the trigger is released.

2. A gun as claimed in claim 1, wherein the sear portion is an L-shaped extension on the same side of the sear pivot as that side driven by the trigger.

3. A gun as claimed in claim 2, wherein the member is spring biassed to contact a portion of the trigger on a side of the trigger pivot remote from the sear pivot.

* * * * *

UNITED STATES PATENT AND TRADEMARK OFFICE

CERTIFICATE OF CORRECTION

PATENT NO. : 4,505,182

DATED : MARCH 19, 1985

INVENTOR(S) : Leroy James Sullivan

It is certified that error appears in the above-identified patent and that said Letters Patent is hereby corrected as shown below:

Claim 1 (Column 44, lines 66-67) delete --(adjacent said bolt means, said notch being arranged to cooperate and engage)--

Claim 1 (Column 45, line 5) delete the word --(whereby)--

Signed and Sealed this

*Twenty-fourth* Day of *June 1986*

[SEAL]

*Attest:*

DONALD J. QUIGG

*Attesting Officer*

*Commissioner of Patents and Trademarks*